US008130986B2

(12) United States Patent
White et al.

(10) Patent No.: US 8,130,986 B2
(45) Date of Patent: Mar. 6, 2012

(54) TRAPPED FLUID MICROSYSTEMS FOR ACOUSTIC SENSING

(75) Inventors: Robert David White, Medford, MA (US); Karl Grosh, Ann Arbor, MI (US)

(73) Assignee: The Regents of the University of Michigan, Ann Arbor, MI (US)

( * ) Notice: Subject to any disclaimer, the term of this patent is extended or adjusted under 35 U.S.C. 154(b) by 1380 days.

(21) Appl. No.: 11/656,849

(22) Filed: Jan. 23, 2007

(65) Prior Publication Data

US 2007/0230721 A1 Oct. 4, 2007

Related U.S. Application Data

(60) Provisional application No. 60/761,166, filed on Jan. 23, 2006.

(51) Int. Cl.
*H04R 25/00* (2006.01)

(52) U.S. Cl. ..... 381/165; 381/166; 381/174; 381/175; 381/186; 73/718

(58) Field of Classification Search ..... 381/166, 381/174–175, 186; 73/718
See application file for complete search history.

(56) References Cited

U.S. PATENT DOCUMENTS

| | | | | |
|---|---|---|---|---|
| 4,654,554 | A * | 3/1987 | Kishi | 381/190 |
| 6,295,365 | B1 * | 9/2001 | Ota | 381/114 |
| 7,214,179 | B2 * | 5/2007 | Miller et al. | 600/25 |
| 7,421,903 | B2 * | 9/2008 | Brosh | 73/722 |
| 7,570,773 | B2 * | 8/2009 | Ohbayashi et al. | 381/175 |
| 2007/0293761 | A1 * | 12/2007 | Wickline et al. | 600/459 |

OTHER PUBLICATIONS

W. Hemmert, U. Durig, M. Despont, U. Drechsler, G. Genolet, P. Vettinger, D.M. Freeman; Biophysics of the Cochlea from Molecules to Models; Proceedings of the International Symposium held at Titisee, Germany, Jul. 27-Aug. 1, 2002; pp. 408-415; World Scientific.

Gan Zhou, Louis Bintz, Dana Z. Anderson, Kathryn E. Bright; A life-sized physical model fo the human cochlea with optical holographic readout; pp. 1516-1523; J. Acoust. Soc. Am 93(3), Mar. 1993; Acoustical Society of America.

Michael J. Wittbrodt, Charles R. Steele, Sunil Puria; Developing a Physical Model of the Human Cochlea Using Microfabrication Methods; Audiology Neurotology; Jan. 17, 2006; pp. 104-112; S. Karger AG, Basel.

Charles R. Steele, Larry A. Taber; Comparison of WKB calculations and experimental results for three-dimensional cochlear models; J. Acoust. Soc. Am 65(4), Apr. 1979, pp. 1007-1018.

Von R. Helle; Selektivitatssteigerung in einem hydromechanischen Innenohrmodell mit Basilar- und Deckmembran; Acustica vol. 30 (1974); pp. 301-312.

(Continued)

*Primary Examiner* — Curtis Kuntz
*Assistant Examiner* — Ryan Robinson
(74) *Attorney, Agent, or Firm* — Brooks Kushman P.C.

(57) ABSTRACT

Silicon and glass micromachined (MEMS) acoustic sensors incorporating trapped-liquid architectures are disclosed. The trapped liquid serves as an acoustic transmission medium allowing the input port to the system to be physically separated from the sensing location. The trapped liquid interacts with a conductive, flexible sensing membrane. Sound pressure waves enter the trapped liquid through an input membrane, travel to the sensing membrane, and excite vibrations of the sensing membrane. The vibrations of the sensing membrane are measured using on-chip capacitive sensing. The capacitive sensing structure is formed by the conductive sensing membrane and a fixed conducting top electrode. As the gap between the conductive sensing membrane and the fixed top electrode varies, the capacitance varies, leading to an electrical signal which is the electrical output of the system.

7 Claims, 33 Drawing Sheets

OTHER PUBLICATIONS

R. S. Chadwick, D. Adler; Experimental observations of a mechanical cochlear model; J. Acoust. Soc. Am., vol. 58, No. 3, Sep. 1975; pp. 706-710.

Karl Grosh, John M. Dodson; Cochlear-Based Transducer Designs; NCA-vol. 26, Proceedings of the ASME, 1999; pp. 383-385.

Fangyi Chen, et al., A Hydromechanical Biomimetic Cochlea: Experiments And Models, J. Acoust Co. Am 119(1), Jan. 2006, pp. 394-405.

K.M. Lim, A.M. Fitzgerald; C.R. Steele, S. Puria; Building a Physical Cochlear Model on a Silicon Chip; pp. 222-229; 1999.

Thomas P. Lechner; A hydromechanical model of the cochlea with nonlinear feedback using PVFsub2 bending transducers; Hearing Research; Elsevier Science Publishers B.V.; pp. 202-212; 1993.

Fangyi Chen; A Hydro-Mechanical Biomimetic Cochlea: Experiments and Models, Boston University, College of Engineering Dissertation; pp. 1-405; 2005.

* cited by examiner

Silicon Processing

Pyrex Glass Processing

Bonding

Mask 1: Backside Oxide

Mask 2: Frontside Dielectric

Mask 3: Nitride

Mask 4: Polysilicon

Mask 5: Metal

Mask 6: Backside DRIE #1

TRAPPED FLUID MICROSYSTEMS FOR ACOUSTIC SENSING

CROSS-REFERENCE TO RELATED APPLICATIONS

This application claims the benefit of U.S. Provisional Application Ser. No. 60/761,166, filed Jan. 23, 2006.

STATEMENT REGARDING FEDERALLY SPONSORED RESEARCH OR DEVELOPMENT

This invention was made with Government support under N00014-99-1-0493 awarded by the Office of Naval Research. The Government has certain rights in the invention.

BACKGROUND OF THE INVENTION

1. Field of the Invention

The invention relates to trapped fluid microsystems for acoustic sensing.

2. Discussion

The typical human cochlea operates over a two and a half decade frequency band, from 20 Hz-20 kHz, covers 120 dB of dynamic range, and can distinguish tones which differ by less than 0.5%. Sounds as quiet as 0 dB SPL (20 μPa RMS) can be heard. Humans are also able to discriminate sounds temporally with spacing as small as 10-20 μs.

The human cochlea is small, occupying a volume of about 1 $cm^3$. The cochlea uses a mechanical process to separate audio signals into approximately 3000 channels of frequency information; it is a sensitive real-time frequency analyzer.

Marine mammals such as whales hear over an even broader band than humans, utilizing acoustic signals for communication (at low frequencies) and navigation (high frequency "SONAR"). One difference between submerged and in-air operation is that the middle ear impedance matching functions may be inactive or modified in marine mammals due to the different characteristic impedance of the environment.

SUMMARY

Embodiments of the invention may take the form of a micro system for acoustic transduction. The system includes an input membrane configured to vibrate in response to an excitation from acoustic energy, a liquid filled acoustic chamber having chamber walls, and a conductive membrane. The input membrane and the conductive membrane form portions of the chamber walls. The liquid transfers acoustic energy from the input membrane to the conductive membrane. The conductive membrane is configured to vibrate in response to an excitation from acoustic energy in the liquid adjacent the conductive membrane.

BRIEF DESCRIPTION OF THE DRAWINGS

FIG. 8A shows the layout of the metalization, the location of the flexible membranes, and the location of the bonding pads. FIGS. 8B-8C show the geometry of the fluid chamber and the thickness of the various thin films.

FIG. 24 is a circuit model for the 16 channel multiplexer. Only 3 of the 16 channels are shown; the pattern repeats. The 4 bit digital address selects which of the 16 switches is turned on. Based on this model, with the component values shown, −32 dB of crosstalk is expected between adjacent channels, −44 dB between channels with 1 space in between.

DETAILED DESCRIPTION

Figure 1:
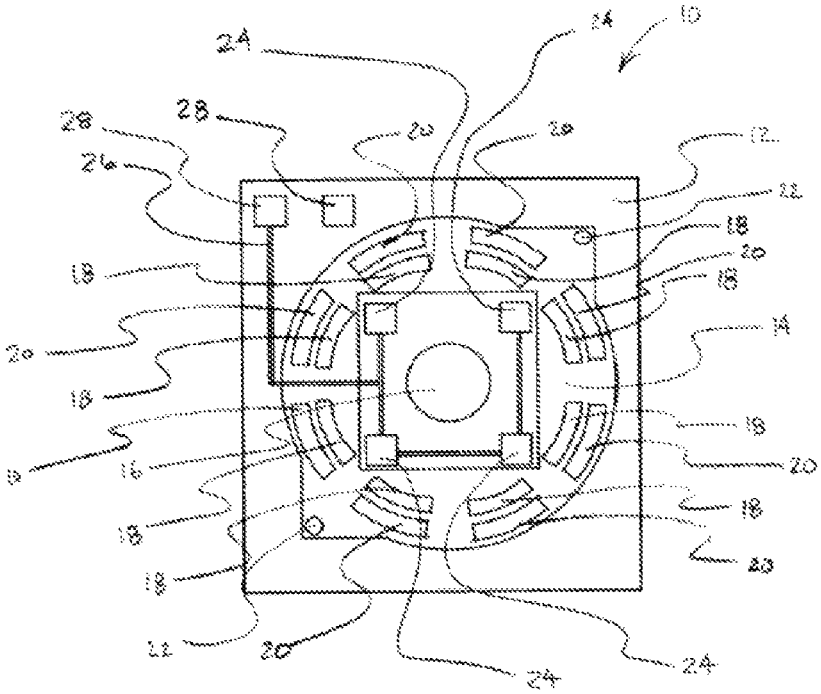
FIG. 1 is a top view of a single channel acoustic sensor system in accordance with an embodiment of the invention.

Detailed embodiments of the present invention are disclosed herein; however, it is to be understood that the disclosed embodiments are merely exemplary of the invention that may be embodied in various and alternative forms. The figures are not necessarily to scale, some features may be exaggerated or minimized to show details of particular components. Therefore, specific structural and functional details disclosed herein are not to be interpreted as limiting, but merely as a representative basis for teaching one skilled in the art to variously employ the present invention.

Low cost, high sensitivity, small size, general purpose acoustic sensors for commercial, scientific, and military applications are described. The trapped-fluid architecture is unique, and may allow the capacitively-sensed systems to be submerged, which is not true for most other types of capacitive microphones.

Some embodiments of invention include a silicon and glass micromachined (MEMS) acoustic sensor incorporating a novel trapped-fluid architecture. The trapped fluid serves as an acoustic transmission medium, allowing the input port to the system to be physically separated from the sensing location, providing mass-loading to the sensor which allows it to be submerged without compromising system bandwidth, and providing tunable mass-loading and damping to the sensor. It also allows an approximate order of magnitude sensitivity increase by area multiplication effects. Experimental results in air demonstrate sensitivities and bandwidth which are competitive with commercial piezoelectric hydrophones. The invention may be manufactured using micromachining, using highly scalable batch processing techniques.

Low-power, compact, low cost, integrated acoustic sensors and spectral analysis systems are described. Commercially, the products could be useful in low power military systems such as unattended sensors, handheld sonar, or autonomous vehicles. They could also be used in medical applications such as a cochlear implant front-end. Additional applications may exist in environmental monitoring using a low-power unattended sensor.

Some embodiments of the invention include a micromachined fluid-structure system capable of acoustic sensing and mechanical frequency analysis. This system acts as a passive mechanical filter. A capacitive sensing scheme is incorporated into the micromachined structure to produce multiple channels of filtered output, each sensitive to a particular frequency band. Inspiration for the design is taken from the structure of the mammalian cochlea. One technical innovation, which makes this device very unique, is the inclusion of both "cochlear-like" fluid-structure mechanics and integrating sensing elements into a single micromachined device. This produces a sensor/filter which functions like a human ear. Previous devices are not fully micromachined, nor do any previous cochlear-like devices include multiple-output-channel sensing.

A micromachined, trapped fluid acoustic sensor is disclosed. Some embodiments of the invention provide a unique geometry for a micromachined condenser hydrophone. A trapped fluid provides mass loading and damping. Models predict that this will allow the system to be submerged without affecting performance. The fluid chamber is also used to transmit pressure from a large "input" area to a smaller "sensing" area. Finite element results show a 28 dB displacement gain at low frequencies between the "input" and "sensing" membranes, which directly results in a 28 dB improvement in sensitivity. This ratio is the area ratio of the two sets of membranes. The displacement gain can be increased by continuing to increase the number of input membranes, as long as the total radial extent of the input membranes remains smaller than the free wavelength of sound in the environment.

Both lumped element and finite element model results predict approximately 1 nm/Pa deflection of the central membrane at low frequencies. This is the magnitude of membrane response observed with laser vibrometry between 5 kHz and 20 kHz. However, laser vibrometry measurements indicate that below 5 kHz the entire chip oscillates, perhaps due to compliance of the supporting wax. Complexities in the dynamics of this unmodeled motion may be the cause of the variability in measured electrical sensitivity below 7 kHz. The predicted sensitivity with a 1.5 V applied bias and the described preamplifier circuitry is 0.3 mV/Pa in a 10 kHz band. Measurements show mean sensitivity of 0.9 mV/Pa from 300 Hz-7 kHz, and 0.32 mV/Pa from 7 kHz-15 kHz. No sensitivity measurements were made above 15 kHz.

The mounting scheme for the sensor may be stiffened to remove low-frequency motion of the sensor on its supports, and thereby reduce the variability in low-frequency sensitivity. Secondly, the sensor can be packaged for submerged operation. This includes both sealing the electrical components away from the seawater and addressing issues of sensitivity to hydrostatic loading. Finally, electrical shielding can be incorporated to reduce crosstalk.

Some embodiments of the invention include a square silicon die 1.25 cm on a side. It consists of a 0.5 mm deep, 10 mm diameter fluid chamber, filled with silicone oil of 200 cSt viscosity. This chamber is constrained on one side by a series of flexible membranes. The center membrane is circular with either a 1 mm or 2.5 mm diameter. Arrayed around the outer portions of the chamber are two rings of 8 arc segments, each subtending 30 degrees, with inner and outer diameters. The membranes are a laminate structure consisting of 100 nm of stoichiometric LPCVD silicon nitride, 1.0 μm of p++ (boron doped) polycrystalline silicon, and another layer of 100 nm thick silicon nitride. The bottom side of the chamber is sealed by anodically bonding on a square Pyrex die 1.25 cm on a side. On the top side, a smaller square Pyrex glass die, 5 mm on a side, is bonded over the center of the silicon chip. Thin film Cr/Pt electrodes are fabricated on the Pyrex to form the parallel plate sense capacitor, one side of which is the flexible nitride/poly/nitride membrane. Incoming sound excites motion of the outer "input" membranes, generating an acoustic pressure in the fluid chamber. This causes vibration of the center membrane. With a DC bias applied across the two electrodes of the sensing capacitor, vibrations result in oscillatory charge generation. The charge is integrated by a charge amplifier to produce a voltage output.

FIG. 1 is a top view of a hydrophone system 10. System 10 includes a square silicon dye 12 which, in this embodiment, is 1.25 cm on a side. It includes a 0.5 mm deep, 10 mm diameter fluid chamber 14, filled with silicone oil of 200 cSt viscosity. This chamber 14 is constrained on one side by a series of flexible membranes 16, 18, 20. The center membrane 16 is circular with either a 1 mm or 2.5 mm diameter. Arrayed around the outer portions of the chamber 14 are two rings of 8 arc segments 18, 20, each subtending 30°. Arc segments 18 have a 7 mm inner diameter and a 7.5 mm outer diameter. Arc segments 20 have an 8.5 mm inner diameter and a 9 mm outer diameter. System 10 also includes needle fill ports 22, top electrode bond pads 24 which are connected as shown via wiring trace 26 to external bond pads 28.

Figure 2:
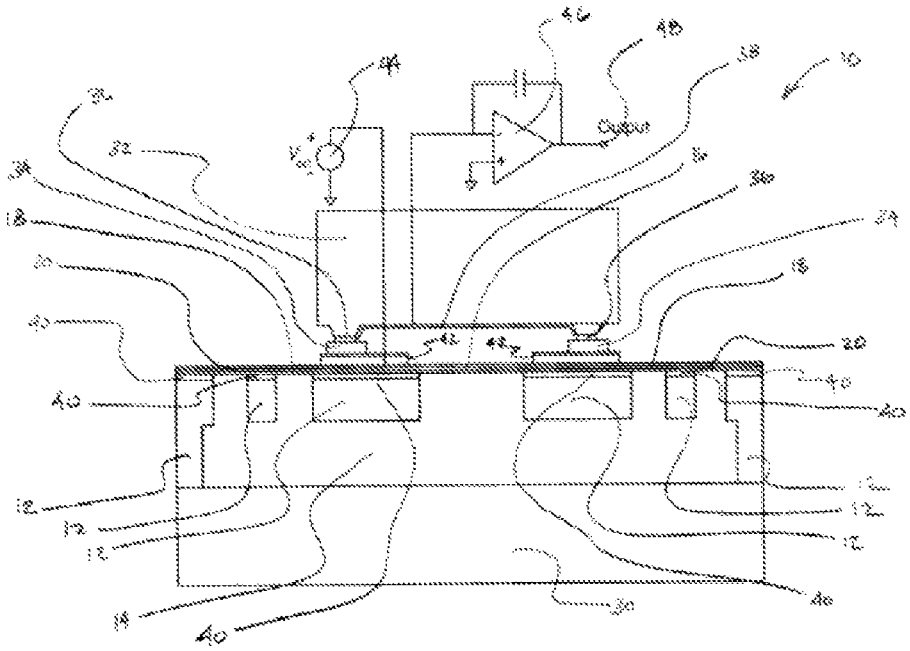
FIG. 2 is a side view, in cross section, of the single channel acoustic system of FIG. 1.

FIG. 2 is a side view, in cross section, of system 10. The membrane 16, 18, 20 are laminate structures consisting of 100 nm of stoichiometric LPCVD silicon nitride, 1.0 μm of p++ (boron doped) polycrystalline silicon, and another layer of 100 nm thick silicon nitride. The bottom side of the chamber 14 is sealed by anodically bonding on a square pyrex dye 30 which is 1.25 cm on a side. On the top side, a smaller square pyrex class dye 32, 5 mm on a side, is bonded over the center of the silicon chip 12 using Sn—Au fluxless solder bonding. The bonding includes 2 μm Au bond pads 34 and 1.3 μm Sn bonding agents 36. Thin film Cr/Pt electrodes 38 are fabricated on the pyrex 32 to form the parallel plate sense capacitor, one side of which is the flexible nitride/poly/nitride membrane.

System 10 also includes an insulating layer 40, $SiO_2$ (2 μm), an edge stop, and insulating layers 42, $Si_3N_4$ (240 nm) on $SiO_2$ (780 nm).

Incoming sound excites motion of outer "input" membranes 18, 20, generating an acoustic pressure in the fluid chamber 14. This causes deflection of the center membrane 16. With a DC bias 44 applied across the two electrodes of the sensing capacitor, deflections result in charge generation. The charge is integrated by a charge amplifier 46 to produce a voltage output 48.

Other embodiments have a single rectangular input membrane, 1.1 mm by 2.1 mm in size, located at one end of a rectangular liquid chamber. The liquid chamber is approximately 6.25 mm wide and 38 mm long. The sensing membrane is a 3 cm long, 0.1/1.0/0.1 μm thick, LPCVD $Si_3N_4$/p+ Polysilicon/$Si_3N_4$ laminate with 40 MPa net tensile stress. The membrane width tapers exponentially from 140 μm to 1.82 mm. The varying width results in varying membrane compliance, leading to a frequency-position map: high frequencies excite motion close to the narrow end, low frequencies close to the wide end. Silicone oil of 200 cSt viscosity is used to fill the liquid chamber. The bottom side of the chamber is sealed by anodically bonding on a Pyrex die 9.4 mm wide and 41.4 mm long. On the top side, a smaller rectangular Pyrex glass die, 6 mm wide and 32.1 mm long, is bonded over the center of the silicon chip. Multiple (from 4 to 32) thin film Cr/Pt electrodes are fabricated on the Pyrex to form multiple parallel plate sense capacitors, one side of which is a portion of the flexible nitride/poly/nitride membrane.

Incoming sound excites motion of the outer "input" membrane, generating an acoustic pressure wave in the fluid chamber. This pressure wave travels down the length of the device, interacting with the sensing membrane. Due to the spatially variable acoustic impedance of the sensing membrane, portions of the membrane will respond with large vibration amplitudes. With a DC bias applied across the two electrodes of the sensing capacitor, vibrations result in oscillatory charge generation. The charge is integrated by a charge amplifier to produce a voltage output. This device has multiple channels of output, each connected to a different Cr/Pt top electrode, and each designed to be preferentially sensitive to a particular frequency band.

Figure 3:
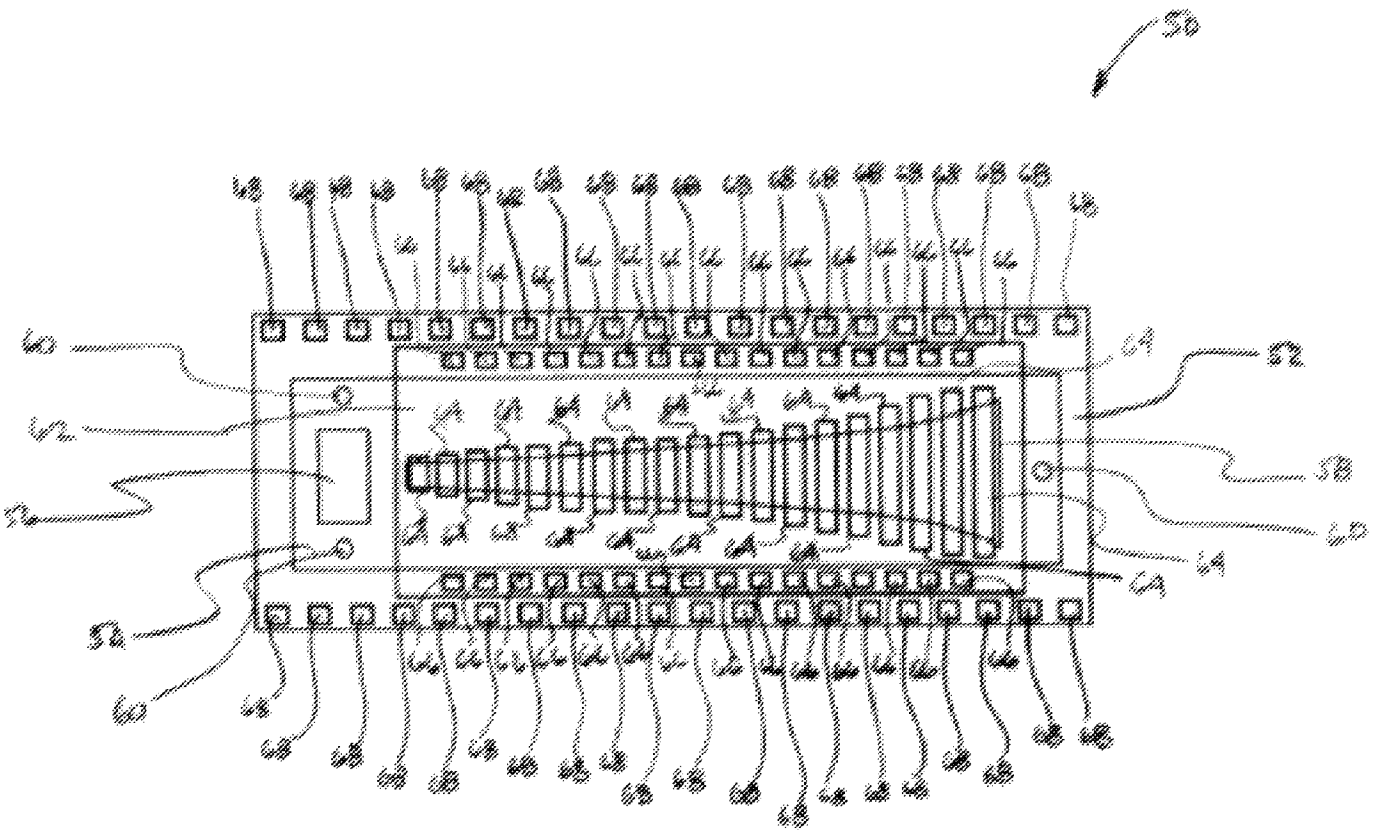
FIG. 3 is a top view of a multi-channel acoustic sensor system in accordance with an embodiment of the invention.

FIG. 3 is a top view of a multi-channel acoustic sensor system 50. System 50 includes silicone dye 52, 9.4 mm in width, 41.4 mm in length and 0.475 mm in thickness. System 50 also includes fluid filled chamber 54, 6.25 mm in width and 0.275 mm in height, input membrane 56, 1.1 mm×2.1 mm, and variable width membrane 58, e.g., 0.14 mm-0.82 mm. Input membrane is a $Si_3N_4$/P++poly/$Si_3N_4$ laminate (0.1/1.0/0.1μ). Variable width membrane 58, e.g., tapered membrane, is similarly constructed to input membrane 56. System 50 also includes fluid filling ports 60 and in-situ strain gauge (D=0.6 mm), pyrex glass top cover 62, top electrodes 64, Cr/Pt, bond pads 66, Sn—Au bonds, and bonds to chip package 68.

Figure 4:
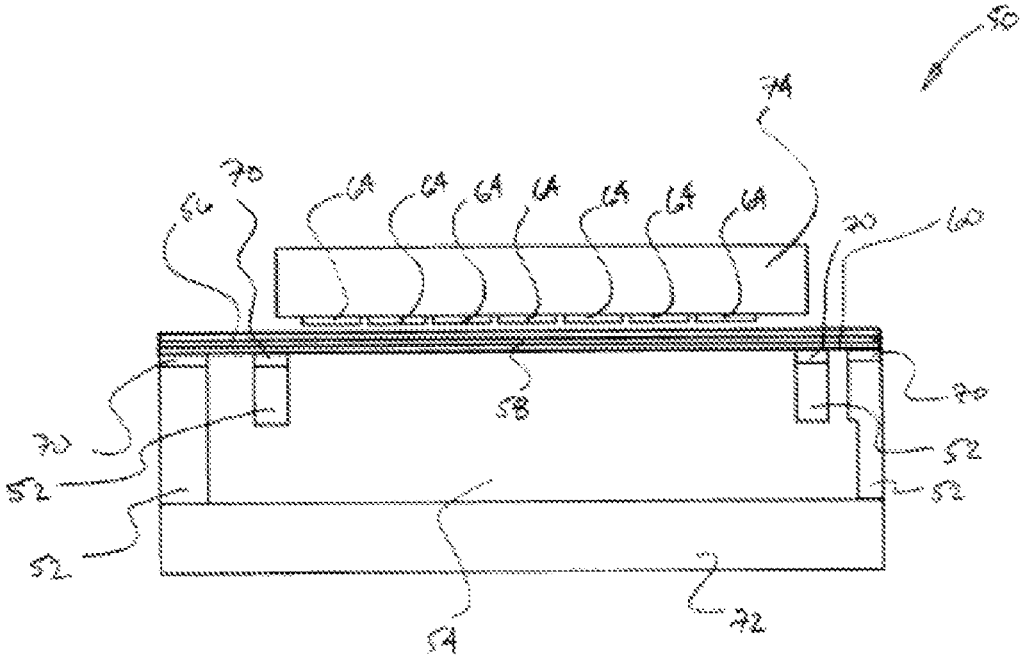
FIG. 4 is a side view, in cross-section, of the multi-channel acoustic sensor system of FIG. 3 taken along the length of the system.

FIG. 4 is a side view, in cross-section, of system 50 taken along the length of system 50. Input membrane 56 and variable width membrane 58 are $Si_3N_4$/p++poly/$Si_3N_4$ laminate structures. Disposed between laminate membranes 56, 58 and the silicone main structure 52 is an insulating layer 70, $SiO_2$ (2μ), and etch stop. Fluid chamber 54 is filled with 200 cSt silicone oil and sealed with pyrex glass back cover 72 in a manner similarly described above as well as below.

System 50 also includes pyrex glass top cover 74 on which top electrodes 64 are constructed.

Figure 5:
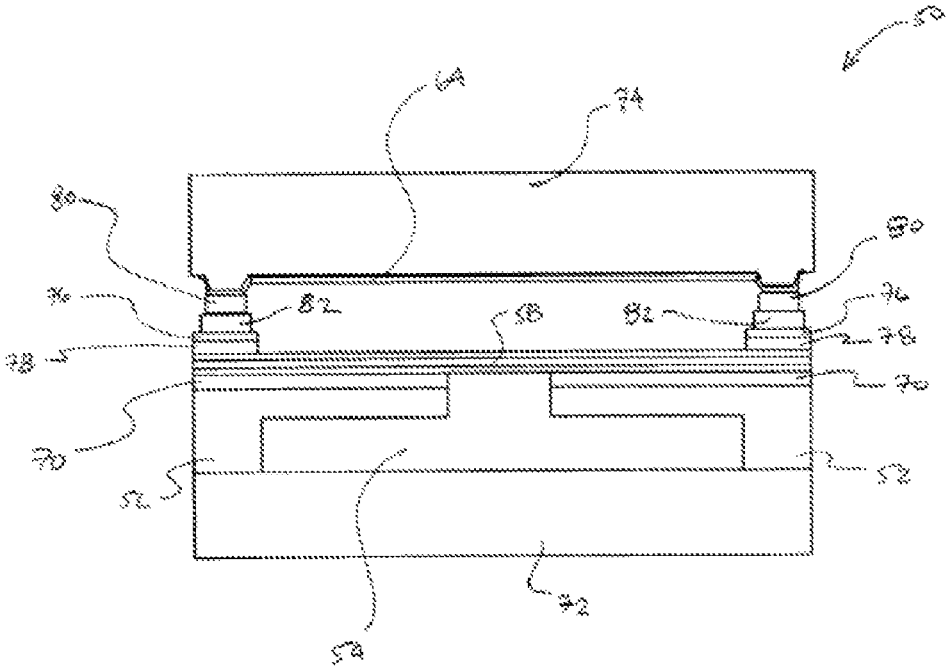
FIG. 5 is another side view, in cross-section, of the multichannel acoustic sensor system of FIG. 3 taken along the width of the system.

FIG. 5 is another side view, in cross-section, of system 50 taken along the width of system 50. System 50 includes insulating layer 76, $Si_3N_4$ (240 nm), on insulating layer 78, $SiO_2$ (180 nm). FIG. 5 also shows bonding pad 66 in greater detail. Bonding pad 66 includes bonding agent 80, 1.3 μm Sn, and bond pad 82, 2 μm Au.

Embodiments of the fabrication process may proceed as follows. The starting substrates are 100 mm diameter, 475 μm thick, <100> oriented, p-type (boron) (1-10 Ohm cm) silicon wafers. Three surface films are deposited by pyrogenic oxidation and low pressure chemical vapor deposition (LPCVD) in the following order: 2 μm thermal $SiO_2$, 100 nm LPCVD stoichiometric $Si_3N_4$, 1 μm of LPCVD polycrystalline silicon. The polysilicon film is doped using solid source boron diffusion. Three more thin films are deposited by LPCVD: 100 nm stoichiometric $Si_3N_4$, 780 nm of $SiO_2$, and 240 nm of stoichiometric $Si_3N_4$. The 100 nm/1.0 mm/1.0 μm/100 nm silicon nitride/polysilicon/silicon nitride structural laminate has approximately 40 MPa net tensile stress and a sheet resistivity of 10-50 Ω/square.

The top five surface films on the backside are removed by a combination of wet and plasma phase etching. The last backside film (the 2 μm thick pyrogenic $SiO_2$) is patterned using plasma phase etching to produce a hard mask for a later deep reactive ion etching (DRIE) step (described below).

The top two surface films on the frontside (780 nm of $SiO_2$ on 240 nm of stoichiometric $Si_3N_4$) are patterned by reactive ion etching and wet etching to remove them from the mechanically active regions and to open up electrical connections to the doped polysilicon layer where needed. Additional etching of the top 100 nm $Si_3N_4$ is also performed where needed to make electrical connection to the polysilicon layer.

Cr/Au metalization is then sputtered on and patterned via liftoff to define the bond pads for the top glass die, the pads for connection to the package, and connections to the doped polysilicon layer.

The wafers are then etched from the backside using DRIE. The first etch uses a photoresist mask and defines the membrane shapes. A second DRIE etch is performed using the backside $SiO_2$ as a hardmask, and stopping on the buried $SiO_2$ etch stop. This etch defines the liquid chamber shape. The $SiO_2$ etch stop is then removed in 1:1 HF, releasing the membranes.

In parallel with the silicon processing, a Pyrex glass wafer (Corning type 7740 borosilicate glass with Na and Al doping), is processed to produce the top electrodes for capacitive sensing. 4 μm high legs are first etched into the glass using 3:1 HF and an evaporated Cr/Au mask. Cr/Pt electrodes are then evaporated on and patterned using liftoff. Sn "bumps" are evaporated on and patterned using liftoff. These will serve as a fluxless solder for the Sn—Au solder bonding process to the silicon at the end of the process.

New Pyrex glass pieces, cut from a Pyrex glass wafer using a dicing saw and chemically cleaned, are then anodically bonded onto the backside of the silicon die at 350° C. and 700 V, sealing the fluid chambers.

The micromachined Pyrex top pieces with Cr/Pt electrodes, described above, are finally bonded onto the silicon die using Sn—Au fluxless solder bonding at 350° C. with 100 MPa of applied clamping pressure. The MEMS structure is now complete, and ready to be packaged.

Needles are epoxied into the filling ports and silicone oil is injected using a microinjection jig. The needles are cut and sealed off with epoxy. The finished chip is then mounted into a hybrid leadless ceramic chip carrier (LCCC) package with double-sided tape and wirebonded to make electrical connection with Au wirebonds.

Innovative architectures for acoustic sensing using a trapped fluid as an acoustic transmission medium has been developed. Micromachining technology was used to fabricate the sensors in order to preserve the physiological size scale of the mammalian cochlea, and to aid in the integration of sensing elements. Mathematical models for microscale acoustics, including fluid-structure interaction, are developed in support of these designs.

Three microsystems are described. First, a lifesize hydromechanical cochlear model is discussed. This model is used to explore the effects of structure orthotropy and fluid viscosity on the mechanics. It is demonstrated that achievable orthotropy ratios of 8:1 in tension do not result in the sharp filtering observed in animal experiments. It is also demonstrated that high viscosities (20 cSt) must be used to introduce enough damping to avoid nonphysiological standing waves. These results underscore the importance of the active mechanisms present in the cochlea which appear to be critical for sharp filtering.

Second, a design for a single-output-channel acoustic sensor with the trapped fluid architecture and a capacitive sensing scheme is described. This device achieves sensitivities (−170 to −200 dB re 1 V/μPa) and bandwidth (100 kHz) for some channels. Laser vibrometry results demonstrate the presence of chochlear-like traveling waves and a frequency position map. Electrical output from the integrated sensors does not follow the vibration pattern measured with laser vibrometry.

Introduction

An innovative architecture for acoustic sensing using a trapped fluid as an acoustic transmission medium has been developed. Micromachining technology was used to fabricate the sensors to aid in the integration of sensing elements into the structure.

The ideas and models of cochlear mechanics have been adapted to the design of a novel type of acoustic sensor. The design is motivated by the superb sensing characteristics of cochlea.

The cochlear-like sensor was fabricated using micromachining techniques, and designed to operate first in air (a microphone) and subsequently submerged (a hydrophone). The sensor, like the cochlea, gives multiple channels of information about the frequency content of an incoming sound. This filtering is accomplished using mechanical means (fluid-structure interaction), rather than by the use of electrical filters. An advantage of this approach is the low power consumption of the mechanical signal processing scheme. This work represents the first demonstration of a functioning, integrated acoustic sensing system based on the cochlea.

In addition to the multichannel cochlear-like sensor, the fabrication techniques and models were adapted to the design of a unique single-channel MEMS acoustic sensor. This sensor also uses a trapped-fluid architecture, but in a different geometry. The trapped-fluid architecture allows the sensor to operate both in-air and submerged, and allows the acoustic input to be physically separated from the sensing location. The system demonstrates sensitivities competitive with (or as much as 20 dB higher than) commercial hydrophones, although it operates over a smaller bandwidth.

Mathematical models, experimental apparatus and methods, and microfabrication techniques are developed and utilized in support of these goals. The microfabrication process represents a contribution in its own right. Mathematical models have been extended and adapted from cochlear mechanics and structural acoustics to this problem in unique ways, focusing on the effects of fluid viscosity.

Modeling

Mathematical models have been developed to support design and analysis of trapped-fluid microsystems. In the most general sense, these systems can be thought of as a three dimensional acoustic fluid medium interacting with a two dimensional structural domain. Models must be determined for each of these domains, and rules for their interaction must be defined. Information about the frequencies, amplitudes, and phases of structural response to acoustic inputs needs to be available from the models.

Due to the acoustic nature of the phenomena, linear models are used, and only the steady-state response of the system is considered, with an assumed $e^{+iwt}$ time dependence. All transients are assumed to be rapid. These assumptions are reasonable since all displacements and pressures are small, and the system includes significant damping, resulting in rapid transients (for linear systems, a critically damped system will approach steady-state most rapidly). Electrical response of any sensing elements is determined from the computed structure response in post-processing operations.

Most of the modeling efforts have been directed toward a cochlear-like structure. In this problem the fluid domain is a rectangular duct. The fluid interacts with a planar structure on one side of the duct. The structure is long and narrow, and varies in width along its length. The coordinate axes will be set up such that the x axis is along the centerline of the structure with x=0 at the narrow end. The y axis lies in the plane of the structure. The z axis is normal to the structure, with z=0 at the structure surface, and the positive z direction into the fluid domain.

In general, the goal is to be able to select geometries and sensing methods which will result in measurable signal in useful bandwidths, and to allow evaluation of the effect of various systems parameters on sensor performance. These goals differ somewhat from the goals of cochlear modeling, where often a qualitative match with animal experiments is desired to investigate a proposed physiological mechanism. Often the material properties for the biological system are not well known, and due to the complexities of the structure many simplifications must be made. In the engineered systems discussed, geometries are simple and well defined, and material properties are usually known. Thus, the models should produce a quantitative match with experimental results.

| | | |
|---|---|---|
| Pf = | 911 kg/m$^3$ | [fluid density] |
| μ = | 5 cSt | [fluid viscosity] |
| c = | 1000 m/s | [acoustic free wave speed in fluid |
| h = | 110 μm | [fluid chamber height] |
| $L_1$ = | 6.25 mm | [fluid chamber width] |
| L = | 3 cm | [membrane length] |
| $b_0$ = | 140 μm | [membrane width at x = 0] |
| $b_f$ = | 1.82 mm | [membrane width at x = L] |
| $T_x$ = | 30 N/m | [tension in x] |
| $T_y$ = | 240 N/m | [tension in y] |
| $m_a$ = | 0.0036 kg/m$^2$ | [membrane mass per unit area] |

The membrane width varies exponentially in x according to the exponential function given in equation 2.1. This choice of function leads to a logarithmic frequency to linear position mapping similar to that found in the cochlea.

$$b(x) = b_0 e^{\alpha x} \qquad (2.10)$$

$$\alpha + \frac{1}{L} 1n(b^f / b_0)$$

Domain Models

Fluid Domain

The acoustic domain is a viscous, compressible fluid domain. Silicone oils with viscosities as high as 500 cSt are used for these systems to introduce damping. It is therefore important to capture the viscous effects in the model. The fluid is considered to be governed by the linearized Navier-Stokes equation. Linearization assumes that the convective term, is small:

$|\partial \vec{v}/\partial t| >> |\vec{v} \cdot \nabla \vec{v}|$, where $\vec{v}$ is the fluid velocity vector. This is essentially equivalent to assuming that $L/U_0 >> 1$ where L is some characteristic dimension, and $U_0$ is the typical amplitude of fluid displacement. For this case, $U_0$ is on the order of 1 nm, and L, the smallest dimension in the problem, is on the order of 100 μm. Hence linearization is justified.

| | | |
|---|---|---|
| $u_n$ = | fluid displacement in the nth direction | [m] |
| Pf = | fluid density | [kg/m$^3$] |
| μ = | fluid viscosity | [Pa · s] |
| ω = | angular frequency | [rads/s] |
| c = | acoustic free wave speed in fluid | [m/s] |
| $x_1, x_2, x_3$ = | coordinates | [m] |
| i = | $\sqrt{-1}$ | |
| n, m = | indices | |

In indicial notation, with all summations explicitly stated (i.e. Einstein's summation convention is not used), the three dimensional linearized Navier Stokes relation can be expressed solely in terms of the fluid displacements as three equations [56] (for n=1 . . . 3), $$\rho_f \omega^2 u_n + (\rho_f c^2 - i\mu\omega/3) \sum_{m=1}^{3} \left[ \frac{\partial u_m}{\partial x_n \partial x_m} \right] - i\mu\omega \sum_{m=1}^{3} \frac{\partial^2 u_n}{\partial x_m \partial x_m} = 0 \qquad (2.2)$$

Equation 2.2 will be the starting point for all derivations of fluid models in subsequent sections.

Structural Domain

The structural domains for these systems are all planar thin film diaphragms fabricated out of low pressure chemical vapor deposited (LPCVD) silicon nitride, silicon dioxide, polysilicon, or layered laminates of these materials. All of these fabrication processes result in large (100-1000 MPa) as-deposited residual stresses, which may be tensile or compressive. The laminates are designed to partially compensate for the residual stresses, resulting in a lower net stress for the structure. However, the residual stresses are never zero. Even for the compensated laminates, the minimum residual stress obtained was 40 MPa tensile.

In order to quantify the relative importance of bending and tension in modeling, the nondimensional bending number, Bn, is here defined, $$Bn = 2\frac{h}{L}\sqrt{\frac{E}{\sigma_{res}}} \qquad (2.3)$$

where h is the structure thickness, L is the structure in-plane size, E is the elastic modulus of the material, and $\sigma_{res}$ is the residual stress in the material. This number is the ratio, for a one-dimensional simply-supported structure (beam or string), of the first resonant frequency in pure bending to that in pure tension. Hence, large Bn implies that bending dominates, small Bn implies that tension dominates. As can be seen from equation 2.3, bending is most important for short, thick structures. Tension is most important for long, thin structures. Although these arguments are made for one dimensional structures, it is expected that the bending number will give an estimate of which type of compliance dominates for two dimensional structures, where the smallest lateral dimension of the structure is used in place of L.

For the structures disclosed in this work, h is between 0.3 μm and 1.2 μm, and E is on the order of 160 DPa (polysilicon, silicon nitride, or high temperature silicon dioxide and their laminates). If we allow $\sigma_{res}$ to vary over the range of observed values, 10-1000 MPa, and the structure size, L, to vary over 10 μm to 10 mm, we can plot contours of the Bending Number to estimate whether tension, bending, or both effects should be included in the model.

Bending dominates only for small, thick structures with low residual stress (less than 10 μm long, greater than 1 μm thick, and stress less than 10 MPa). For all other structures, residual stress must be included in the model. In fact, for much of the space, tension dominates. For the structure sizes which have been fabricated, between 140 μm and 2.5 mm, tension completely dominates for the 0.3 μm thick structures. For the 1.2 μm thick structures, tension effects are always important. However, bending is also important for the narrow parts of the structure. For pure tension, the structural model is $$T_x \frac{\partial^2 u_z(x, y)}{\partial x^2} + T_y \frac{\partial^2 u_z(x, y)}{\partial y^2} + m_a \omega^2 u_z(x, y) = \sigma_{zz}(x, y) - \sum F \qquad (2.4)$$

The tensions in the two orthogonal directions, $T_x$ and $T_y$, need not be the same. The structure is considered to be initially planar, and to lie in the x-y plane.

Including bending in the structural model involves adding additional terms to the structural equation. For a pretensioned isotropic Kirchhoff plate, the structural model is $$T\nabla^2 u - D\nabla^4 u + m_a \omega^2 u == \sigma_{zz}(x,y) - \Sigma F \qquad (2.5)$$

| | | |
|---|---|---|
| $u_z(x, y)$ = | structure displacement | [m] |
| $T_x$ = | structure tension in x | [N/m] |
| $T_y$ = | structure tension in y | [N/m] |
| $m_a$ = | structure mass per unit area | [kg/m$^2$] |
| $E_x$ = | structure elastic modulus in x | [N/m$^2$] |
| $E_y$ = | structure elastic in modulus y | [N/m$^2$] |
| $\nu_{xy}$ = | structure Poisson ratio xy | |
| vyx = | structure Poisson ratio yx | |
| $G_{xy}$ = | structure in-plane shear modulus | [N/m$^2$] |
| t = | structure thickness | [m] |
| $\omega$ = | angular frequency | [rads/s] |
| x, y = | coordinates in-plane | [m] |
| $\sigma_{zz}(x, y)$ = | normal stress applied to the structure | [N/m$^2$] |
| F = | point loads applied to the structure | [N] |

where the applied pressure, $\sigma_{zz}$, is above the plate (that is, at low frequencies, positive pressure causes negative displacement). The bending stiffness is $D=Et^3/(12(1-\nu^2))$. For an orthotropic plate, the structural equation is $$T_x\frac{\partial^2}{\partial x^2}u + T_y\frac{\partial^2}{\partial y^2}u - D_{xx}\frac{\partial^4}{\partial x^4 u - 2D_{xy}}\frac{\partial^4}{\partial x^2\partial y^2}u - D_{yy}\frac{\partial^4}{\partial y^4}u + m_a\omega^2 u = \sigma_{zz}(x, y) - \sum F \text{ where} \tag{2.6}$$

$$D_{xx} = \frac{E_x t^3}{12(1-\nu_{xy}\nu_{yx})} \tag{2.7}$$

$$D_{yy} = \frac{E_x t^3}{12(1-\nu_{xy}\nu_{yx})} \tag{2.8}$$

$$D_{xy} = \frac{E_x t^3 \nu_{yx}}{12(1-\nu_{xy}\nu_{yx})} + \frac{1}{6}G_{xy}t^3 \tag{2.9}$$

where there are four independent parameters, $E_x$ and $E_y$ are the two elastic moduli, $G_{xy}$ is the in-plane shear modulus, and $\nu_y$ and $\nu_{yx}$ are the two Poisson ratios, which must satisfy $\nu_{xy}/\nu_{yx}=E_x/E_y$. The plate thickness is t. For an isotropic plate, there are only two independent parameters (E and $\nu$), and $G=E/(2(1+\nu))$.

| | | |
|---|---|---|
| $u_n(x, y, z)$ = | fluid displacement in nth direction | [m] |
| $T_x$ = | structure tension in x | [N/m] |
| $T_y$ = | structure tension in y | [N/m] |
| $m_a$ = | structure mass per unit area | [kg/m$^2$] |
| $E_x$ = | structure elastic modulus in x | [N/m$^2$] |
| $E_y$ = | structure elastic in modulus y | [N/m$^2$] |
| $\nu_{xy}$ = | structure Poisson ratio xy | |
| $\nu_{yx}$ = | structure Poisson ratio yx | |
| $G_{xy}$ = | structure in-plane shear modulus | [N/m$^2$] |
| t = | structure thickness | [m] |
| $\rho_f$ = | fluid density | [kg/m$^3$] |
| $\mu$ = | fluid viscosity | [Pa · s] |
| $\omega$ = | angular frequency | [rads/s] |
| c = | acoustic free wave speed in fluid | [m/s] |
| $x_n$ = | coordinates | [m] |
| i = | $\sqrt{-1}$ | |
| n, m = | indices | |

Coupling between the fluid and structure is straightforward. The fluid normal stress at the structure surface provides forcing to the structure through $\sigma_{zz}$. The fluid displacement and the structure displacement must match at the interface, providing coupling from the structure into the fluid. The solution must therefore be obtained simultaneously for the entire coupled problem. Note that the types of structures used (plates and membranes) are assumed to move only normal to the surface; hence all tangential fluid displacements on the structure are zero (no-slip).

Three Dimensional Modeling

A three dimensional model that directly implements these coupled fluid and structure models has been developed. This is the most general model, but has a serious drawback: problem size rapidly becomes very large. This can exhaust available computational resources.

The linearized Navier Stokes relation for the fluid can be expressed solely in terms of the fluid displacements as the three equations given in equation 2.2. Derivation of the finite element problem proceeds as follows. First, multiply each equation by an arbitrary displacement variation (which must satisfy any essential boundary conditions) and integrate over the domain of the problem. After integration by parts is carried out, the three fluid equations are then expressed as the variational equations (for n=1 . . . 3), $$\int_\Omega \rho_f\omega^2\bar{u}_n u_n\,d\Omega - (\rho_f c^2 - i\mu\omega/3)\sum_{m=1}^{3}\left[\int_\Omega \bar{u}_{n,m}u_{m,n}\,d\Omega\right] + i\mu\omega\sum_{m=1}^{3}\left[\int_\Omega \bar{u}_{n,m}u_{n,m}\,d\Omega\right] + (\rho_f c^2 - 4i\mu\omega/3)\int_{T_n}\bar{u}_n u_{n,n}\,dT_n + (\rho_f c^2 - i\mu\omega/3)\sum_{m\neq n}\left[\int_{T_m}\bar{u}_n u_{m,n}\,dT_m\right] - i\mu\omega\sum_{m\neq n}\left[\int_{T_m}\bar{u}_n u_{n,m}\,dT_m\right] = 0 \tag{2.10}$$

where $\bar{u}_n$ is the arbitrary displacement for the $n^{th}$ equation, and where $u_{n,m}$ denotes the derivative $\partial u_n/\partial x_m$. The boundary terms resulting from the integration by parts can be simplified. Over all the rigid walls, there is an essential boundary condition that $u_n=0$, due to the no slip condition. Hence all the boundary integrals are zero over all the rigid walls.

On any portions of the boundary which are a flexible structure, the two in-plane motions are zero and only the normal motion is nonzero. For our problem, the membrane boundaries are all normal to $x_3$. Hence, the only remaining boundary term appears in the n=3 equation, $$(\rho_f c^2 - 4i\mu\omega/3)\int_{T_{memb}}\bar{u}_3 u_{3,3}\,dT_{memb} \neq 0 \tag{2.11}$$

This term is related directly to $\sigma_{zz}$, the normal stress in the fluid, which is exactly the forcing term on the membrane.

$$\sigma_{zz}=(\rho_f c^2-4i\mu\omega/3)u_{3,3} \tag{2.12}$$

Starting from the structural equation, equation 2.6, if we multiply by the variation $\bar{u}_z$, and integrate by parts, it can be shown that $$\left(\rho_f c^2 - 4i\mu\omega/3\int_{T_{memb}}\bar{u}_3 u_{3,3}\,dT = \int_{T_{memb}}\bar{u}_z\sigma_{zz}(x, y, z=0)\,dT = -\int_{T_{memb}} T_x\bar{u}_{z,x}u_{z,x} + T_y\bar{u}_{z,y}u_{z,y} + D_{xx}\bar{u}_{z,xx} + 2D_{xy}\bar{u}_{z,xy}u_{z,xy} + \right. \tag{2.13}$$

-continued $$D_{yy}\bar{u}_{z,yy}u_{z,yy} - m_a\omega^2\bar{u}_z u_z dT + \sum \int_{T_{memb}} F\bar{u}_z dT$$

where we have now expressed the only nonzero boundary term in equation 2.10 in terms of the structural operator operating on the plate motion, $u_z$, which is required by continuity to be the same as the fluid motion on z=0. Thus, the final variational equations for the boundary value problem are, in the three fluid displacements, $$\int_\Omega \rho_f\omega^2\bar{u}_x u_x d\Omega - \left(\rho_f c^2 - i\mu\omega/3\int_\Omega(\bar{u}_{x,x}u_{x,x} + \bar{u}_{x,y}u_{y,x} + \bar{u}_{x,x}u_{z,x})d\Omega + i\mu\omega\int_\Omega(\bar{u}_{x,x}u_{x,x} + \bar{u}_{x,y}u_{x,y} + \bar{u}_{x,z}u_{x,z})d\Omega = 0 \tag{2.14}$$

$$\int_\Omega \rho_f\omega^2\bar{u}_y u_y d\Omega - (\rho_f c^2 - i\mu\omega/3)\int_\Omega(\bar{u}_{y,x}u_{x,y} + \bar{u}_{y,y}u_{y,y} + \bar{u}_{y,z}u_{z,y})d\Omega + i\mu\omega\int_\Omega(\bar{u}_{y,x}U_{y,x} + \bar{u}_{y,y}u_{y,y} + \bar{u}_{y,z}u_{y,z})d\Omega = 0 \tag{2.15}$$

$$\int_\Omega \rho_f\omega^2\bar{u}_z u_z d\Omega - (\rho_f c^2 - i\mu\omega/3)\int_\Omega(\bar{u}_{z,x}u_{x,z} + \bar{u}_{z,y}u_{y,z} + \bar{u}_{z,z}u_{z,z})d\Omega + i\mu\omega\int_\Omega(\bar{u}_{z,x}u_{z,x} + \bar{u}_{z,y} + \bar{u}_{z,z}u_{z,z})d\Omega \tag{2.16}$$

$$\int_{T_{memb}}(T_x\bar{u}_{z,x}u_{z,x} + T_y\bar{u}_{z,y}u_{z,y} + D_{xx}\bar{u}_{z,xx}u_{z,xx} + 2D_{xy}\bar{u}_{z,xy}u_{z,xy} + D_{yy}\bar{u}_{z,yy}u_{z,yy} - m_a\omega^2\bar{u}_z u_z)dT = \sum F$$

Working from equations 2.14-2.16, the Galerkin method can be implemented using isoparametric 3D 8-noded brick elements. Trilinear interpolations are used in the fluid domain. Note that this problem uses a compressible fluid formulation, but that the fluid is nearly incompressible. This can cause the elements to lock. To overcome this problem, a selective reduced integration scheme is used. A 2×2×2 Gaussian quadrature integration rule is used in the 3D domain for all terms which do not include the compressibility constant $pc^2$. For terms that include $pc^2$, a reduced 1 point quadrature rule is used.

Due to the fourth order derivatives, the Kirchhoff plate formulation on the structure requires $C^1$ continuity. (As opposed to $C^0$ for the membrane equations.) It is difficult to construct $C^1$-interpolations in two dimensions for arbitrarily shaped elements. For this reason, the most successful plate elements are based on the higher-order Mindlin-Reissner plate theory which requires only $C^0$ continuity. In Mindlin-Reissner plate theory, the transverse shear components of plate motion are included, which is more accurate for thick plates, but can cause locking in the thin plate limit. The MITC4 (mixed interpolated tensorial components) element is one such four-noded quadrilateral displacement based Mindlin-Reissner plate element. It uses separate interpolants for the transverse shear stresses to avoid locking in the thin plate limit. This element has been extended for the orthotropic case by Wang. In order to include bending effects into the model, this element has been implemented, extended to include pre-tension, and coupled to the fluid model. This results in a very general planar structural element including orthotropic bending and orthotropic pretension. The plate and membrane aspects were tested separately, and gave the correct modal frequencies and static displacements for simply supported and clamped square and highly skewed rhombic plates for regular and distorted meshes.

The problems is implemented in a research code written in Fortran. All attempts to use iterative solution methods such as those described in Lin and Grosh did not converge. Thus a direct solution method was used, which for the high-bandwidth matrices generated for the three-dimensional problem imposes severe restrictions on the fidelity of the mesh. The largest problem that can be solved using 2 GB of RAM is 600 elements long by 10 elements wide by 14 elements high. The elements in any given region are uniformly spaced. Forcing is delivered to the problem using nodal forces over the input membrane. A symmetry boundary condition is used along the centerline of the problem.

Two Dimensional Finite Element Modeling

Due to the large problem size generated by the full three-dimensional finite element solution approach, a simplified model was sought.

It is possible to take advantage of the disparity in the in-plane and out-of-plane dimensions of the fluid chamber. A finite element model which does this for structural acoustic systems is described by Beltman, et al. Beltman's model was developed for large area systems with small gaps such as solar panels. However, the model can be directly applied to the modeling of MEMS fluid-structure systems. The model couples a thin, viscous, compressible acoustic medium to a structure, differing from the cochlear model papers mentioned above by focusing on viscous fluid effects. The thin gap approximations are valid for fluid film heights much less than any dimension of the response. In the cases considered in this study, the wavelength of the response in the plane of the device is always more than 2 mm, at least 4 times the fluid chamber height. The most rapid variation of the structure response therefore occurs over the smallest dimension of the membrane.

| | |
|---|---|
| P = | acoustic pressure in the fluid |
| $w_p$ = | membrane out-of-plane displacement |
| $u_n$ = | fluid velocity in the nth direction |
| $h_0$ = | duct height |
| $T_x$ = | structure tension in x direction |
| $T_y$ = | structure tension in y direction |
| $E_x$ = | structure elastic modulus in x |
| $E_y$ = | structure elastic modulus in y |
| $v_{xy}$ = | structure Poisson ratio xy |
| $v_{yx}$ = | structure Poisson ratio yx |
| $G_{xy}$ = | structure in-plane shear modulus |
| t = | structure thickness |
| $m_a$ = | structure mass per unit area |
| $\rho_0$ = | unperturbed fluid density |
| $\tilde{\rho}$ = | fluid density fluctuation |
| $\omega$ = | angular frequency |
| $c_0$ = | acoustic free wave speed in fluid |
| $x_1, x_2, x_3$ = x, y, z = | cartesian coordinates |
| i = | $\sqrt{-1}$ |

For these regions of the model, errors will be introduced by the thin-film assumptions. Making the thin film assumptions allows the problem to be rendered in two dimensions, with only fluid pressure and structure displacement as free variables. This reduces the problem size considerably, enabling a more refined solution in the x-y plane, where all of the geometric features of interest lie.

Starting again from the linearized Navier-Stokes equations, which are recast here in terms of fluid velocity and pressure for n=1 . . . 3, $$\rho_0 i\omega u_n = -\frac{\partial P}{\partial x_n} + \mu\nabla^2 u_n + \frac{1}{3}\mu\sum_{m=1}^{3}\frac{\partial}{\partial x_n}\frac{\partial u_m}{\partial x_m} \tag{2.17}$$

The thin gap approximations assume that the in-plane fluid velocities are much greater than the out-of-lane fluid velocity, and that the derivatives of all velocities in the out-of-plane direction are much greater than derivatives of the same quantities in-plane. With these assumptions, the Navier-Stokes equations reduce to $$\rho_0 i\omega u_x = -\frac{\partial P}{\partial x} + \mu\frac{\partial^2 u_x}{\partial z^2} \tag{2.18}$$

$$\rho_0 i\omega u_y = -\frac{\partial P}{\partial y} + \mu\frac{\partial^2 u_y}{\partial z^2} \tag{2.19}$$

$$0 = -\frac{\partial P}{\partial z} \tag{2.20}$$

where the z direction is taken to be the out-of-plane direction. Equation 2.20 indicates that the pressure is constant through the height of the duct. The solutions to equations 2.18 and 2.19 are subject to the no-slip boundary conditions at z=0 and $z=h_0$, $$u_x = -\frac{1}{\rho_0 i\omega}\frac{\partial P}{\partial x}\cdot A(z) \tag{2.21}$$

$$u_y = -\frac{1}{\rho_0 i\omega}\frac{\partial P}{\partial y}\cdot A(z) \tag{2.22}$$

where $$A(z) = 1 - \frac{\sinh\left((1+i)\frac{z}{\delta}\right) - \sinh\left((1+i)\frac{z-h_0}{\delta}\right)}{\sinh\left((1+i)\frac{h_0}{\delta}\right)}$$

$$\delta = \sqrt{\frac{2\mu}{\rho_0\omega}}$$

Note that δ is the viscous boundary layer thickness. In addition to the Navier-Stokes equations, continuity must hold. Subject to the thin fluid layer assumptions, continuity becomes $$i\omega\tilde{\rho} + \rho_0\left(\frac{\partial u_x}{\partial_x} + \frac{\partial u_y}{\partial y} + \frac{\partial u_z}{\partial z}\right) = 0 \tag{2.23}$$

where the fluctuations in the density are related to the fluctuations in the fluid pressure by the constitutive relation for a bariotropic fluid, $$\tilde{\rho} = \frac{P}{c_0^2}$$

Using this relationship along with the solutions from equations 2.21 and 2.22 in equation 2.23, $$\frac{i\omega}{c_0^2}P - \frac{1}{i\omega}\left[\frac{\partial^2 P}{\partial x^2} + \frac{\partial^2 P}{\partial y^2}\right]A(z) + \rho_0\frac{\partial u_z}{\partial z} = 0 \tag{2.24}$$

Integrating out the thin direction, z, using boundary conditions on the fluid motion in the z direction that $$u_z(z=0)=i\omega w_p \text{ and } u_z(z=h_0)=0$$

The thin-layer acoustic viscous fluid model is produced, $$\left(\frac{\omega}{c_0}\right)^2 P + \left[\frac{\partial^2 P}{\partial x^2} + \frac{\partial^2 P}{\partial y^2}\right]S\left(\frac{\delta}{h_0}\right) = \frac{\rho_0\omega^2}{h_0}w_p \tag{2.25}$$

which can be written in the simple form $$\left[\frac{\partial^2 P}{\partial x^2} + \frac{\partial^2 P}{\partial y^2}\right] + \left(\frac{\omega}{c_{eff}}\right)^2 P = \frac{\rho_0\omega^2}{h_0 S(\delta/h_0)}w_p \tag{2.26}$$

where $$S\left(\frac{\delta}{h_0}\right) = 1 - \frac{\delta 2(\cosh((i+1)h_0/\delta) - 1)}{h_0(i+1)\sinh((i+1)h_0/\delta)} \tag{2.27}$$

$$c_{eff} = c_0\sqrt{S(\delta/h_0)}$$

$$\delta = \sqrt{\frac{2\mu}{\rho_0\omega}}$$

Equation 2.26 is a modified two dimensional Helmholtz equation with viscous damping and structure coupling included. The structural equation including bending and tension was given in equation 2.6. These two equations are the strong form of the boundary value problem and represent the fully coupled fluid-structure system.

A standard Galerkin finite element procedure is used to solve the system. 4-noded isoparametric quadrilateral elements are used with a 2×2 Gaussian quadrature integration rule. Each node has four degrees of freedom: fluid pressure, structure displacement, and two structure rotations. The system is complex, and all results are assumed to be time harmonic as $e^{i\omega t}$. In all cases, the real part of the solution is the instantaneous value of the solution.

As discussed in section 2.2, the most successful plate elements are based on the higher-order Mindlin-Reissner plate theory. The MITC4 (mixed interpolated tensorial components) element is one such four-noded quadrilateral displacement based Mindlin-Reissner plate element, which is used here for the structure. The element was extended to include orthotropy and pretension and coupled to the thin film fluid model.

The element stiffness matrix is symmetric, and can be written $$[K_e] = \begin{bmatrix} K_{fluid} & K_{couple} \\ K_{couple} & K_{struct} \end{bmatrix}$$

where the fluid stiffness matrix, structural stiffness matrix, and coupling matrices come from application of the Galerkin procedure to equations 2.26 and 2.6.

A direct Gauss elimination solver is used to invert the global stiffness matrix. Forcing to the system is provided by a vector of nodal forces acting on the structural degree of freedom. These forces can be conceptualized as a distributed pressure by integrating over the surface of application. Essential boundary conditions set the structural degrees of freedom to zero over regions of the problem where the structure is very thick.

Wentzel-Kramer-Brillouin Modeling

Even more rapid solutions can be obtained using the semi-analytic technique known as Wentzel-Kramer-Brillouin (WKB), or Louiville-Green. This method is useful for solving problems which have an oscillatory (wave-like) solution which exists in a domain where there is some slowly varying parameter. The parameter should change slowly with respect to the solution; that is, there should be little change in the parameter over one wavelength. The method has been applied for many years in the solution of problems in cochlear mechanics, where usually the slowly varying parameter is a structural property (such as the width) of the basilar membrane.

The following assumptions are made in this approximate solution method:

1. A single structural cross-mode is assumed in the structure. For this derivation, a simply supported mode (half sinusoid) is chosen.
2. The variation of the envelope of the solution is slow compared to the wavelength of the solution. This allows us to disregard some derivatives and to make use of the WKB method. However, for some regions of the problems where the wavelengths become quite long, and this assumption can be questionable.
3. The thin-film fluid assumptions hold. That is, the fluid film thickness is small compared to the wavelength of the solution and the width of the membrane.
4. The fluid pressure in the y direction can be represented by a sum of the inviscid pressure modes with varying amplitudes.
5. The structure can be described purely in terms of tension; bending stiffness is not important. (Note that this assumption is not needed for a WKB formulation, other authors have included bending. However, it simplifies the derivation somewhat.)

The starting point for the solution method is the thin film fluid model, which was stated in final form in equation 2.26. The first step in the WKB approximation is to assume a form for the pressure which uses the inviscid fluid cross-modes to represent the y variation of the pressure field. This form is chosen to satisfy the rigid wall boundary conditions at $y=\pm L_1/2$. Only symmetric fluid cross-modes are included since the problem is symmetric about y=0. The pressure is also assumed to be oscillatory in x, with a slowly varying wave-number k(x). Each fluid mode has a slowly varying envelope function $B_j(x)$.

| | | |
|---|---|---|
| p(x, y, t) = | fluid pressure | [N/m$^2$] |
| w (x, y, t) = | membrane displacement | [m] |
| $T_x$ = | membrane tension in x | [N/m] |
| $T_y$ = | membrane tension in y | [N/m] |
| $m_a$ = | membrane mass per unit area | [kg/m$^2$] |
| b(x) = | membrane width | [m] |
| L = | membrane length | [m] |
| ρ = | fluid density | [kg/m$^3$] |
| μ = | fluid viscosity | [Pa · s] |
| $c_0$ = | free wave speed in the fluid | [m/s] |
| $h_0$ = | fluid duct height | [m] |
| $L_1$ = | fluid duct width | [m] |
| ω = | drive frequency | [rad/s] |
| x, y, z = | coordinates (see figure) | [m] |
| j = | index | |
| i = | $\sqrt{-1}$ | |

There is a subscript on $B_j(x)$ because each fluid mode can have a different envelope function.

$$P(x, y) = \sum_{j=0}^{N} B_j(x)\cos(2j\pi y/L_1)e^{-i\int_0^x k(x)dx} \tag{2.28}$$

A form is also assumed for the structural displacement, $$w(x, y) = W(x)\eta(x, y)e^{1i\int_0^x k(x)dx} \tag{2.29}$$

where the spatial variation of the solution in x has been expressed as the product of a slowly varying envelope function, W(x), and the same oscillatory function, $$e^{-1\int_0^x k(x)dx}.$$

The structural cross-mode shape is a function of x, according to $$\eta(x, y) = \cos(\pi y/b(x)) \tag{2.30}$$

$$b(x) = b_0 e^{\alpha x}$$

$$\alpha = \frac{1}{L}\ln(b_{final}/b_0)$$

We now substitute these solution forms for pressure and structure displacement into the fluid equation, equation 2.26. It is assumed that the most rapid variation in x is the oscillatory part of the solution. Hence, any derivative in x simply brings down a −ik. This results in $$\sum_{j=0}^{N} B_j(x)\cos(2j\pi y/L_1)\left[-k^2 - \left(\frac{2j\pi}{L_1}\right)^2 + \left(\frac{\omega}{c_{eff}}\right)^2\right]e^{-i\int_0^x k(x)dx} = \frac{\rho\omega^2}{h_0 S}W(x)\eta(y)e^{-i\int_0^x k(x)dx} \tag{2.31}$$

Now, multiplying the orthogonal fluid y-mode shape, and integrating in y, the modal coefficients of the fluid modes can be computed, $$B_j(x) = \frac{\rho\omega^2 A_j}{h_0 S L_1 m_j^2}W(x)\cdot\begin{pmatrix} 2 \ldots j > 0 \\ 1 \ldots j = 0 \end{pmatrix} \tag{2.32}$$

where $$A_j = \int_{-b/2}^{b/2}\eta(y)\cos(2j\pi y/L_1)dy$$

$$m_j^2 = -k(x)^2 - \left(\frac{2j\pi}{L_1}\right)^2 + \left(\frac{\omega}{c_{eff}}\right)^2$$

Now that the pressure loading is known, it can be substituted into the structural equation with only tension included (no bending), equation 2.4, to produce $$T_x\frac{\partial^2 w(x,y)}{\partial x^2}+T_y\frac{\partial^2 w(x,y)}{\partial y^2}+m_a\omega^2 w(x,y)=\sum_{j=0}^{N}B_j\cos(2j\pi y/L_1)W(x)e^{-i\int_0^x k(x)dx} \tag{2.33}$$

Substituting the form for the displacement into 2.33, and again assuming that the derivative of the envelope in x, ∂W/∂x, can be neglected as small compared to the rapid variation due to the wavenumber k, $$\left[T_x\left(-k(x)^2\eta-2ik(x)\frac{\partial\eta}{\partial x}+\frac{\partial^2\eta}{\partial x^2}\right)-Ty(\pi^2/b(x)^2)\eta+m_a\omega^2\eta\right]W(x)e^{-i\int_0^x k(x)dx}=\sum_{j=0}^{N}\left[\frac{\rho\omega^2 A_j}{h_0SL_1m_j^2}\cos(2j\pi y/L_1)\cdot\begin{pmatrix}2\ldots j>0\\1\ldots j=0\end{pmatrix}\right]W(x)e^{-i\int_0^x k(x)dx} \tag{2.34}$$

Now multiply through by the structural cross-mode η(y) and integrate in y, $$T_x\left(-k(x)^2\int\eta^2dy-2ik(x)\int\frac{\partial\eta}{\partial x}\eta dy+\int\frac{\partial^2\eta}{\partial x^2}\eta dy\right)\ldots-T(\pi^2/b(x)^2)\int\eta^2dy+m_a\omega^2\int\eta^2dy=\frac{\rho\omega^2}{h_0SL_i}\sum_{j=0}^{N}\left[\frac{A_j^2}{m_j^2}\cdot\begin{pmatrix}2\ldots j>0\\1\ldots j=0\end{pmatrix}\right] \tag{2.35}$$

Simplifying and evaluating the integrals (all of which can be evaluated in closed form for the exponential membrane width function), $$f(x,\omega)=T_x[-k(\omega,x)^2+ik(\omega,x)\alpha-\alpha^2\pi^2/12]-T_y[\pi^2/b(x)^2]+m_a\omega^2-\frac{2\rho\omega^2}{b(x)h_0S(\omega)L_1}\sum_{j=0}^{N}\left[\frac{A_j(x)^2}{m_j(x,\omega)^2}\cdot\begin{pmatrix}2\ldots j>0\\1\ldots j=0\end{pmatrix}\right]=0 \tag{2.36}$$

This is the so called "eikonal equation" from the WKB method. Everything is known except the wavenumber k(x, ω). This nonlinear algebraic equation can be solved using a Newton-Raphson technique in the complex plane. Solution proceeds as follows. First, a winding number method is used to determine the approximate value of a root of the eikonal equation. The winding number is Wn=+1 if there is a root within a region in the complex plane, Wn=−1 if there is a pole in that region. The winding number for a region is defined as the integral around the boundary of that region, $$Wn=\frac{1}{2\pi i}\oint_s\frac{df(k)/dk}{f(k)}dk \tag{2.37}$$

Once the winding number integral has been used to identify a root of the eikonal equation at x=0 for a particular frequency, a numerical Newton-Raphson technique (with backtracking) is employed in the complex plane to determine the complex wavenumber, k(x), at each location x, starting from x=0 and stepping along the membrane in short increments. There will be multiple root-loci, but only the least-damped need be included.

Once the wavenumber is determined, a second equation, called the "transport equation" is used to determine the slowly varying amplitude envelope W(x). This equation is, $$W(x)=C\left(\frac{\partial f(k)}{\partial k}\right)^{-1/2} \tag{2.38}$$

where C is an arbitrary constant. Since f(k) is a known function, once k(x) is computed from the eikonal equation, W(x) can be computed directly at each location. Note that the derivative of f(k) can be computed analytically. Including both the backward and forward traveling waves, the full membrane displacement can then be written, with time dependence explicitly stated, $$w(x,y,t)=e^{i\omega t}W(x)\left[C_1e^{i\int_0^x k(x)dx}+C_2e^{i\int_0^x k(x)dx}\right]\eta(y) \tag{2.39}$$

The constants are fixed by the boundary conditions on the average oscillatory fluid displacement at x=0 and x=L. The $0^{th}$ fluid pressure mode (j=0) can be written (in terms of the same constants), $$P_0(x)=W(x)\frac{2b(x)\rho\omega^2}{\pi h_0SL_1((\omega^2/c_{eff}^2)-k(x)^2)}\left[C_1e^{i\int_0^x k(x)dx}+C_2e^{i\int_0^x k(x)dx}\right] \tag{2.40}$$

Making use of the linearized Euler relation, $dP/dx=\rho\omega^2u_x$ is the fluid displacement in the x direction, we can relate the constant $C_1$ and $C_2$ to the fluid displacement boundary conditions at x=0 and L, $$\begin{bmatrix}\left.\frac{W(x)b(x)}{(\omega^2/c_{eff}^2)-k^2}ik\right|_{x=0} & \left.\frac{-W(x)b(x)}{(\omega^2/c_{eff}^2)-k^2}ik\right|_{x=0}\\ \left.\frac{W(x)b(x)}{(\omega^2/c_{eff}^2)-k^2}ik\right|_{x=L}e^{+i\int_{x=0}^{L}k(x)dx} & \left.\frac{-W(x)b(x)}{(\omega^2/c_{eff}^2)-k^2}ik\right|_{x=L}e^{+i\int_{x=0}^{L}k(x)dx}\end{bmatrix}\begin{pmatrix}C_1\\C_2\end{pmatrix}=\frac{\pi h_0SL_1}{2}\begin{pmatrix}u_x(x=0)\\u_x(x=L)\end{pmatrix} \tag{2.41}$$

This matrix equation can be inverted to determine the constants $C_1$ and $C_2$. For a rigid wall at x=L, $u_x(x=L)=0$. The displacement of the membrane is ratioed to the displacement of the input "wall" at x=0. Since this differs from the type of excitation for the other models and the experiment, it is difficult to compare the absolute magnitude of the results. However, the phase and the shape of the magnitude curve can be compared to the other computations.

Lumped Element Models

The simplest possible solution to these types of problems is the lumped element solution. To generate such a solution, we need to reduce the problem to an equivalent circuit. For the variable impedance waveguide, this results in a one dimensional "transmission line" model of the system. In order to produce such a simple model, the following drastic assumptions must be made:

- The structure is perfectly orthotropic. That is, there is no coupling through the structure in the direction of wave travel (i.e. $T_x=0$). This allows the structure to be represented as a locally reacting impedance Z(x).
- The variation of the structure impedance, Z(x), is slow. That is, Z(x) does not change appreciably over one wavelength of the solution.
- The fluid can be modeled by the thin film fluid model, but is incompressible. (That is, $c_0$ is very large.) Thus, viscous damping is included approximately as long as the thin film fluid model holds. (Fluid height is small compared to structure width and wavelength of the response.) The incompressible assumption is needed to produce a good analogy to the electrical domain.
- The fluid is one-dimensional. That is, there is no variation of pressure with z or y.

With the assumption that the structural coupling in the direction of wave travel can be neglected, the structural equation becomes $$-T_y\left(\frac{\pi}{b(x)}\right)^2\eta(y)w(x)+m_a\omega^2\eta(y)w(x)=P \tag{2.42}$$

Thus, the structural displacement is, after multiplying through by the structural cross-mode shape, η(y), and integrating in y, $$w(x)=P\frac{4/\pi}{m_a\omega^2-T_y\left(\frac{\pi}{b(x)}\right)^2} \tag{2.43}$$

With the assumption that the fluid pressure does not vary with y, and that the free wave speed $c_0$ is very high, the thin film fluid model becomes $$\frac{\partial^2 P}{\partial x^2}=\frac{\rho_0\omega^2}{h_0S(\delta/h_0)}w(x) \tag{2.44}$$

where $$B\left(\frac{\delta}{h_0}\right)=1-\frac{\delta}{h_0}\frac{2(\cosh((i+1)h_0/\delta)-1)}{h_0(i+1)\sinh((i+1)h_0/\delta} \tag{2.45}$$

$$\delta=\sqrt{\frac{2\mu}{\rho_0\omega}}$$

Substituting in the structural displacement from equation 2.43, $$\frac{\partial^2 P(x)}{\partial x^2}+\frac{\frac{4\rho_0}{\pi hS}}{Ty\left(\frac{\pi}{b(x)}\right)^2-m_a\omega^2}\omega^2P(x)=0 \tag{2.46}$$

Consider now a circuit model of a transmission line. In the limit as the spacing between elements becomes very small, the lumped element model becomes the continuous differential equation $$\frac{d^2e(x)}{dx^2}+\frac{L_1}{1/C(x)-L_2\omega^2}\omega^2e(x)=0 \tag{2.47}$$

where it is important to understand that $L_1$ and C are inductance and capacitance per unit length and $L_2$ is inductance over unit length. A comparison between equation 2.46 and equation 2.47 immediately yields the analogy to the mechanical system.

$$L_1(\omega)=\frac{4\rho}{\pi S(\omega)h} \tag{2.48}$$

$$L_2=m_a \tag{2.49}$$

$$C(x)=\frac{1}{Ty(\pi/b(x))^2} \tag{2.50}$$

The series inductances model fluid inertia, the shunt inductances model structure inertia, and the shunt capacitances model structure compliance. The voltage, e(x), is equivalent to the fluid pressure, and the current through each leg is equivalent to the structure velocity. Viscous damping enters by modifying the series inductance, $L_1$, to a complex "lossy" inductance. Due to the nature of viscosity, the losses are a function of frequency. This does not cause any problems when solving the system at steady state at a particular driving frequency.

To solve this system, a finite number of units is chosen, fixing dx. Then the values of each circuit component can be computed from the known structural properties. Standard circuit analysis results in an upper triangular matrix problem which can be easily inverted.

The input to the system is a pressure source at the beginning of the transmission line. It should be emphasized that this differs somewhat from the pressure drive to the finite element models. In this case the input sets the fluid pressure inside the duct, whereas the finite element models have an external pressure acting on the other side of an "input" membrane which communicates with the duct.

Microengineered Hydromechanical Cochlear Model

In the following, a lifesize, fully micromachined mechanical model of the cochlea is described. In order to produce an engineered structure which models this physiology, simplifications to the structure are employed. The compliance of Reissner's membrane and the tectorial membrane are low compared with the basilar membrane (BM). Hence, we will neglect these two membranes, and retain only two fluid-filled ducts (analogous to the scala tympani and scala vestibuli) separated by a single membrane (the BM). The effects of cochlear coiling are also neglected as a secondary effect. Use of a single uncoiled fluid duct rather than two coiled ducts reduces the complexity of the fabrication process considerably, and facilitates mechanical measurements. A single duct physical model corresponds to a mathematical model of the cochlea where only antisymmetric pressure contributions are included.

The complex structure of the organ of Corti (OoC) includes the sensory inner hair cells (IHC), electromotile outer hair cells (OHC), and interactions of the BM with the tectorial membrane mass. Production of a physical replica of this structure would be prohibitively complicated. Instead, we can think of this structure as providing a modification to the properties of the basilar membrane; including added damping and mass, and modified stiffness (including orthotropic qualities). Thus, the simple mechanical analog of the cochlea which we have arrived at is a single, fluid filled, rigid walled duct constrained along one side by a variable width membrane. In the human cochlea, the fluid duct height varies from as much as 2 mm at the base to less than 0.5 mm at the apex. The duct height for the engineered model is a constant 0.11 mm due to fabrication limitations. This is similar to the scala height at the apex, but is as much as 20 times smaller than the basal height. The reduced duct height results in increased fluid mass loading of the membrane, thereby reducing response frequency. It also reduces the overall response amplitude, and increases the effects of viscous damping.

Computations indicate that increasing the duct width sharpens the response of the filter, until the duct is more than approximately 3 times the width of the membrane, beyond which increasing the duct width has little further effect. The duct width was chosen to exceed this width, also allowing space for the fluidic interconnect ports. Pure silicone oil with either 5 cSt or 20 cSt viscosity is used to fill the duct.

The following two types of micromachined membranes corresponding to the BM have been fabricated: (1) an isotropic 0.32 μm thick stoichiometric LPCVD (low pressure chemically vapor deposited) silicon nitride membrane, and (2) a composite membrane consisting of 0.32 μm thick LPCVDsi licon nitride beams overlayed by a 1.4 μm thick low-stress photodefineable polyimide layer (PI2737). In the orthotropic membrane, each beam is 15 μm wide, and separated from its neighbors by 5 μm gaps. Both membranes taper exponentially from 0.14 to 1.82 mm in width. Wafer curvature measurements indicate a residual stress of 1 GPa in the silicon nitride for LPCVD films deposited on silicon. This agrees, within 30%, to two other measurements conducted for wafers with similar film thickness in the same furnace but different runs. The polyimide is expected, based on the manufacturer's data, to have a cured residual stress of 18 MPa. Thus, the isotropic membrane is expected to have a tension of approximately 320 N/m, the orthotropic a tension of 30 N/m longitudinally, 240 N/m transversely. For the given tapered geometry, this corresponds to a volume compliance per unit length of approximately $10^{-15}$–$10^{-12}$ $m^4/N$, defined as the integral of the displacement across the membrane width for a uniformly applied pressure. The measurements of von Bekesy on human cadavers show $10^{-12}$–$10^{-10}$ $m^4/N$ volume compliance per unit length 24 hours post mortem. The lower compliance present in this model results in response in the slightly ultrasonic regime (4-35 kHz), despite the higher mass loading due to the lower duct height.

The ratio of 8:1 in tension results in a computed ratio of 3:1 between the transverse and longitudinal space constants for a point load applied to the membrane centerline. This computed longitudinal space constant is 8 μm (21 μm) close to the base, and 38 μm (106 μm) close to the apex for the orthotropic (isotropic) membrane. These space constants are similar to the 10 μm (base) and 50 μm (apex) measurements made on the gerbil BM. I am not aware of any quantitative measurements of orthotropy on the human BM, although Voldrich's measurements indicate qualitatively that the human BM is orthotropic.

Figure 6A:
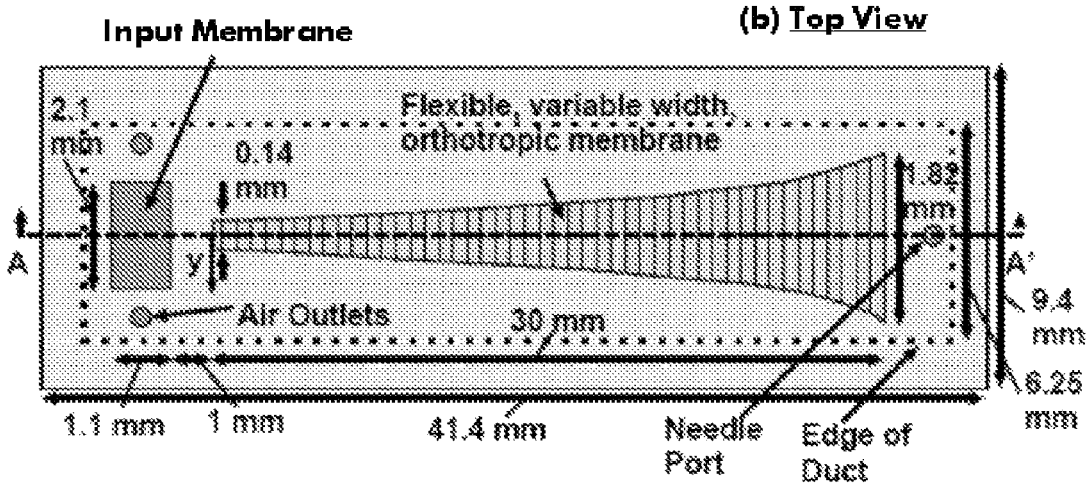
FIGS. 6A-6B are schematic top and cross-sectional views of the hydromechanical cochlear model. A feature is the exponentially tapered membrane width, which provides the varying acoustic impedance needed for cochlear-like frequency-position mapping. The width of the tapered membrane has been intentionally scaled up with respect to the rest of the drawing in order to improve visibility.
Figure 6B:
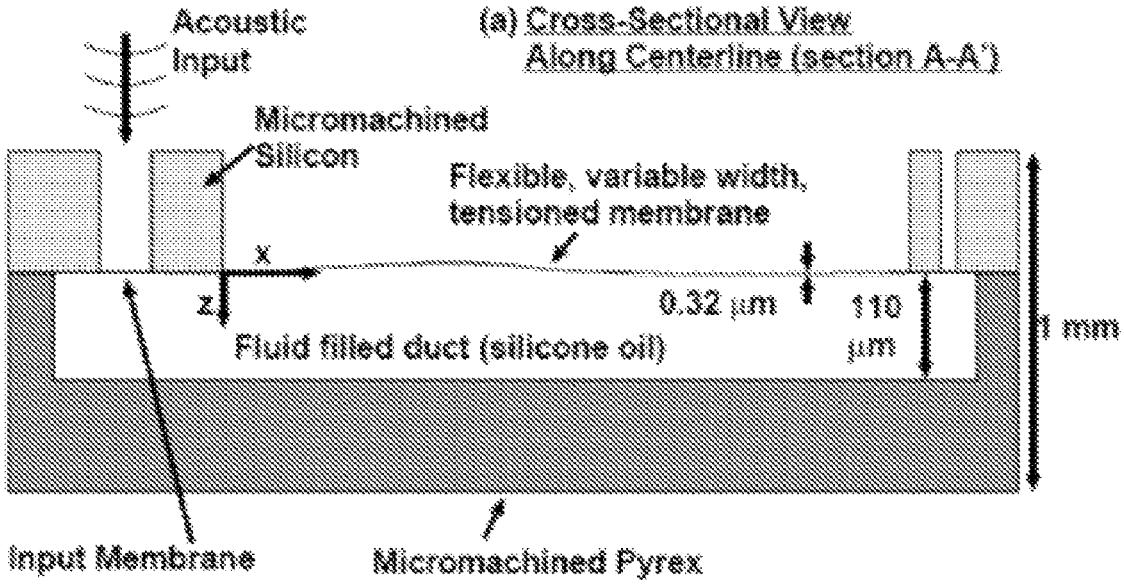

A 1.1 mm by 2.1 mm "input" membrane is fabricated prior to the start of the tapered membrane. This structure serves as an acoustic input to the system. For the isotropic devices it is also isotropic silicon nitride. For the orthotropic devices it is isotropic silicon nitride overlayed with isotropic. All additional geometric parameters for the fabricated device are given in FIGS. 6A-6B.

Modeling

A model developed for this system is the two dimensional finite element model using a thin film viscous compressible fluid approximation. The model parameters are determined as follows.

Duct height, $h_0$, is measured with a contact profilometer after etching, with a variability across the wafer and from run to run of 10%. $h_0$ is 110 μm. Fluid density was measured on a balance in a 100 ml graduated cylinder, with an uncertainty of ±5%. $\rho_0$ is 911 $kg/m^3$ for the 5 cSt fluid, and 950 $kg/m^3$ for the 20 cSt fluid. The free wave speed is an approximate value, $c_0$=1000 m/s, taken from tables of data on other oils. This is not a critical parameter; for the size scales involved, the fluid is essentially incompressible. Viscosities for the fluids are taken from manufacturer supplied datasheets. μ is either 5 cSt or 20 cSt. Membrane mass per unit area is computed from the bulk densities of silicon nitride, chromium, and gold, and the manufacturer supplied data on the density of the cured polyimide films. Thicknesses of the films are measured using ellipsometry or contact profilometry during fabrication. $m_a$=2.0 $g/m^2$ for the isotropic membrane, $m_a$=3.6 $g/m^2$ for the orthotropic membrane. Membrane mass per unit area has little impact on the model results, as the majority of the mass loading comes from the fluid.

The two-orthogonal tensions in the membrane are the most difficult parameters to determine. Wafer curvature measurements and manufacturer data are used to estimate the tensions at $T_x$=$T_y$=320 N/m for the isotropic case, and $T_x$=30 N/m, $T_y$=240 N/m for the orthotropic case.

For the 5 cSt case, standing waves are predicted at low frequencies close to x=30 mm. Increasing the viscosity to 20 cSt suppresses the standing waves. The experimental results also show this effect. The antisymmetric cross-mode results seen in the experiments are not present in the model output, since the model uses a symmetry condition along the membrane centerline. Any asymmetries present in the experiment are unintentional, so including asymmetry in the model to generate asymmetric response would be completely ad hoc, and so has not been done.

A phase lag of between 5 and 10 radians is predicted at the location of maximum response, commensurate with experimental results. Wave decay produced by viscous damping effects is also well captured. The magnitude of the modeled and measured response, normalized to the driving pressure, is correct within our ability to resolve the driving pressure, given directionality of both the speaker and microphone.

Single Channel Trapped-Fluid MEMS Sensor

A novel single channel acoustic sensor with a trapped-fluid architecture, capable of operating both in-air and submerged, has been designed, modeled, fabricated and tested. The sensor uses capacitive sensing in a condenser microphone scheme. If a condenser type system designed to operate in-air were submerged and used as a hydrophone, the mass loading introduced by the heavy fluid environment would reduce the bandwidth by approximately a decade (based on the fluid mass loading of a piston and typical mass of the MEMS membranes). To compensate, the tension in the membrane would need to be increased by two orders of magnitude to maintain the same bandwidth, reducing the low frequency sensitivity by two orders of magnitude. The design presented demonstrates a novel approach to dealing with this problem. A fluid chamber is included as part of the MEMS structure. The interaction of this fluid with the membrane increases the dynamic mass of the system, so that additional mass loading from a heavy fluid environment will not influence the sensor bandwidth. The effective system stiffness is increased, by increasing membrane tension and adding the stiffness of the fluid cavity, to maintain a 10 kHz bandwidth. This results in the expected reduction of sensitivity of 2 orders of magnitude. It is shown that an order of magnitude of sensitivity can be recovered by using a unique structure: a ring of "input" membranes with a large area collects sound around the outside of the structure, transmitting a cylindrical pressure wave through the trapped fluid in the chamber, and generating amplified motion of the central sensing membrane (See FIGS. 8A-8C). This architecture also allows the input ports to be physically separated from the sensing location, which has advantages for packaging, particularly for submerged operation.

The geometry of this single channel sensor is very different from the cochlear-like geometry considered above. However, the fabrication process for producing this capacitively sensed single-channel device is identical to that used to produce the multichannel cochlear-like sensor described below. In addition to the development of this sensor in its own right, the work on the single channel system allowed necessary components of the multi-channel cochlear-like sensor (such as electronics and the microfabrication process) to be initially developed and optimized.

The system described achieves sensitivities of −170 to 200 dB re 1 V/μPa in a 30 kHz band with a noise floor 0 to 40 dB above sea state zero. This is on the same order, or up to 20 dB higher, than the sensitivities achieved by capacitive and piezoelectric MEMS hydrophones and conventional "macromachined" piezoelectric hydrophones. The technology has thus been demonstrated to be competitive, and has the advantages of small form factor, economical MEMS fabrication, and an acoustic input which is physically separated from the sensing location.

Design

Figure 8A:
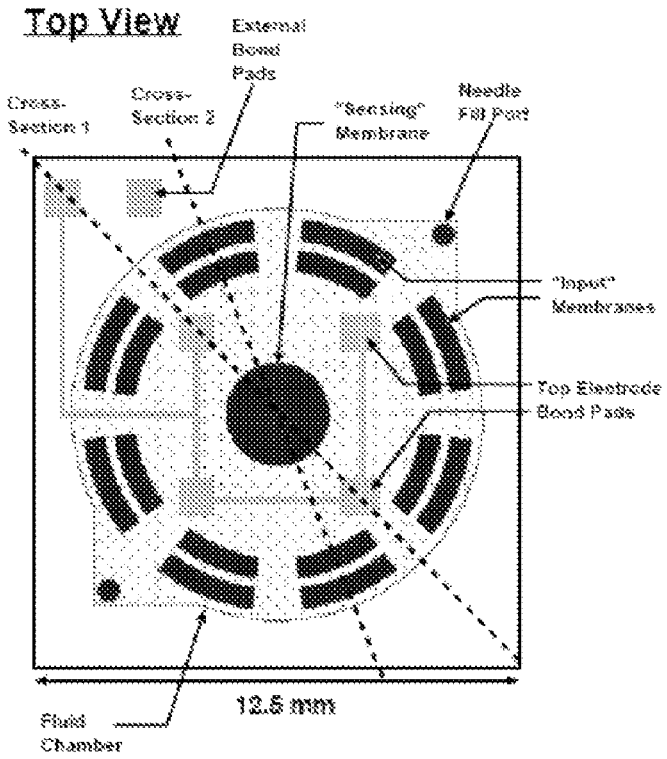
FIGS. 8A-8C are diagrams of the sensor system showing certain geometry.
Figure 8B:
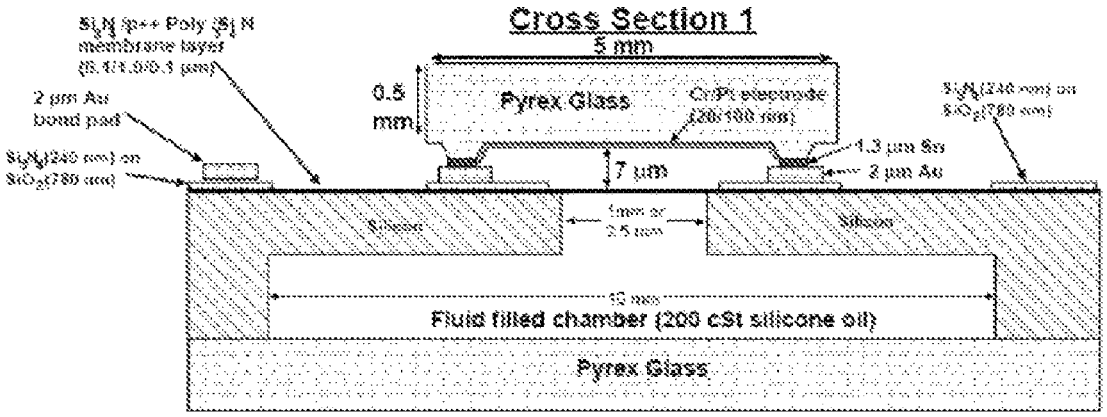
Figure 8C:
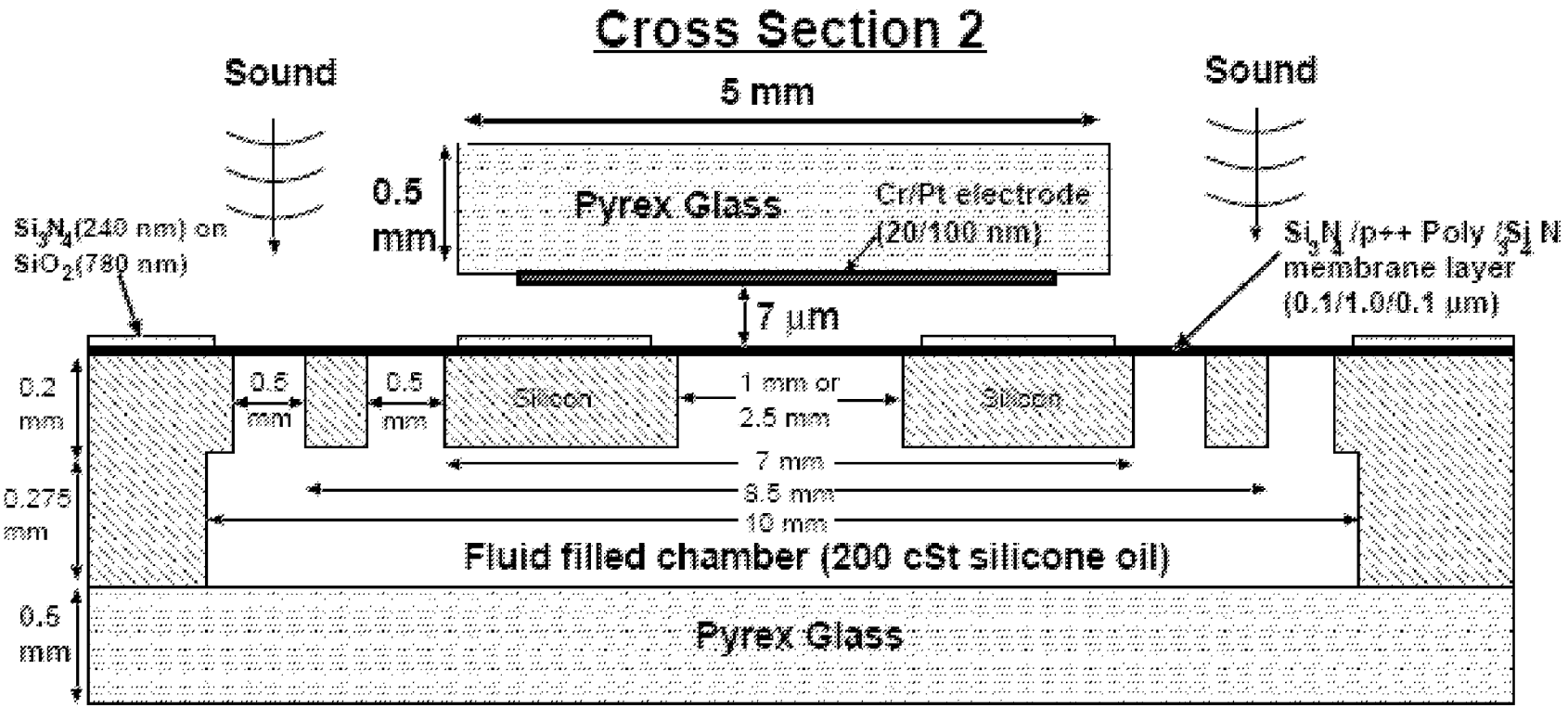

The mechanical portion of the micromachined hydrophone, diagramed in FIGS. 8A-8C, is a square silicon die 1.25 cm on a side. It consists of a 0.5 mm deep, 10 mm diameter fluid chamber, filled with silicone oil of 200 cSt viscosity. This chamber is constrained on one side by a series of flexible membranes. The center membrane is circular with either a 1 mm or 2.5 mm diameter. Arrayed around the outer portions of the chamber are two rings of 8 arc segments, each subtending 30 degrees, with inner and outer diameters as shown in the figure. The membranes are a laminate structure consisting of 100 nm of stoichiometric LPCVD silicon nitride, 1.0 μm of p++ (boron doped) polycrystalline silicon, and another layer of 100 nm thick silicon nitride. The bottom side of the chamber is sealed by anodically bonding on a square Pyrex die 1.25 cm on a side. On the top side, a smaller square Pyrex glass die, 5 mm on a side, is bonded over the center of the silicon chip using Sn—Au fluxless solder bonding. Thin film Cr/Pt electrodes are fabricated on the Pyrex to form the parallel plate sense capacitor, one side of which is the flexible nitride/poly/nitride membrane.

Incoming sound excites motion of the outer "input" membranes, generating an acoustic pressure in the fluid chamber. This causes deflection of the center membrane. With a DC bias applied across the two electrodes of the sensing capacitor, deflections result in charge generation. The charge is integrated by a charge amplifier to produce a voltage output.

Modeling

The modeling approaches described above are applied to this structure to determine expected sensitivity and bandwidth. The goal is to determine the expected displacement of the membrane in response to a driving acoustic pressure. From the displacement pattern, the electrical response can be computed.

Parameter Estimation

A number of parameters must be determined in order to apply the models. The fluid density was measured on a balance in a graduated cylinder, resulting in $\rho_0$=950 kg/m$^3$ for the 200 cSt silicone oil. The wave speed of sound in the oil is taken to be $c_0$=1000 m/s from tables of data on other oils. This is not a critical parameter; for the size scales involved, the fluid is essentially incompressible. The viscosity of the silicone oil is taken from manufacturer supplied datasheets; μ=200 cSt. The membrane density is determined from the film densities of LPCVD silicon nitride (3 g/cm$^3$) and polysilicon (2.3 g/cm$^3$) and the measured film thicknesses (0.1 μm/1.0 μm/0.1 μm). This gives $m_a$2.9 g/m$^2$.

The sense gap for the sensing capacitor can be determined by the static change in capacitance when the Pyrex top electrode is bonded on. The change in capacitance is given by $$\nabla C = \in_0 A / g_0 \tag{4.1}$$

where $\in_0$=8.545·10$^{-12}$ F/m is the dielectric constant of free space, and A=12.6 mm$^2$ is the area of the electrode on the Pyrex top piece. For the two devices described here, ∇C=16 pF, resulting in an estimated gap of 7 μm. This matches with the expected gap based on the Pyrex etch depth (4 μm), the thickness of the gold metalization (2 μm) and the thickness of the dieelectric (1 μm), which sum to 7 μm.

The residual stress in the membrane is the most difficult parameter to determine. Three techniques have been simultaneously applied to estimate the membrane stress: wafer curvature measurements, in-situ strain gauges, and capacitive snapdown voltage measurements. Wafer curvature for the process wafers show an average tension of 52 N/m with a standard deviation of 16 N/m. The minimum tension is 12 N/m and the maximum 100 N/m.

The in-situ strain gauge measurements indicate approximately 50 MPa tensile stress for the process wafer, which agrees with the wafer curvature measurements. For device F5-7E-1, a 2.5 mm diameter device, snapdown occurred at 22 V, indicating a tension of 12 N/m, at the low end of the expected range. Snapdown for device F6-7F-1 (with a 1 mm diameter center membrane) is higher than 50 V, and could cause damage to the sensor if the device were driven to snapdown. Hence, snapdown measurements were not conducted for F6-7F-1.

For this range of tensions (10 N/m−100 N/m), and for a 1 mm sized structure with a 1.2 μm thick structural layer (E-160 GPa [58]), the bending number (see Equation 4.2) ranges from 0.3 to 0.1, indicating that tension dominates the structural equation. Hence bending can be neglected. However, the tension could fall anywhere in the given range, and vary from device to device.

$$Bn = \frac{2}{L}\sqrt{\frac{h^3 E}{T}} \tag{4.2}$$

Parameters used in modeling the single-channel sensors.

| | |
|---|---|
| $h_0$ = | 475 μm (under the membranes) |
| = | 275 μm (under the silicon supports) |
| $\rho_0$ = | 950 kg/m$^3$ |
| $c_0$ = | 1000 m/s |
| $\rho_{env}$ = | 1.29 kg/m$^3$ |
| c = | 343 m/s |
| μ = | 200 cSt |
| $m_a$ = | 2.9 g/m$^2$ |
| T = | 12 N/m to 100 N/m |

Finite Element Modeling

The thin-film fluid model coupled to a tensioned membrane is an appropriate choice for modeling this system. The fluid chamber for the sensor described in this section has a dual height: under the membranes the fluid chamber is full wafer thick (475 μm), whereas elsewhere its depth is determined by the DRIE etch times, and was measured to be 275 μm. The parameters used for the model are given above.

Due to symmetry, only one quarter of the system needs to be meshed up and modeled.

Lumped Element Modeling

Figure 11:
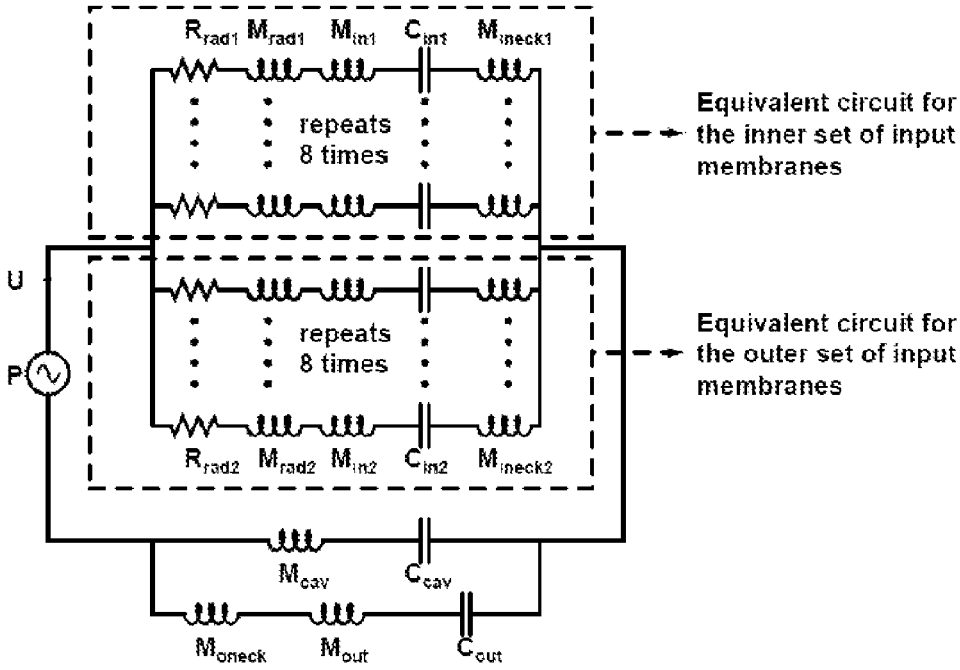
FIG. 11 is an equivalent acoustic circuit model for a system.

At low frequencies where the sensor dimensions are small compared to the wavelength of interest, a lumped parameter model is appropriate to approximate the sensitivity of the device. An equivalent lumped acoustic element model for the system is shown in FIG. 11. The input acoustic pressure of all 16 input membranes, P (assumed to be constant), and the total volume velocity of all 16 input membranes, U, are modeled as the potential (voltage) quantity and the flow (current) quantity, respectively.

In FIG. 11, $M_{rad1}$ and $R_{rad1}$ are radiation mass and radiation resistance of one of 8 identical input membranes in the inner set. Similarly, $M_{rad2}$ and $R_{rad2}$ are those for the outer set. The radiation mass and resistance are determined by approximating the diaphragm as a plane piston mounted in an infinite baffle.

$$M_{rad} = \frac{i\rho_{env}}{3\pi^2 a_{in}} \tag{4.3}$$

$$R_{rad} = \frac{\rho_{env}\omega^2}{2\pi c} \tag{4.4}$$

where $\rho_{env}$ is the density of the external environment, $a_{in}$ is the equivalent radius of the input membrane and c is wave speed in the external environment. For the computation presented here, the external environment is considered to be air ($\rho_{env}$=1.29 kg/m$^3$, c=343 m/s). The effective piston radius for the arc-shaped membranes is estimated from the total area, $a_{in}\approx\sqrt{A/\pi}$.

$M_{ineck1}$ is the neck mass under one of inner membranes, and $M_{ineck2}$ is the neck mass under one of outer membranes. $M_{oneck}$ is the neck mass under the sensing membrane. For the neck, since one end of it is terminated in a large fluid cavity, the end correction is added to the neck mass, $$M_{neck} = \frac{\rho_0(L + 0.85a)}{\pi a^2} \tag{4.5}$$

where a and L are the neck radius and length, respectively. The effective neck radius for the arc-shaped necks is estimated from the total area, $a_{in}\approx\sqrt{A/\pi}$. The neck length is L-200 μm.

The fluid cavity impedes the diaphragm movement by storing potential energy and has an equivalent compliance $C_{cav}$. The acoustic mass $M_{cav}$ for the cavity is also included in the circuit model. Expressions for these quantities can also be found in a standard reference.

$$C_{cav} = \frac{\pi a L}{\rho_0 c_0^2} \tag{4.6}$$

$$M_{cav} = 0.85\frac{\rho_0}{\pi a} \tag{4.7}$$

where a=5 mm is the radius of the fluid cavity, L=0.275 mm is the height of the fluid cavity, and $\rho_0$ and $c_0$ are for the trapped fluid. $C_{in1}$ and $M_{in1}$ are acoustic compliance and mass for one of input membranes in the inner set. $C_{in2}$ and $M_{in2}$ are those for the outer set. The diaphragm compliance can be derived from the fundamental mode of the membrane vibration equation. For the input membrane, the fundamental mode and the first resonant frequency are obtained from a circular membrane equation, $$T\left(\frac{\partial^2\psi_{in1}}{\partial r^2} + \frac{1}{r}\frac{\partial\psi_{in1}}{\partial r} + \frac{1}{r^2}\frac{\partial^2\psi_{in1}}{\partial\theta^2}\right) - m_a\frac{\partial^2\psi_{in1}}{\partial t^2} = 0 \tag{4.8}$$

where T and $m_a$ are the tension and the area density of the membrane respectively. In order to satisfy the boundary conditions, the fundamental mode $\psi_{in1}$ is, $$\psi_{in1} = \sin\frac{\psi(\theta-\theta_1)}{\theta_2-\theta_1}(c_1 J_n(k_{in1}r)) \tag{4.9}$$

where the ratio of $c_1$ to $c_2$ and the value of $k_{in1}$ are determined by the boundary conditions $\psi_{in1}(r=r_1)=\psi_{in1}(r=r_2)=0$. $r_1$ and $r_2$ are the inner and outer radii of the input membrane. $\theta_1$ and $\theta_2$ are the arc angles. $J_n$ and $Y_n$ are Bessel functions of the first and second kind of order n=6. The first resonant frequency of the input membrane $\omega_{in1}$ is found from $\omega_{in1}=k_{in1}\sqrt{T/m_a}$.

Assuming the static deflection of the input membrane is $\omega_{in1}=A\psi_{in1}$, and substituting it into the static membrane equation, $$T\left(\frac{\partial^2\omega_{in1}}{\partial r^2} + \frac{1}{r}\frac{\partial\omega_{in1}}{\partial r} + \frac{1}{r^2}\frac{\partial^2\omega_{in1}}{\partial\theta^2}\right) = P \tag{4.10}$$

we can solve for the modal coefficient A which depends linearly on the input pressure P, $$A = -\frac{P\int_{r_1}^{r_2}\int_{\theta_1}^{\theta_2}\psi_{in1}\,r\,dr\,d\theta}{m_a\omega_{in1}^2\left(\int_{r_1}^{r_2}\int_{\theta_1}^{\theta_2}\psi_{in1}^2\,r\,dr\,d\theta\right)} \tag{4.11}$$

The input membrane compliance is then defined as the ratio of the volume displacement to the applied pressure, $$C_{in1} = \frac{\int_{r_1}^{r_2}\int_{\theta_1}^{\theta_2} \omega_{in1}\, r dr d\theta}{P} = \frac{\left(\int_{r_1}^{r_2}\int_{\theta_1}^{\theta_2} \psi_{in1}\, r dr d\theta\right)^2}{m_a \omega_{in1}^2 \int_{r_1}^{r_2}\int_{\theta_1}^{\theta_2} \psi_{in1}^2\, r dr d\theta} \quad (4.12)$$

The input membrane mass is computed from $$M_{in1} = \frac{1}{C_{in1}\omega_{in1}^2}.$$

The value of $C_{in2}$ and $M_{in2}$ can be determined in similar fashion.

In FIG. 11, $M_{out}$ and $C_{out}$ are acoustic mass and compliance of the sensing membrane. For the circular sensing membrane, the fundamental mode is $\psi_{out}=J_0(k_{out}r)$, where $J_0$ is the first kind Bessel function of order 0. $k_{out}$ is determined from the boundary condition $\psi_{out}(r=r_{out})=0$, where $r_{out}$ is the radius of the sensing membrane. The first resonant frequency $\omega_{out}$ is determined from $\omega_{out}=k_{out}\sqrt{T/m_a}$. Using the process described above, we can obtain the equivalent acoustic compliance and mass for the sensing membrane.

By using the first kind Bessel function as the displacement distribution field in the sensing membrane, the center point displacement of $\omega_{max}$ is related to the volume velocity $$U_{out} \text{ by } \omega_{\max} = \frac{2.32}{i\omega A_{out}}$$

where, $A_{out}$ is the area of the sensing membrane.

Electronics

An AD795 low noise precision FET input operational amplifier is configured as a charge amplifier to integrate the charge generated by the MEMS sensor. A 10 pF silvered mica capacitor is used as the feedback capacitor and sets the charge gain of the system. A 200 MΩ feedback resistor is used to stabilize the system at DC. The RC cutoff frequency for this combination is 80 Hz. The 10 pF capacitor results in a 0.1 V/pC charge sensitivity. The output of the charge amplifier is passed through a 1 μF coupling capacitor into a bandpass filter circuit. The filter is constructed using a UAF42 universal active filter chip from Texas Instruments. The first stage is configured as a lowpass state-variable filter with a 2 pole cutoff at 70 kHz and a passband gain of 20 dB. The second stage is configured as a highpass voltage controlled course with a 80 Hz cutoff frequency and 6 dB of passband gain. The net result of the entire system is a charge sensitivity of 2 V/pC in a 80 Hz-70 kHz band.

A DC bias, generated by an ADR01 bandgap reference IC, is applied across the plates of the MEMS sensor. A passive RC low pass filter is used to reduce the noise of the reference IC output. A 100 kΩ potentiometer is used as a voltage divider to set the bias voltage anywhere from 0 to 9 V. For small deflections, the charge produced from the displacement of the sensor comes from the linearized change in capacitance multiplied by the applied DC bias voltage, $$Q = V_{bias}\varepsilon_0 \frac{1}{g_0^2}\int\int_A \omega_p(x, y) dx dy \quad (4.13)$$

where $g_0$=7 μm is the initial sense gap, $\in_0=8.854\cdot10^{-12}$ F/m is the permittivity of free space, $\omega_p(x,y)$ is the displacement of the sense electrode, and the integral is over the area of the electrode. The resulting charge is then passed into the charge amp and through the filter transfer function to result in a final voltage output.

The measured power consumption of the entire electronics is 260 mW, when operating off of 15V and −15V supplies. A SPICE model incorporating manufacturer-supplied models of the UAF42 active filter, the REF01 (which is similar to the ADR01) bias reference and the AD795 charge amplifier predicts a total power consumption of 271 mW. The SPICE model predicts that 216 mW is consumed by the UAF42, 39 mW by the AD795, and 15 mW by the REF01 (accounting for 270 mW). Power consumption could be reduced by operating at a lower voltage, perhaps using a single 3.3 V or 5 V supply. This would reduce sensitivity somewhat because the sensor would operate at a lower bias, but would be a worthwhile tradeoff for low power applications. Additional power savings may be possible by choosing a more efficient active filter scheme.

Discussion

These sensors exhibit sensitivities on part with piezoelectric hydrophones, and as much as 20 dB higher than previously reported capacitively sensed MEMS hydrophones. The noise floor for this design is 0 to 40 dB above sea state zero. The bandwidths for both sensors are approximately 20-30 kHz. The sensors are manufactured using batch silicon and glass processing, which is economical at producing parts in large quantities. They are also small (1.56 $cm^2$) and low power (260 mW at ±15 V supply). The flat form-factor could be useful in some manufacturing circumstances. In addition, the input port can be located at a physically separate location from the sensing location, which may also have advantages in packaging and isolation from the environment.

Multi-Channel Chochlear-Like MEMS Sensor

This section describes a unique MEMS acoustic sensor. This section describes the integration of multiple capacitive sensing channels integrated into a chochlear-like mechanical system. This system will be referred to as the micro-cochlear analog transducer (μCAT). The goal is twofold: to produce an acoustic sensor which can operate in air and submerged with a high sensitivity and bandwidth, and also to produce multiple channels of mechanically filtered output, each sensitive to a particular band of frequencies. This unique real-time mechanical signal processing scheme will allow low power spectral analysis of acoustic signals in a compact design.

An array of narrow band sensors are used, but the sensors are arrayed along a one dimensional waveguide. Hence, any energy entering the system through its relatively large input window passes down the waveguide, meeting each narrow-band sensor in turn. The energy is absorbed by the sensor tuned to that band of sound. Hence, little energy is wasted; all the acoustic energy is passed to the sensor tuned to optimally transduce that band.

Design

The first step in this process is to demonstrate the ability to sense sound and perform mechanical spectral analysis in a cochlear-like mechanical architecture. Such a device is described here.

Figure 12:
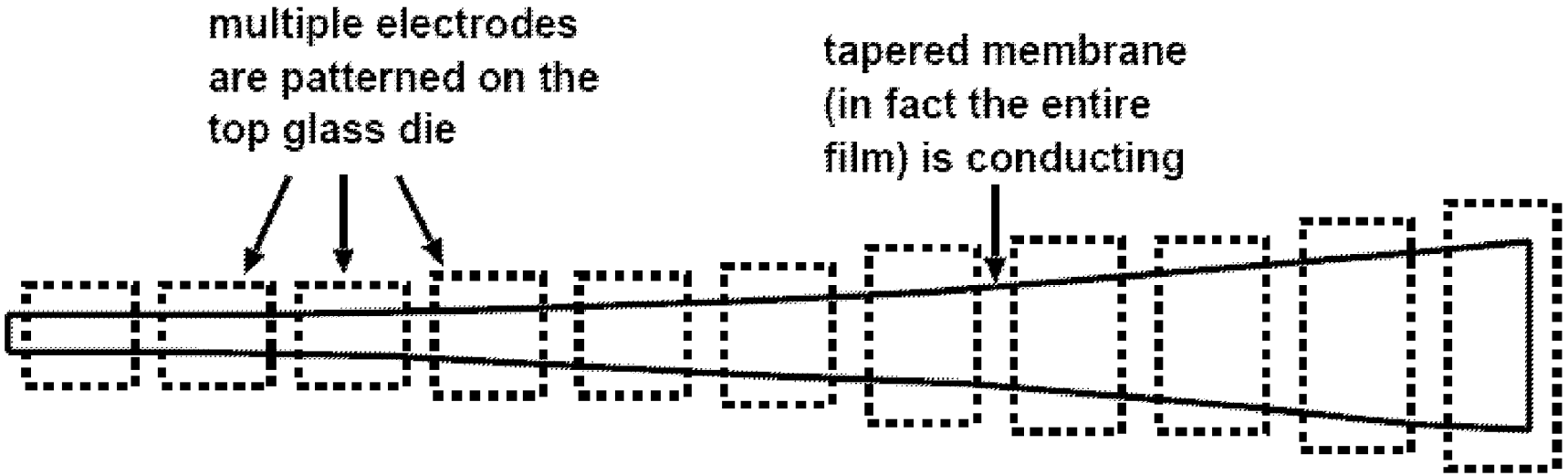
FIG. 12 is a schematic view of the multichannel sensing scheme.

The simplest analogy to the mechanical structure of the cochlea is a single straight fluid-filled duct bounded along one side by a tapered membrane. For the μCAT, capacitive sensing elements will be included. This is accomplished by making the membrane conducting (highly boron doped polysilicon) and bonding on a glass die with patterned Cr/Pt electrodes to form a series of parallel plate capacitors along the length of the membrane. Each electrode is a separate channel of output, corresponding to vibration of the section of membrane under that electrode. FIG. 12 shows the concept.

In order to produce high sensitivity, the gap between the membrane and the sensing electrodes should be small. This requires that the membrane be flush with the top of the silicon wafer, so that the bonded glass piece can be in close proximity. The bonding method for the glass to the silicon must provide not only a mechanical bond, but also an electrical connection. Hence, a Sn—Au fluxless solder bonding process is selected for this bond. The bond points on the glass die, each connected to a single top electrode, will bond to pads on the silicon each of which will have traces leading to bond pads along the edge of the silicon die for wirebonding to the package. Off-chip electronics can then be used to supply both the required bias and to do the charge integration to produce a voltage output.

Figure 13A:
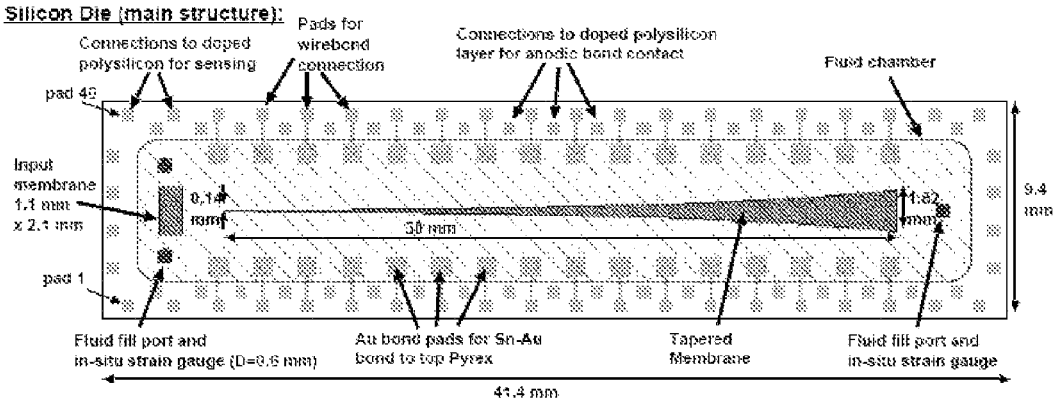
FIGS. 13A-13B are plan views of the multichannel acoustic sensor system design showing the tapered membrane, fluid chamber, and all metalization for both connection to the package and bonding to the Pyrex die containing the top electrodes. The Pyrex die is also shown, with bond pads and top electrode metalization.
Figure 13B:
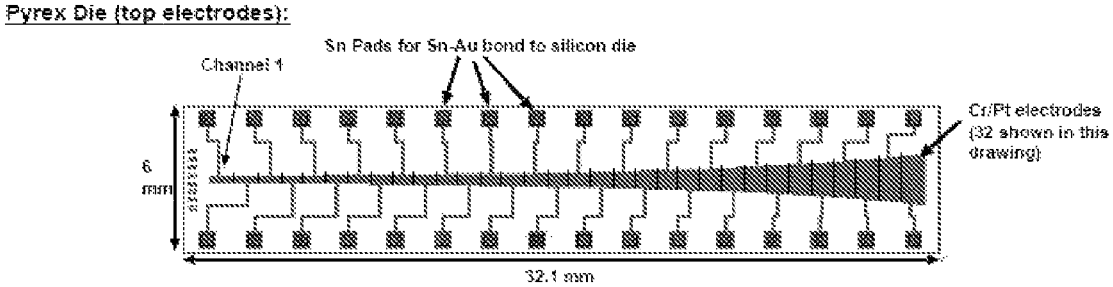
Figure 14A:
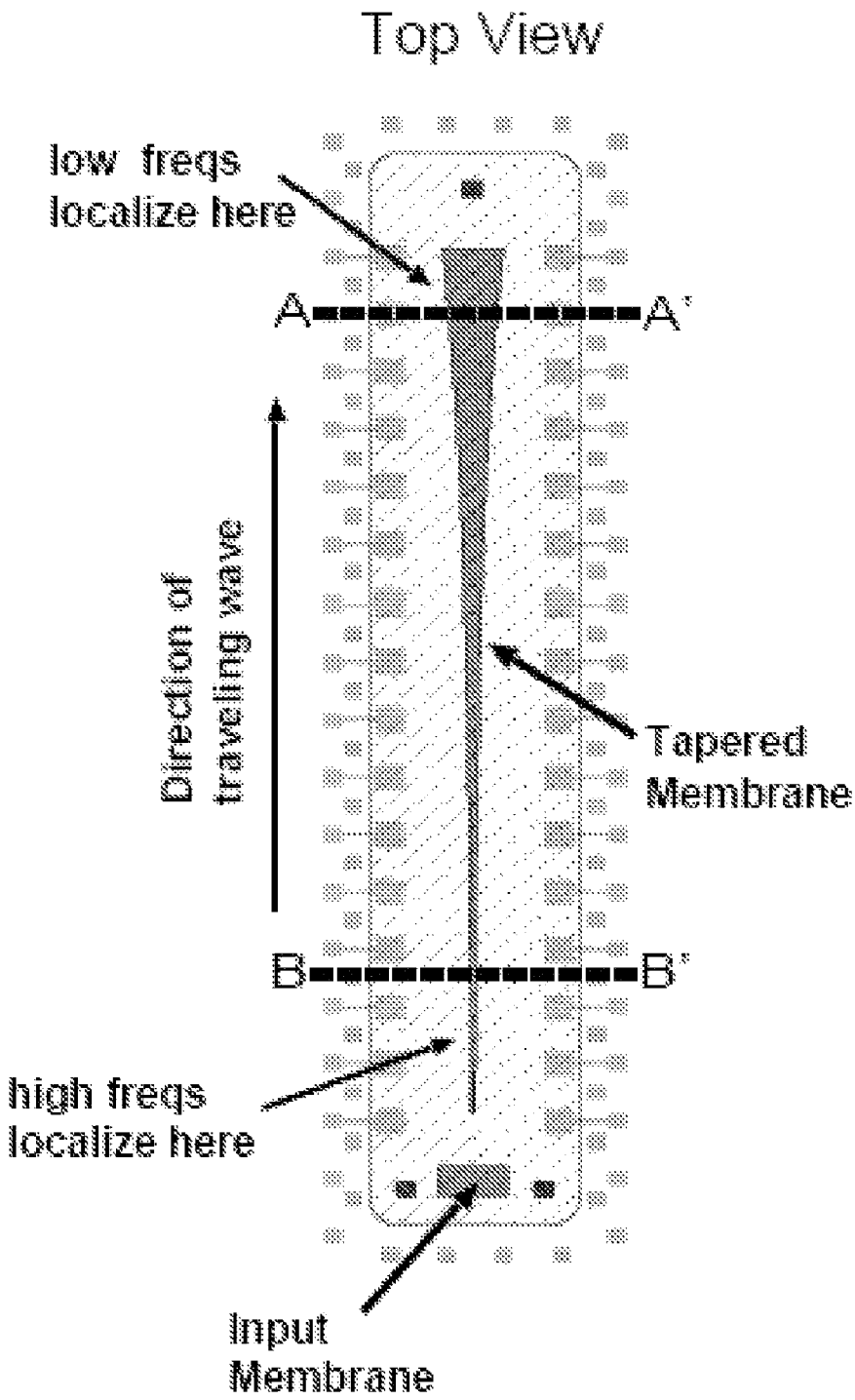
FIGS. 14A-14C show a top view and cross-sections of the multichannel acoustic sensor system design showing the internal structure of the fluid chamber and location of the sensing membrane and capacitive sensing structure.
Figure 14B:
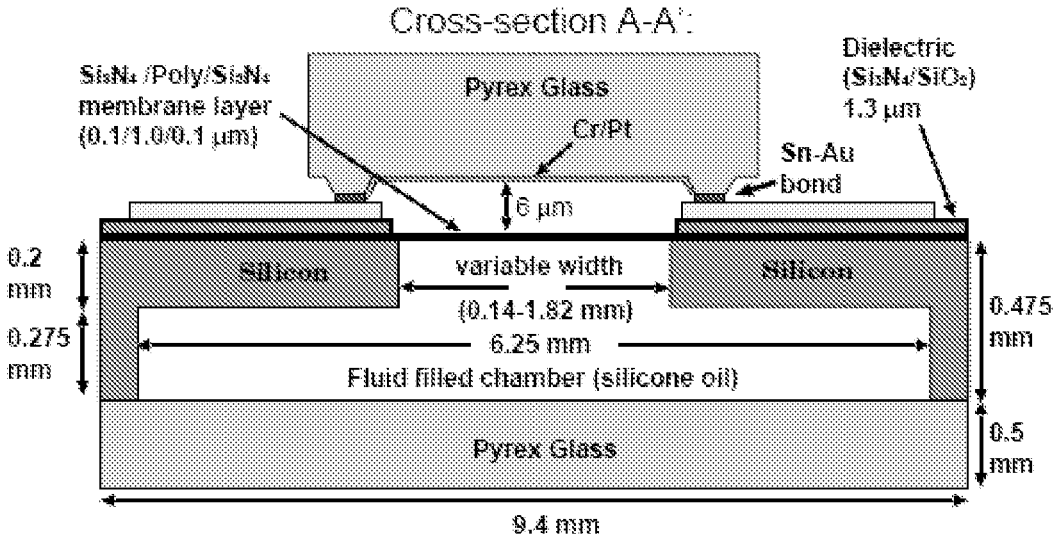
Figure 14C:
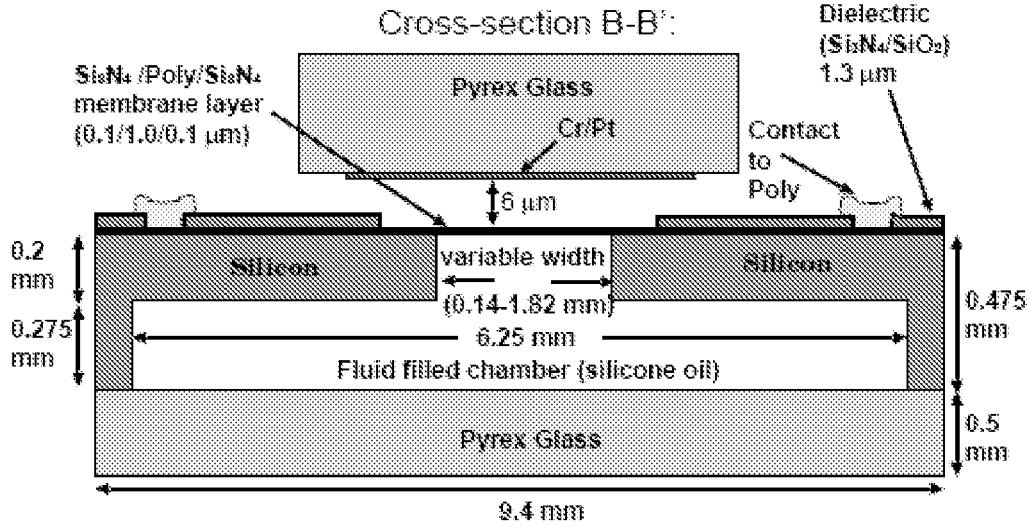

Since the membrane is now on the top of the silicon, the fluid chamber must be etched into the silicon rather than the glass. This has the added benefit of allowing the fluid chamber to be deeper, as the silicon etch (deep reactive ion etching, DRIE) is capable of a deeper etch than the HF glass etching used above. A deeper fluid chamber (0.5 mm deep) is closer to cochlear dimensions (the cochlear duct height is 0.1-2 mm). FIGS. 13A-13B shows the structure in a plan views. FIGS. 14B-14C show two cross-section views.

Increasing the duct height decreases the mass loading of the fluid. Thus, in order to keep the frequency of operation within a testable range (below 100 kHz for acoustic excitation), the membrane tension must be reduced. Attempts were made to produce low stress polysilicon membranes. The most successful method was to create a laminate structure for the membrane composed of outer tensile layers of LPCVD silicon nitride, and a central layer of compressive boron doped LPCVD polysilicon. By controlling the ratio of the film thicknesses, the residual stress was controlled to less than 100 MPa, while remaining tensile to avoid buckling. Stress variation across the wafer for the LPCVD thin films had a standard deviation of approximately 10 MPa. Hence it was not possible to control the stress to values lower than about 40 MPa. A film of 0.1/1.0/0.1 μm thickness LPCVD stoichiometric $Si_3N_4$/boron doped polysilicon/$Si_3N_4$ had a net residual stress of 40 MPa as measured by wafer curvature. This is the laminate used in the design.

As the duct height increases, the viscous fluid damping decreases. For this reason, fluid viscosity must be increased to avoid standing waves. Modeling and experiments indicated that a viscosity of 200 cSt was needed for this purpose.

The length of the membrane is chosen to be 3 cm, which is the length of a human basilar membrane. The width of the membrane is selected based mainly on fabrication limitations. The deep reactive ion etch (DRIE) through-wafer etch minimum easily achievable feature size is about 100 μm. This will be the minimum width of the membrane. A maximum width of 2 mm allows enough space for the rest of the needed features. If the width of the membrane is too large, problems are experienced with membranes breaking during release. It may be possible to make somewhat larger (perhaps up to 5 mm) membranes, but 2 mm was selected to improve yield. The fluid duct height for this design is determined by the thickness of a standard silicon wafer, 475 μm. The actual as-fabricated membrane taper (as measured on the finished devices) was 140 μm-1.82 mm.

The duct width was chosen to be 6.25 mm. Computations indicate that as duct width is increased the sharpness of the filter increases, until the duct width is 2 to 3 times the width of the membrane. After this point, further increases in the duct width have little effect. Thus, the duct width is chosen to be 6.25 mm. This is also a convenient size for handling the chips and for packaging.

Sensing

Figure 15:
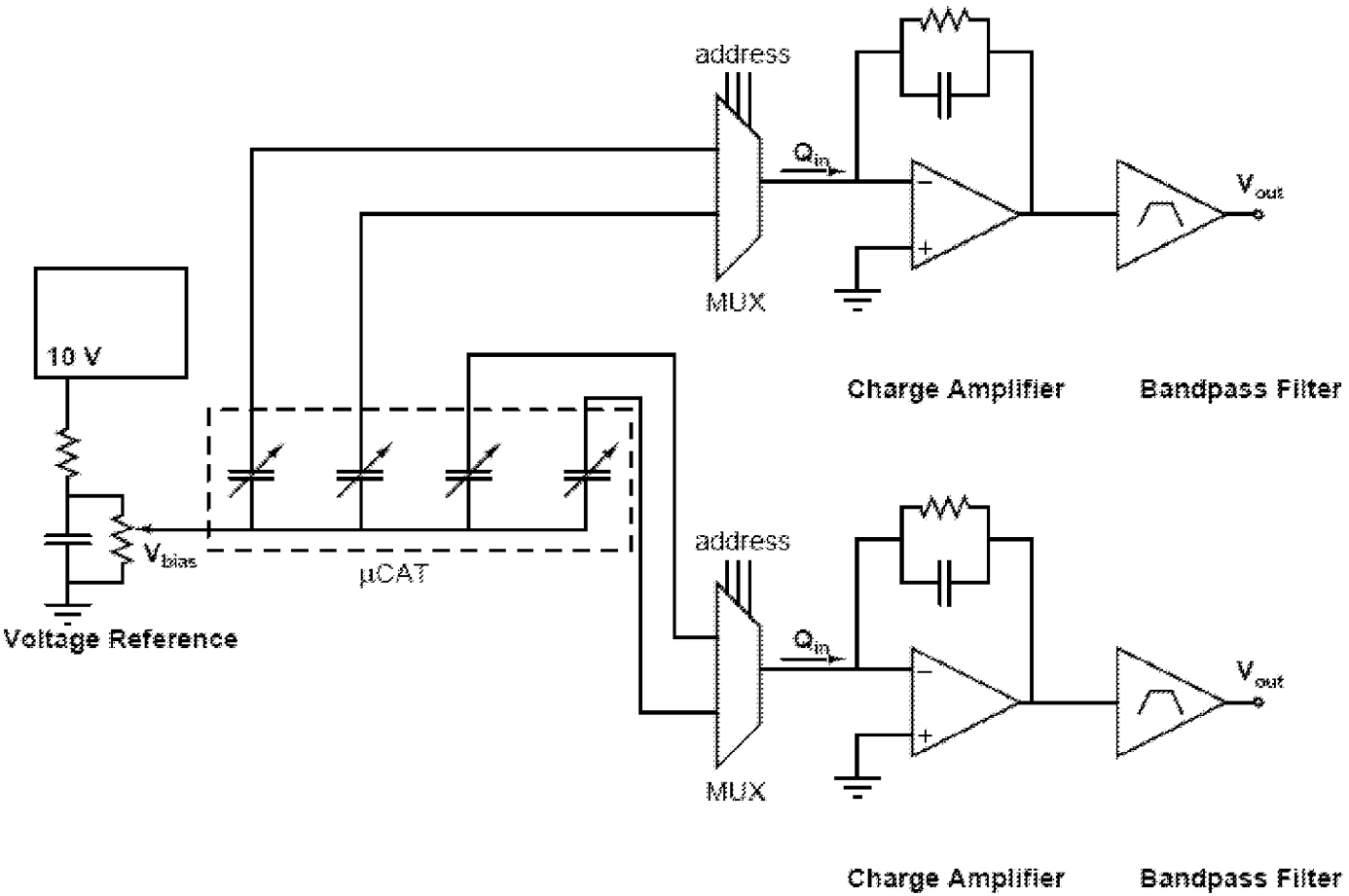
FIG. 15 shows a conceptual layout of the multiplexer to charge amp system to allow multiple sensor channels. In the interests of comprehension, only 4 channels are shown in the diagram. As implemented, the electronics can handle up to 32 channels, 16 going to each MUX, with 4 bits of address to each MUX.
Figure 16A:
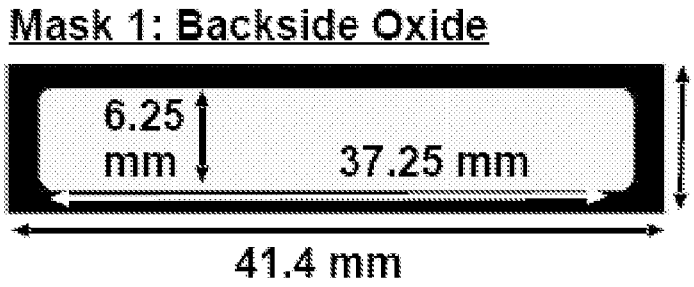
FIGS. 16A-16G are schematic views of a mask set for manufacturing the multichannel acoustic sensor system. Each 4" wafer contains 10 of these devices. Dark regions indicate opaque regions of the mask.
Figure 16B:
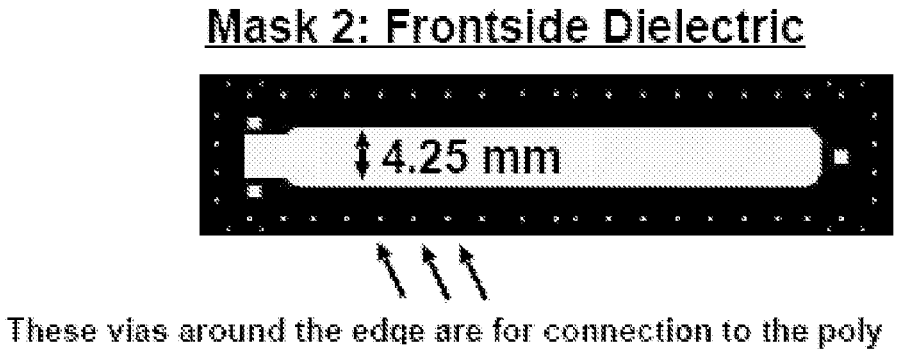
Figure 16C:
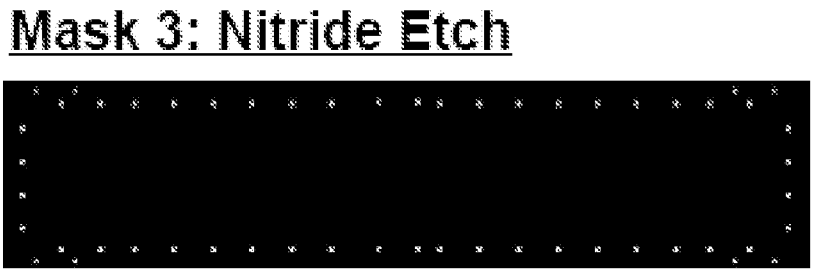
Figure 16D:
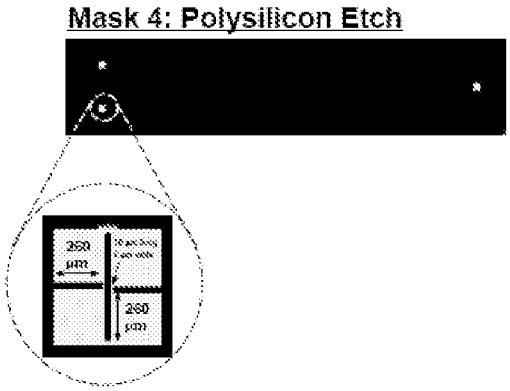
Figure 16E:
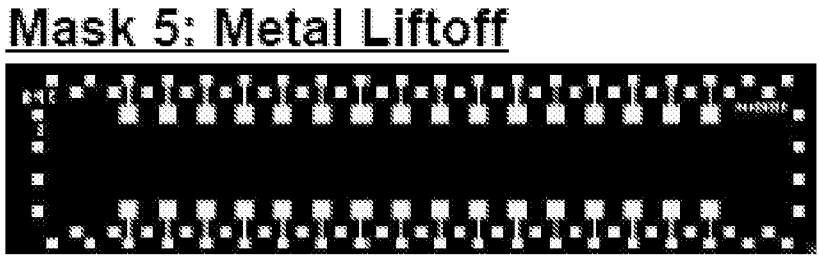
Figure 16F:
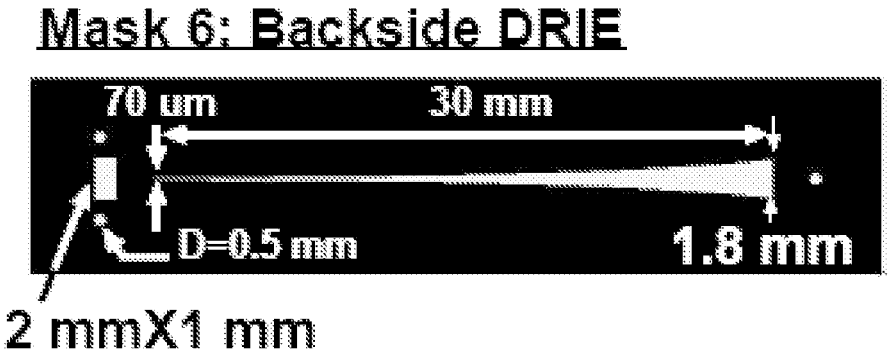
Figure 16G:
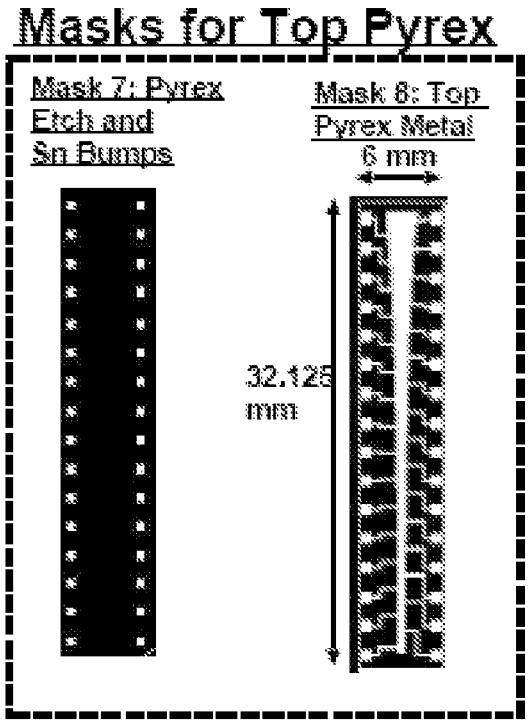
Figure 17A:
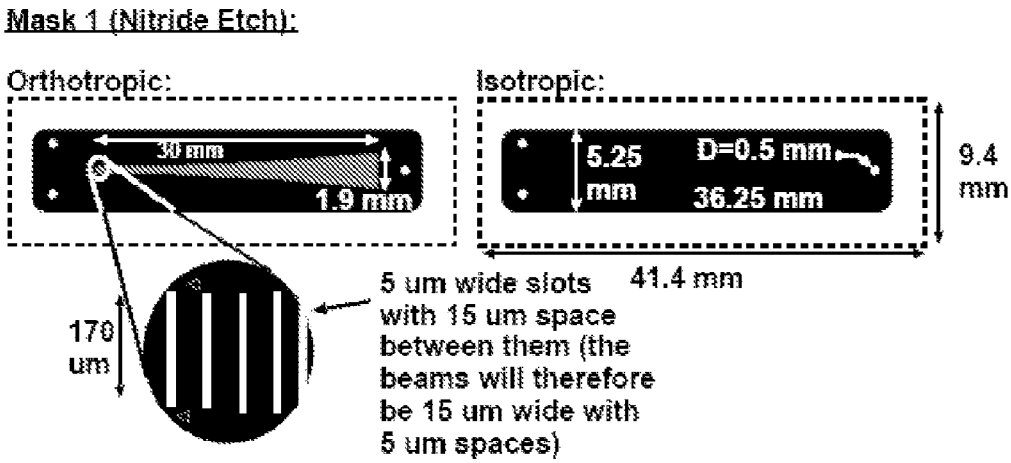
FIGS. 17A-17E are schematic views of a mask set for manufacturing the hydromechanical cochlear model. Each full mask contains 10 dies of this type. There are 4 orthotropic and 6 isotropic dies per wafer. In the diagram, white colored regions are transparent in the mask, black colored regions are opaque.
Figure 17B:
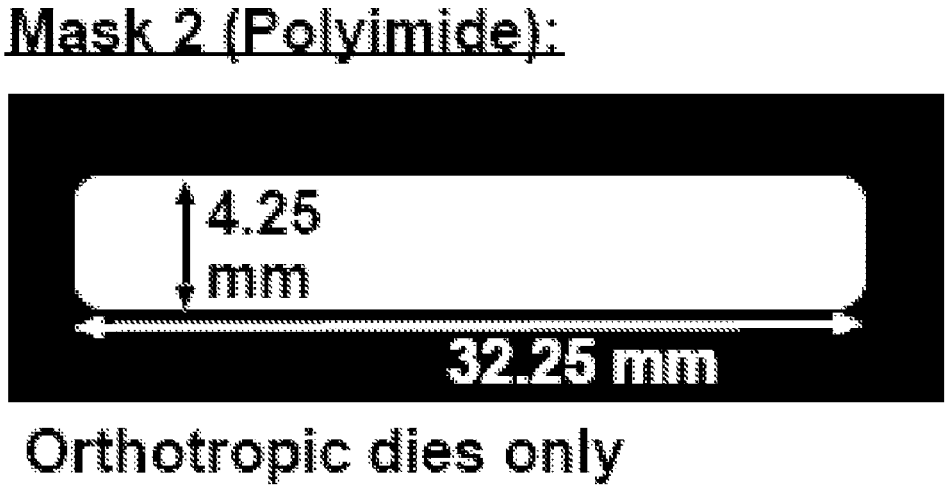
Figure 17C:
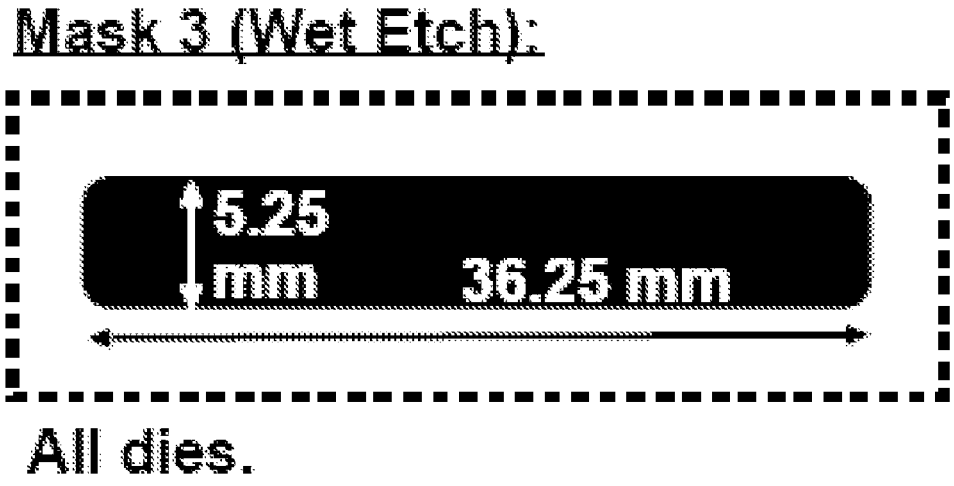
Figure 17D:
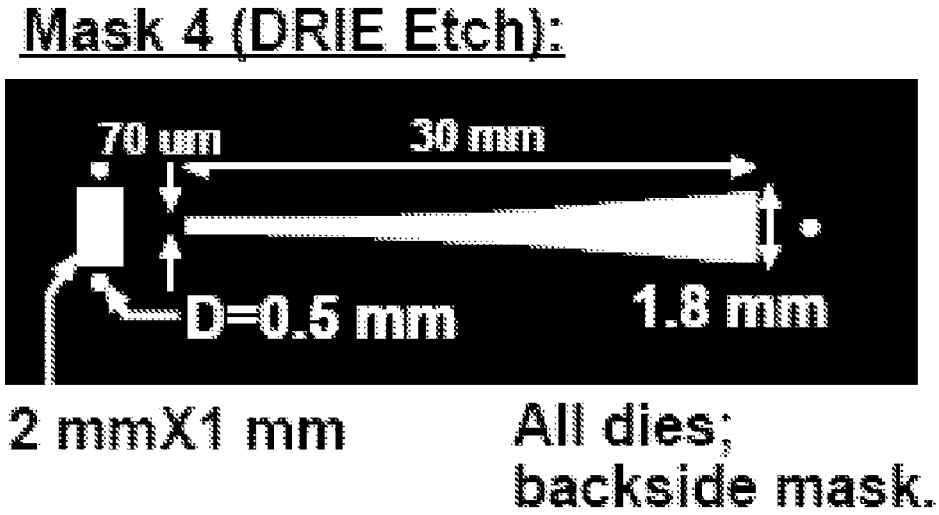
Figure 17E:
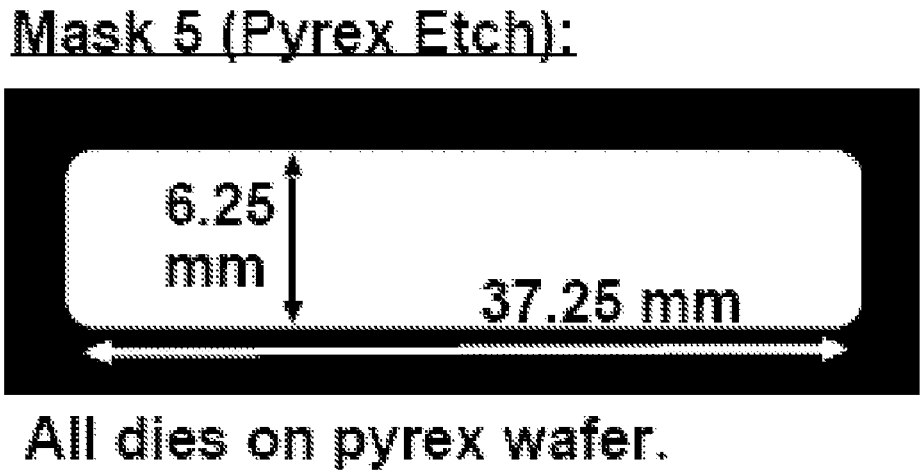

Sensing is accomplished using a capacitive sensing scheme similar to that described above. The only difference for the μCAT is that there are multiple channels to sense. To accomplish this task, the electronics were designed around two 16 channel analog multiplexers. The concept is shown in FIG. 15. Only 4 channels are shown in the Figure, 2 leading to each MUX. For the actual device, the number of channels is determined by the top glass piece. There are 32 bond points on the silicon die (see FIG. 13A-13B). Different glass tops with different numbers of electrodes have been fabricated. In all cases, all 32 bond points are used. Thus, for glass tops with less than 32 electrodes, multiple bond points serve each electrode. (Glass tops with 32, 8, 4, 2, and 1 electrode have been fabricated.) Each bond pad has 30 pF of stray capacitance (measurements agree with computations based on metalization area and dielectric thickness). So, for a 8 channel top glass piece, each channel will have 120 pF of stray capacitance. For a 4 channel top glass piece, each channel will have 240 pF of stray capacitance, and so on. If optimization is conducted in the future for a particular number of channels, the stray capacitance could be reduced by using only one bond point for each channel.

Each of the 32 bond points is wirebonded to the 40 pin hybrid DIP package. Half of the 32 channels then lead to each 16-channel MUX. There are 8 bits (4 for each MUX) to select the channels which are routed to the charge amplifiers. The remaining 8 pins on the package are wired to the corner pads (2 on each corner of the die) which make contact to the doped polysilicon membrane layer.

Rather than using the UAF42 universal active filter from Texas Instruments, dual Analog Devices opamps (OP270GS) are used as a bandpass filter. The opamps are configured as cascaded Sallen-Key amplifiers, resulting in 40 dB of passband gain in the 70 Hz-70 kHz band. This is a more efficient amplifier scheme, using 52% of the power required for the UAF42 (112 mW per bandpass filter rather than 216 mW for the UAF42).

The measured power consumption of the entire electronics is 326 mW, when operating off of +15V and −15V supplies. A SPICE model incorporating manufacturer-supplied models of the two OP27 dual Sallen-Key filters, the REF01 bias reference (which is similar to the ADR01), and the two AD795 charge amplifier predicts a total power consumption of 316 mW. The power consumption of the ADG506A multiplexers is not included in the model. The SPICE model predicts that 112 mW is consumed by each OP270GS, 38 mW by each of the AD795 chips, and 16 mW by the REF01 (accounting for 316 mW). Power consumption could be reduced by operating at a lower voltage, perhaps using a single 3.3 V or 5 V supply. This would reduce sensitivity somewhat because the sensor would operate a lower bias, but would be a worthwhile tradeoff for low power applications.

Modeling

The modeling approaches described above are used to compute the expected mechanical response of the μCAT. From the vibration pattern, the expected electrical output can be computed. Four models are available: the WKB model, the transmission line model, the two-dimensional thin-film fluid model, and a full three dimensional Navier-Stokes simulation.

Fluid Film Thickness

The WKB model, the lumped element transmission line model and the two-dimensional finite element model were all derived starting from the thin film fluid assumptions: they assumed that the fluid film thickness was small compared to the size of the structure and the wavelength of the solution. For this design, the fluid film is 475 μm high, but the membrane is 140 μm wide at its narrowest. Therefore the thin-film approximations will introduce some error. It is not immediately obvious how large that error will be.

In order to address this question, the problem has been solved using the three dimensional finite element model including the full linearized Navier-Stokes model, which was described above. As mentioned previously, the issue with this model is problem size and computation time. Solutions take approximately 20 minutes at each frequency, running on a Sun Blade 1000 (750 MHZ UltraSPARC III). The same problem was run with a different mesh (finer in x and coarser in z). The results are significantly different from those with the first mesh, indicating that the mesh is not sufficiently refined. The solution is not yet converged. Unfortunately, these meshes represent the limit of the computational resources available at the University of Michigan. Thus, it is not possible to determine how significant the three dimensional effects are, nor the magnitude of errors introduced by the two dimensional thin film fluid approximations.

Bending Effects

A second issue to consider is whether to ignore bending effects for simplicity, as was done above. For this design, the structure residual stress (based on wafer curvature measurements) is approximately 40 MPa. The structure ranges in width from 140 μm to 1.82 mm, and is 1.2 μm thick. This results in a range of bending numbers (see equation 2.3) from 1.1 to 0.08. Thus, the effects of bending stiffness will be significant at the narrow end of the membrane but tension effects will dominate at the wide end of the membrane.

Thus, bending effects should be included. The MITC4 element, a four node displacement based pretensioned orthotropic Mindlin-Reissner plate element is used to include both bending and pretension effects in the structure. For the material bending parameters, the elastic modulus and Poisson ratio of polysilicon are taken to be E=160 GPa, ν=0.23. This results in G=65.04 GPa. Over the stiff shelf regions, the displacement and both rotational degrees of freedom of the plate are set to zero. This is equivalent to clamped boundary conditions along the plate edge. Along the symmetry boundary, the plate rotation about x (−∂u/∂y) is set to zero.

A comparison of the results with and without bending effects are as expected based on the Bending Number analysis. At the narrow end of the plate, bending stiffens the structure, increasing the "center frequency" for these locations (which increases the overall bandwidth of the sensor), reducing the overall displacement (which decreases sensor sensitivity), and increasing the wave speed. At the wide end of the plate where tension dominates, the solution is very similar to the pure tension solution.

Electrostatic Spring

Another effect which is present in this system is the electrostatic spring effect of the parallel plate capacitor. When a bias is applied, a force per unit area is created on the membrane. The size of this force is modulated by the sense gap, according to $$P_E = -\frac{1}{2}\varepsilon_0 V_{bias}^2 \frac{1}{(g_0 - u)^2} \tag{5.1}$$

where $V_{bias}$ is the applied DC bias, $\in_0$ is the dielectric constant of the material in the gap ($8.854\cdot10^{-12}$ F/m for air), $g_0$ is the sense gap with no structure displacement, and u is the displacement of the structure. The nonlinear nature of this relationship results in a static force and in forces applied at the frequency of structure vibration and all higher harmonics. Since we are considering only a linear problem here, and are interested in the response of the system at the driven acoustic frequency, we will retain only the force at the frequency of the structure oscillation. After application of the Taylor expansion, this force per unit area can be seen to act as a negative spring, $$P_E = \frac{\varepsilon_0 V_{bias}^2}{g_0^3} u \tag{5.2}$$

This force can be included in the analysis by adding another term to the structural equation. It has little effect for the design in question, but can be included at no additional computational cost.

Displacement Results

The best available model is therefore the pretensioned plate model coupled to two thin-film fluid models: one for the silicone oil in the micromachined fluid chamber, the other for the air in the sense gap. The effects of the electrostatic spring are also included. This results in the final set of PDEs, $$T_x \frac{\partial^2}{\partial x^2} u + T_y \frac{\partial^2}{\partial y^2} u - D_{xx} \frac{\partial^4}{\partial x^4} u - 2D_{xy} \frac{\partial^4}{\partial x^2 \partial y^2} u - D_{yy} \frac{\partial^4}{\partial y^4} u + \frac{\varepsilon_0 V_{bias}^2}{g_0^3} u + m_a \omega^2 u = P_1 - P_2 \tag{5.3}$$

$$\left[\frac{\partial^2 P_1}{\partial x^2} + \frac{\partial^2 P_1}{\partial y^2}\right] + \left(\frac{\omega}{c_{eff1}}\right)^2 P_1 = \frac{\rho_1 \omega^2}{h_1 S(\delta_1 / h_1)} u \tag{5.4}$$

$$\left[\frac{\partial^2 P_2}{\partial x^2} + \frac{\partial^2 P_2}{\partial y^2}\right] + \left(\frac{\omega}{c_{eff2}}\right)^2 P_2 = -\frac{\rho_2 \omega^2}{h_2 S(\delta_2 / h_2)} u \tag{5.5}$$

(5.6)

where all of the bending rigidities were defined in equations 2.8 to 2.9, and the fluid model parameters were defined in equation 2.27.

Using this model, the expected oscillation of the microsystem is computed A frequency-position map is predicted over the 100 Hz-60 kHz band with amplitudes of approximately 0.1 nm/Pa. Over some regions of the response, there are forward traveling waves, over other regions, backward traveling waves. There is little reflection or build up of standing waves except at the lowest frequencies. At high frequencies, the baffle is very effective at stopping the incoming pressure from impinging directly on the tapered membrane. At low frequencies it is less effective.

| | |
|---|---|
| $\rho_1$ = 950 kg/m$^3$ | [silicone oil density] |
| $\mu_1$ = 200 cSt | [silicone oil viscosity] |
| $c_1$ = 1000 m/s | [acoustic free wave speed in oil] |
| $h_1$ = 475 μm | [fluid chamber height under membrane] |
| = 275 μm | [fluid chamber height elsewhere] |
| $\rho_2$ = 1.2 kg/m$^3$ | [air density] |
| $\mu_2$ = 0.017 cSt | [air viscosity] |
| $c_2$ = 343 m/s | [acoustic free wave speed in air] |
| $h_2$ = 6 μm | [fluid chamber height under baffle] |
| $b_0$ = 140 μm | [membrane width at x = 0] |
| $b_y$ = 1.82 mm | [membrane width at x = L] |

-continued

| | | |
|---|---|---|
| $T_x$ = | 50 N/m | [tension in x] |
| $T_y$ = | 50 N/m | [tension in y] |
| E = | 160 GPa | [Young's modulus of polysilicon] |
| v = | 0.23 | [Poisson ratio of polysilicon] |
| t = | 1.2 μm | [Thickness of polysilicon] |
| $m_a$ = | 0.0029 kg/m$^2$ | [membrane mass per unit area] |
| $g_0$ = | 6 μm | [capacitive sense gap] |
| $V_{app}$ = | 9 V | [applied bias voltage] |
| $\in_0$ = | 8.854 pF/m | [dielectric constant of air] |

Electrical Output

The parallel capacitive plates produce a charge due to the changing sense gap during oscillation, $$Q = V_{bias}\varepsilon_0 \frac{1}{g_0^2} \int\int_A w_p(x, y)dxdy \tag{5.7}$$

where $g_0$=6 μm is the initial sense gap, $\in_0$=8.854·10$^{-12}$ F/m is the permittivity of free space, $w_p(x,y)$ is the displacement of the sense electrode, and the integral is over the area of the electrode. The resulting charge is then passed into the charge amp and through the filter transfer function to result in a final voltage output. In the passband of the filter stage, the voltage output of the charge amplifier is simply $$V_{out} = \frac{1}{C_{fb}} Q \tag{5.8}$$

where the feedback capacitor is $C_{fb}$=10 pF. The spatial integral can be performed on the finite element displacement output data for the model described above (with bending, both thin film fluids, and the electrostatic spring) in post processing to compute the expected voltage output from each channel at a given frequency. The pattern of output from each channel follows the pattern of membrane oscillation.

The results indicate an expected sensitivity for each channel of the 32 channel device of 1-5 μV/Pa (−240 to −226 dB re 1 V/μPa) in a 100 Hz-70 kHz band. If the number of channels were decreased, the sensitivity of individual channels would increase at the expense of reduced frequency selectivity.

Microfabrication

Fabrication of all three MEMS devices described in this work was carried out at the University of Michigan Nanofabrication Facility (MNF). A combination of silicon and glass bulk and surface micromachining was used to fabricate the devices. Two fabrication processes are described in detail. The first is the fabrication process for producing the microengineered hydromechanical cochlear model. The second process was used to fabricate both the single channel trapped-fluid sensors and the multi-channel cochlear-like MEMS sensors.

Microengineered Hydromechanical Cochlear Model

The fabrication process for the hydromechanical cochlear model is here described in detail. The process is diagramed in FIGS. 7A-7F. The mask set is shown schematically in FIGS. 17A-17E.

Silicon Processing

The starting substrates are double-side polished, 475 μm thick, <100> oriented, 100 mm diameter, 1-10 Ω·cm p-type (Boron doped) silicon wafers. All photomasks are made using a photolithographic mask maker at the University of Michigan which is capable of producing approximately 1 μm minimum feature size. The process wafers are initially cleaned for 10 mins in 1:1:10 $H_2O_2$:$NH_3OH$:$H_2O$, rinsed, and then cleaned for 10 mins in 1:1:10 $H_2O_2$:HCl:$H_2O$, rinsed and dried. (An "RCA" clean.)

The wafers are then oxidized in an atmospheric pressure thermal oxidation furnace using a pyrogenic oxidation process [58] (2500 sccm $H_2$, 1700 sccm $O_2$, 30 sccm $N_2$) for 10 hours at 1100° C. This results in 2 μm of thermal $SiO_2$, which will be used as an etch stop for the DRIE etch at the end of the process. Film thickness was confirmed using a Nanospec 6100 spectroscopic reflectometer. (Measurement=1.982 μm+0.002 μm.) A stoichiometric silicon nitride thin film is then deposited in a low pressure chemical vapor deposition (LPCVD) furnace. This $Si_3N_4$ layer will be used as the membrane. The material is chosen for its low etch rate in HF and its tensile residual stress. Deposition conditions: 140 mT, 820° C., 160 sccm $NH_3$, 40 sccm dichlorosilane (DCS). A deposition time of 1 hour 4 mins is used to produce an approximately 0.3 μm thick film. Film thickness was measured using the Nanospec 6100 on a monitor wafer (without the $SiO_2$ film). (Measurement=0.316 μm+0.06 μm.)

The frontside of the process wafers is protected with Shipley 1827 photoresist spun at 3000 rpm for 30 secs (≈3 μm thick), and softbaked at 90° C. in an oven for 30 mins. The backside nitride is etched off of the process wafers and the monitor wafer using reactive ion etching (RIE) in a PlasmaTherm parallel plate plasma etcher. Etch process: 100 mT, 80 Watts platen power, 20 sccm $CF_4$, 1 sccm $O_2$. The measured etch rate for nitride and oxide is 20 nm/min. The wafers are etched for 25 mins to remove all of the nitride and etch approximately 200 nm into the backside $SiO_2$. The resist is stripped off of the frontside in heated Baker PRS2000 positive resist stripper for 15 mins. The backside $SiO_2$ is left in place to protect the backside of the wafer during subsequent processing steps. It will be removed later.

The monitor wafer (which does not have $SiO_2$) is annealed at 200° C. for 30 mins, and 350° C. for 1 hour on a hotplate to simulate the polyimide curing step. A Flexus 2320-S wafer curvature tool is then used to estimate the film stress in the silicon nitride (initial curvature was measured before starting the process). Assuming a silicon modulus of 180 GPa, the Stoney equations result in an estimated nitride film stress of 1.07 GPa. See section A.3.1 for a discussion of wafer curvature measurements. (Three measurements were made at three different orientations resulting in 1.065, 1.067 and 1.068 GPa.)

Photolithography is performed on the process wafer frontside using Shipley 1813 resist spun at 4000 rpm for 30 secs and softbaked for 30 mins. at 90° C. in an oven (resulting in a 1.3 μm thick film). The resist is exposed using an EV Model 620 contact aligner. This aligner uses a broadband UV lamp, calibrated at H-line (405 nm) to 10 mW/cm$^2$, but with approximately 5 mW/cm$^2$ at I-line (365 nm). Total exposure dose at H-line is 110 mJ/cm$^2$ (11 sec exposure). Develop time is 1 min in Microposit MF319 developer (standard ammonium hydroxide phosphate developer). The mask pattern defines the 15 μm thick beams with 5 μm spaces, as well as removing the nitride from around the edges of the dies where anodic bonding will be performed at the end of the process. For dies slated to be isotropic membrane devices, no beams are patterned; only the region around the outside of the dies is opened up. See Mask 1 in FIG. 17A.

Figure 7A:
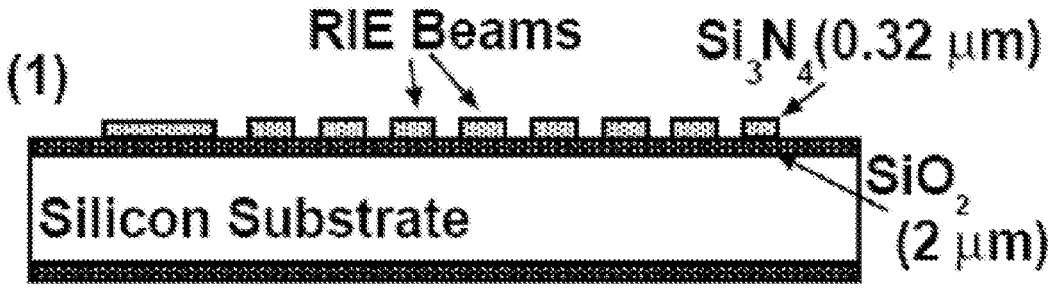
FIGS. 7A-7F are schematic views of a fabrication process.

The frontside nitride is etched on the process wafers using the PlasmaTherm RIE nitride etch. (Etch process: 100 mT, 80 Watts platen power, 20 sccm $CF_4$, 1 sccm $O_2$. The measured etch rate for nitride and oxide is 20 nm/min.) The wafers are etched for 9 mins, rotated 180° and etched for another 9 mins. (The rotation helps to improve etch uniformity.) The resist is stripped off in an oxygen plasma (200 mT, 200 Watts, 10 mins) followed by heated Baker PRS2000 positive resist stripper for 20 mins. After processing, the etch depth was measured using a DekTak 6M surface profilometer to be 0.38 μm. Thus, the etch was all the way through the nitride and slightly (0.06 μm) into the oxide. The situation at this point is seen in FIG. 7A.

Figure 7B:
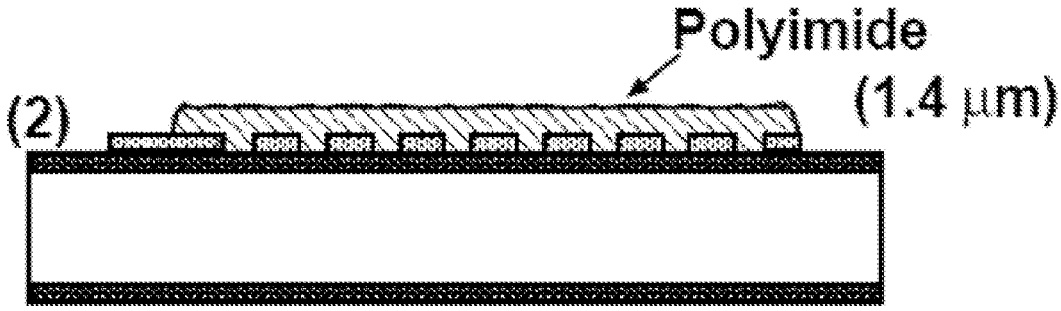

HD Microsystems low-stress photodefineable polyimide PI2737 is now spun onto the frontside of the process wafers with a 9 sec 500 rpm spread and a 30 sec 5000 rpm spin. The wafers are softbaked at 90° C. on a hotplate for 4.5 mins. The polyimide is then exposed using the H-line EV620 contact aligner with a total dose of 750 mJ/cm$^2$ (75 sec exposure). The polyimide acts like a "negative" resist. The mask pattern is set up to leave a polyimide region larger than the etched beam region on those dies slated to be "orthotropic" membranes. Dies for the "isotropic" devices have no exposed polyimide. See Mask 2 in FIG. 17B. The polyimide can stick to the mask, so "soft contact" mode should be used. Developing is carried out on a spin chuck ("puddle develop" and low spin speeds) using the HD Microsystems DE9040 developer (n-methylpyrrolidinone/propylene glycol methyl ether 50/50) and RI9180 rinser (cyclohexane and n-butyl acetate). Develop time is 1-2 mins. Completion of the develop is visually obvious once the white residue is gone. The wafer backside is cleaned with DE9040 and RI9180. The polyimide is then cured on a hotplate: 10 min ramp to 200° C., dwell for 30 mins, 20 min ramp to 350° C., dwell for 30 mins, cool to 200° C. for 10 mins, remove from hotplate. The polyimide thickness was measured after curing using the DekTak 6M at 1.4 μm. The situation at this point is seen in FIG. 7B.

A 10 nm Cr layer is now sputtered onto the frontside of the process wafers followed by a 50 nm Au layer. Sputtering is carried out in an Enerjet DC magnetron sputterer in a 7 mT Argon ambient. Film thickness is determined by the sputtering time (50 secs for the Cr at 650 Watts, 108 secs for the Au at 0.5 Amps) based on a calibrated deposition rate.

Figure 7C:
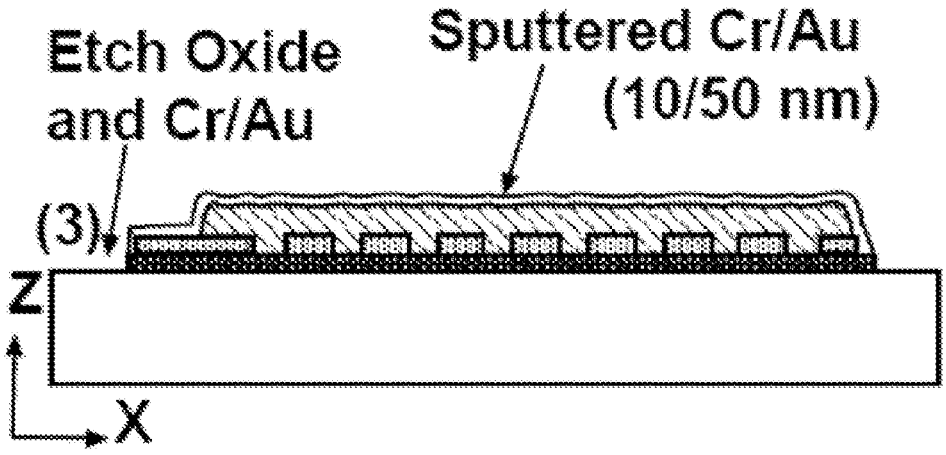

Photolithography is performed on the process wafer frontside using Shipley 1827 resist spun at 4000 rpm for 30 secs and softbaked at 115° C. on a hotplate (resulting in a 2.7 μm thick film). The resist is exposed using a contact aligner (EV Model 620, H-line), exposure dose is 300 mJ/cm$^2$ (30 secs exposure time). This is an intentional overexposure; no fine patterns are present in this mask. Develop time is 2 min in MicropositMF319 developer (again, intentional overdevelop since no small patterns are present). The mask pattern opens up the edges of the die where anodic bonding will take place. See Mask 3 in FIG. 17C. The wafers are then etched in Transene TFA Gold Etchant (KI-$1_2$ Complex) for 5 mins, rinsed, and etched in Cyantek CR-14 Chromium etchant (22% $(NH_4)_2Ce(NO3)_6$+8% H Ac+$H_2O$) for 5 mins. These etch times are significant over-etchs. The patterns are all large. Following the Cr/Au etch, the wafers are etched in Transene Improved Buffered Hydrofluoric Acid Etch (BHF) for 30 mins. This not only etches away the $SiO_2$ around the outside of the dies on the frontside, but also removes the $SiO_2$ from the wafer backsides. The situation at this point is seen in FIG. 7C. The 1827 resist is left in place on the frontside to help protect the membrane during subsequent processing.

Clariant AZ 9260 photoresist is spun onto the frontside of the process wafers at 1000 rpm for 30 secs and softbaked for 30 mins at 90° C. in an oven. (Approximately 20 μm thick.) This will protect the frontside structures during backside processing. AZ 9260 is then spun onto the backside at 1000 rpm for 30 secs and softbaked at 90° C. in the oven for 30 mins. The resist is exposed on the EV620 contact aligner with 1900 mJ/cm$^2$ total dose (190 secs exposure time). The mask is backside aligned using the EV620 camera system. The pattern on the mask defines the exponentially shaped membrane structures, the rectangular "input" membranes, and the fluidic filling ports. The mask also includes lines between the dies, which will allow the DRIE etch to be used to separate the individual dies, avoiding the need for dicing, which the membranes would not survive. See Mask 4 in FIG. 17D. The resist is developed for 3 mins in 1:3 Clariant AZ4OOK:$H_2O$ (a potassium-based buffered developer).

Figure 7D:
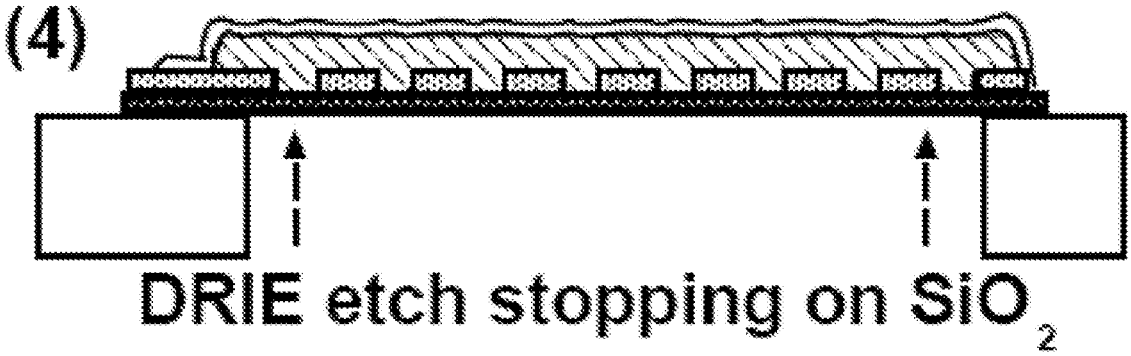
Figure 7E:
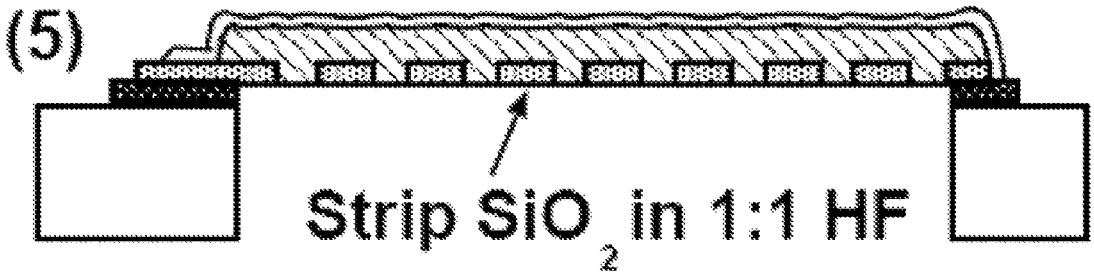
Figure 7F:
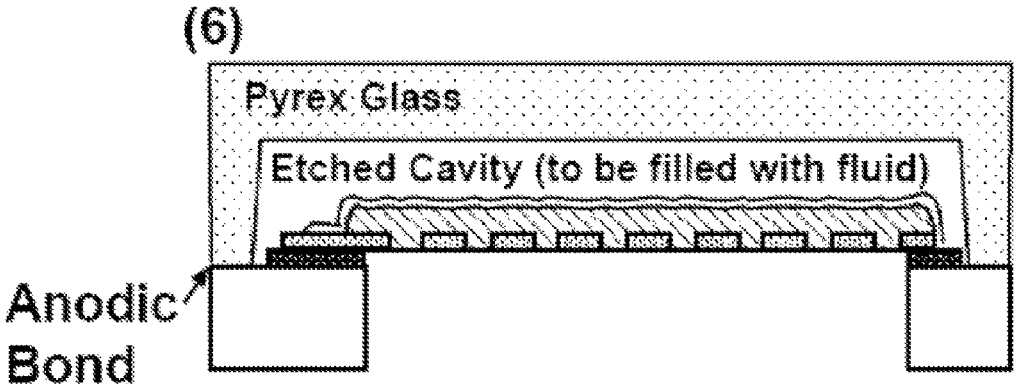

The process wafers are then mounted to 100 mm diameter, 500 μm thick silicon handle wafers using Shipley 1827 resist spun for 4 secs at 500 rpm, then 10 secs at 2000 rpm, and hardbaked in a 110° C. oven for 20 mins. These handles are needed to hold the wafers during the subsequent deep reactive ion etching (DRIE) process. A through-wafer etch is now performed from the backside in an STS Deep-Trench RIE (DRIE) tool (time-multiplexed DRIE with an inductively coupled plasma), running a modified Bosch process. A 1 min $O_2$ plasma descum (800 W coil power, 200 W platen power, 50 sccm $O_2$ 45 mT) is performed in the STS tool prior to starting the etch. (Process parameters: Etch step: 13 secs, 160 sccm $SF_6$, 35 mT, 800 W coil power, 200 W platen power. Passivation step: 7 secs, 80 sccm $C_4F_8$, 15 mT, 600 W coil power, 0 W platen power.) Etch time to completely etch out the pattern in the narrowest portions of the etch is 3 hrs. 20 mins. The widest features break through to the oxide after approximately 2 hrs. 45 mins. Etch is more rapid around the outside of the wafer than in the center, so the dies are oriented such that the narrowest parts of the pattern are close to the outside of the wafer. The 2 μm of thermal $SiO_2$ serves as an etch stop for this process. The etch rate of the $SiO_2$ is approximately 200 times slower than the Si. Due to this, some etch nonuniformity can be tolerated. If too much overetch is required, however, the $SiO_2$ may thin too much and the membranes could break. This step is the worst step as far as yield for this reason; once the membranes are etched out they become fragile and can easily break. The protective coat of AZ 9260 helps in this regard, as does a clean handle wafer. During the through etch, the pattern widens by approximately 50 μm in each lateral dimension. So, a trench will end up being 90-120 μm wider than the masked dimensions. The situation at this point is seen in FIG. 7D. If the etch is not complete, the wafers can be returned to the etch chamber and etched for additional time to complete the etch.

The wafers (still on a handle wafer) are next dipped in isopropyl alcohol for 10 secs and immediately transferred to 1:1 HF:$H_2O$ (with isopropanol still wetting the surface). They are etched in the 1:1 HF for 10 mins. The membranes will look initially rippled after coming out of the DRIE etch, because of the compressive stress in the oxide etch stop. After about 5 mins in 1:1 HF, the membranes will appear to flatten out as the oxide is removed. If the etch is allowed to proceed for too long, the nitride will begin to slowly etch away and some membranes may fracture. The isopropanol dip is needed to stop the formation of air bubbles in the etched trench. The isopropanol completely fills the trench with no bubble formation. The HF is then able to replace the IPA without forming bubbles. If the wafer is put into HF directly, air bubbles will form in the etched trench and stop the etchant from being able to reach and remove the oxide layer, resulting in a buckled membrane.

The wafers are rinsed gently in a DI water cascade (no agitation or bubbles!) and then transferred to an acetone soak for 10-20 hours, which will release the dies from the handle wafer. The individual dies are rinsed in acetone (10 mins), then isopropanol (15 mins), then water (20 mins). The isotropic dies, which do not have polyimide on them, are cleaned in 1:1 $H_2SO_4$:$H_2O_2$ (Piranha) for 5 mins and rinsed in water. The orthotropic dies cannot be cleaned in Piranha since it will etch away the polyimide. All the dies are dried in a 110° C. oven. After cleaning and drying, the membranes are not perfectly flat; there is always a small deflected region around the 300-400 μm wide part of the membrane. The cause of this deflection has not been determined, but it does not appear to affect the mechanics. The magnitude of the deflection is 3-4 μm peak. Elsewhere the membranes are flat (<0.1 μm deflection).

Glass Processing

A 500 μm thick, 100 mm diameter Pyrex glass wafer (Corning type 7740 borosilicate glass with Na and Al doping) is now processed to produce the fluid chambers. First, the wafer is cleaned in 1:1 $H_2O_2$ (Piranha) for 10 mins. 50 nm Cr and then 500 nm of Au are sputtered onto one side of the glass in a DC magnetron sputterer in an Argon ambient at 7 mT. Lithography is performed on the glass wafer using Shipley 1827 resist spun at 4000 rpm for 30 secs (2.7 μm thick) with a 115° C. hotplate softbake for 1.5 mins. The resist is exposed on the EV620 contact aligner with a dose of 240 mJ/cm$^2$ (24 secs exposure time) and developed in MF319 developer for 1.5 mins. The mask pattern is a 6.25 mm wide, 37.25 mm long rectangular chamber with 1 mm radiused corners. 150 μm wide lines to show the die outer dimensions of 9.4 mm by 41.4 mm are also included on the mask. See Mask 5 in FIG. 17E.

After exposure, the wafer is etched in Transene TFA Gold etchant for 5 mins, rinsed, and etched in Cyantek CR-14 Chromium etchant for 2.5 mins. The resist is stripped off in heated PRS2000 for 10 mins. The wafer backside is then protected with a flexible Poly Vinyl Chloride (PVC) polymer dicing saw mounting tape [Semiconductor Equipment Corporation, Moorpark, Calif.] which bonds to the glass with a synthetic acrylic adhesive at slightly elevated temperatures. This backside protection is superior to sputtering Cr/Au onto the backside (some pinholes exist in the Cr/Au which cause etch pits; the polymer film does not have this problem). The wafer is then etched in concentrated (49%) HF 12 mins. The undercut during this etch will cause the Cr/Au mask to delaminate, so this is the maximum achievable etch time. The DekTak 6M was used to measure the etch depth at 110 μm.

The dicing saw tape is removed from the glass wafer with acetone and isopropanol, and the glass wafer is diced into individual dies on a MicroAutomation 1006 dicing saw, using the Cr/Au lines as alignment. The Cr/Au mask is then removed from the frontside of all the dies with the Transene TFA gold etch and Cyantek CR14 Chromium etch. This is followed with a 1:1 $H_2SO_4$ (Piranha) clean for 10 mins, a water rinse, and 110° C. oven dry. The Pyrex ducts are ready for bonding.

Bonding and Packaging

Finally, the Pyrex duct dies are aligned to the frontside of the silicon dies by eye (the dies are the same size, so gross alignment is easy). Anodic bonding is carried out in custom bonding jig. The bonding jig is machined out of aluminum, with two parallel aluminum plates. A bonding jig is needed since the commercial bonding tools which are available at the Michigan Nanofab are not capable of handling dies of this size. On one plate is a raised ridge slightly smaller than the die. On the other plate is a slight recess which allows positioning of the die. The ridge makes contact around the edge of the die while allowing the gap between the aluminum plates to be large enough to avoid arcing. Alumina ($Al_2O_3$) screws with steel springs are used to clamp the two sides together, providing a small clamping force (<10N) while maintaining electrical isolation between the two plates. Springs are needed to take up the mismatch in thermal expansion between the aluminum and alumina, or the screws will break.

The bond is performed in a $N_2$ glovebox on a hotplate at 350° C. with a 700 V DC bias for 30 minutes. The silicon die must be held at a positive potential with respect to the glass. For this bond, the glass is placed on the bottom electrode (ground) and the silicon on top in contact with the top electrode (high). Note that the thermal conductivity of glass is much lower than that of Silicon. Hence, the temperature at the bond interface will be somewhat lower than that measured by the thermocouple. The hotplate is turned on with a setting of 400° C. After 30 minutes the base of the bonding jig has reached a temperature of 350° C. This temperature is measured by a thermocouple inserted into the center of the base of the jig. Hence the actual die temperature during bonding is somewhat (20-30° C. estimated) below the measured 400° C. temperature. The voltage is applied gradually (steps of 50 V over 5 mins, keeping the current below 0.2 mA). Once 700 V is reached, the bond is allowed to continue for 30 minutes. After 30 minutes, the current has dropped to less than 0.02 mA, the hotplate and the voltage source are turned off and the bonding jig is allowed to cool to room temperature (approximately 1.5 hours). Note that anodic bonding occurs most easily to p-type (boron doped) silicon, hence the choice of starting substrate doping. Note also that due to the geometry, it is not possible to measure the deflection of the membrane after bonding. It is possible, even likely, that the anodic bonding process will change the stress in the membrane.

After bonding the chips are removed from the cleanroom and filled with silicone oil. The oil is initially degassed using an ultrasonic water bath and pumping with vacuum pump to low vacuum (100 mT). A 25 gauge (0.51 mm outer diameter) stainless steel needle epoxied into the filling hole which was through etched into one end of the silicon chip. A high viscosity epoxy (Loctite Hysol E-00NS Non-Sag Epoxy) is used to avoid flowing the epoxy over the die. After the epoxy cures, the needle is attached to a plastic Luer Lock 0.1 oz. syringe filled with Clearco Pure Silicone oil of the desired viscosity. A micrometer jig is used to slowly depress the plunger to inject the silicone oil. Since the glass base of the chip is transparent, it is easy to watch the oil fill and to ensure that no air bubbles form. Once the duct is full, the stainless steel needle is cut with wire cutters, which crimps the metal closed. Dots of epoxy are placed over the end of the needle and over the two holes out of which the air was forced.

MEMS Sensor Process

The process for fabricating the MEMS sensors is described herein. The first mask set included both types of devices. A later mask set was used for producing only the cochlear-like sensors in order to produce a large number of devices for per run. The fabrication process is diagramed in FIGS. 9A-9I. Only the mask geometry differs from the single-channel sensors to the multichannel cochlear-like sensor. The mask set for the single-channel sensor is shown in FIGS. 10A-10G. The mask set for the multichannel sensor is shown in FIGS. 16A-16G.

Silicon Processing

The starting substrate for the silicon components is a double-side polished 100 mm diameter, 475 μm thick, <100> oriented, p-type (1-10 Ohm·cm) silicon wafer. All photomasks are made using a photolithographic mask maker at the University of Michigan which is capable of producing approximately 1 μm minimum feature size. All lithography steps use a plastic spin chuck which contacts the wafer around the edges to avoid damaging the backside of the wafer. The process wafers are initially cleaned for 10 mins in 1:1:10 $H_2O_2$:$NH_3OH$:$H_2O$, rinsed, and then cleaned for 10 mins in 1:1:10 $H_2O_2$:HCl:$H_2O$, rinsed and dried. (An "RCA" clean.)

The wafers are then oxidized in an atmospheric pressure thermal oxidation furnace using a pyrogenic oxidation process [58] (2500 sccm $H_2$, 1700 sccm $O_2$, 30 sccm $N_2$) for 10 hours at 1100° C. This results in 2 μm of thermal $SiO_2$, which will be used as an etch stop for the DRIE etch at the end of the process. Film thickness was confirmed using a Nanospec 6100 spectroscopic reflectometer. (Measurement=1.96 μm±0.002 μm.

A second "RCA" clean is conducted, and then 100 nm of stoichiometric silicon nitride is deposited in a low pressure chemical vapor Deposition (LPCVD) furnace. Deposition conditions: 140 mT, 820° C., 160 sccm $NH_3$, 40 sccm dichlorosilane (DCS). A deposition time of 25 mins is used to produce an approximately 0.1 thick film. Film thickness was measured using the Nanospec 6100 on a monitor wafer (without the $SiO_2$ film). (Measurement=0.0969 μm±0.0007 μm). Next a polysilicon thin film is deposited in another LPCVD furnace with a 4 hour and 20 min deposition time, aiming for a 1 μm thick film. Deposition conditions: 100 mT, 588° C., 80 sccm $SiH_4$. Note that the deposition conditions of the polysilicon film will have a strong effect on the intrinsic residual stress and grain size of the polysilicon. These deposition conditions result in a compressive residual stress and a fine grained polysilicon.

The polysilicon is next heavily doped with boron using solid-source boron diffusion in an atmospheric pressure furnace at 1175° C. with a 30 minute deposition time. This is sufficient to dope the polysilicon to the solid solubility limit of approximately $2\cdot10^{20}$ ions/cm$^3$. During the boron diffusion, a boron-rich borosilicate glass (BSG) will grow on the polysilicon. A 10 minute dilution time is used in the furnace after boron doping to grow more glass in an oxygen ambient and reduce the concentration of boron in the BSG to make it easier to etch off later. This dilution step may or may not be necessary. The BSG growth is expected to consume approximately 100 nm of polysilicon, based on measurements of film thickness from previous doping runs. After removing the wafers from the furnace, the BSG is stripped in 1:1 HF for 5 mins. The sheet resistance of the polysilicon after BSG removal is 11-14 Ω/□.

Another "RCA" clean is conducted, and then a second 100 nm layer of LPCVD stoichiometric silicon nitride is deposited. Deposition conditions are the same as the previous film: 140 mT, 820° C., 160 sccm $NH_3$, 40 sccm dichlorosilane (DCS). A deposition time of 25 mins is used to produce an approximately 0.1 μm thick film. This results in a nitride/polysilicon/nitride laminate with approximately 43 MPa net tensile stress.

Figure 18:
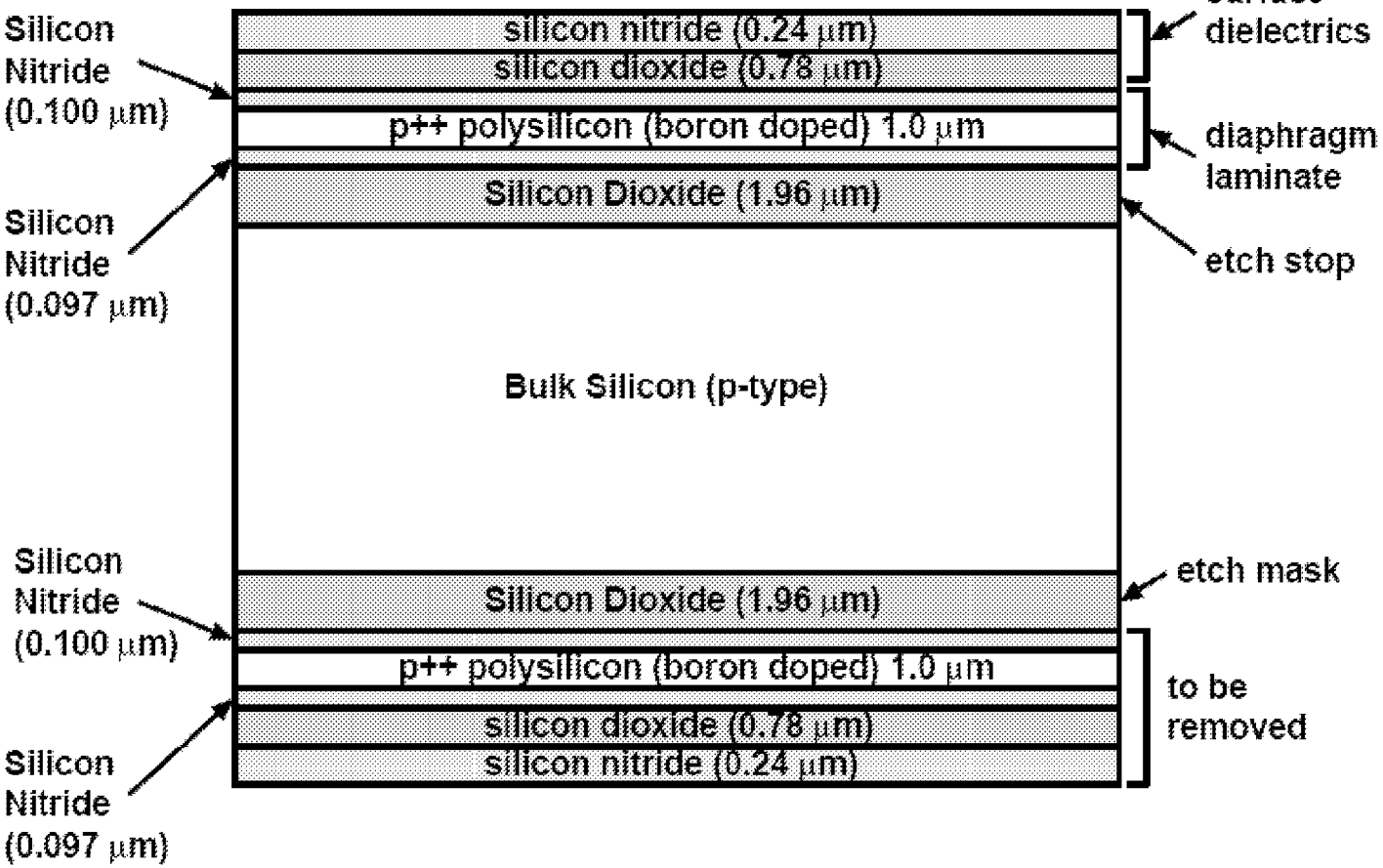
FIG. 18 is a view of initial thin films deposited on the process wafers. The measured thicknesses of the films and their purpose is also shown.

After the second silicon nitride deposition, without breaking vacuum, 0.8 μm thick $SiO_2$ film is deposited by LPCVD (920° C., 435 mT, 120 sccm $N_2O$, 60 sccm Dichlorosilane for 3 hours 30 min dep time). Finally, a 0.3 μm thick LPCVD silicon nitride layer is deposited (140 mT, 820° C., 160 sccm $NH_3$, 40 sccm dichlorosilane (DCS), 1 hour dep time). Film thickness was measured using the Nanospec 6100 on a monitor wafer. (Measurement: $Si_3N_4/SiO_2/Si_3N_4$=0.101/0.782/0.242 μm. The film stack on the wafer at this stage is shown in FIG. 18.

The unwanted backside films are next removed from the process wafers using a combination of wet and dry (plasma) etching. The wafer frontside is protected with Shipley 1827 photoresist spun at 3000 rpm for 30 secs and baked in a 110° C. oven for 25 minutes. The backside nitride is etched off of the wafers using reactive ion etching (RIE) in a PlasmaTherm parallel plate plasma etcher. (Etch recipe #14: 100 mT, 80 Watts platen power, 20 sccm $CF_4$, 1 sccm $O_2$. The measured etch rate for nitride and oxide is 20 nm/min.) The wafers are etched for 30 mins to completely remove the backside nitride and part of the first $SiO_2$ layer. The $SiO_2$ layer is then completely removed by etching in Transene improved buffered hydrofluoric acid etch (BHF) for 10 mins. The backside nitride/poly/nitride is then etched off using RIE in the PlasmaTherm etcher. First, the nitride is removed using the nitride etch (recipe #14) for 3.5 mins., rotate 180 degrees, 3.5 more mins. (The 180 degree rotation halfway through the tech helps to improve etch uniformity.) At this point, a four-point probe sheet resistance measurement can be conducted to confirm that doped polysilicon is exposed. Expected film resistivity is 50 Ω/sq. The polysilicon is then etched for 10 mins, rotate 180 degrees, 10 more mins using a polysilicon etch process: (Etch recipe #10: 10 mT, 50 Watts platen power, 12 sccm $SF_6$, 3 sccm $O_2$. The measured etch rate for polysilicon is 60 nm/min.) Finally, the last backside nitride layer is etched using recipe #14 for 3.5 mins, rotate 180 degrees, 3.5 more mins. After the etching is complete, the backside oxide thickness was measured on the Nanospec 6100, giving 1.897 μm, indicating that only the thick backside oxide film remains, and it has been slightly etched, thus all other backside films were removed.

Photolithography is performed on the process wafer backside using Shipley 1827 resist spun at 3000 rpm for 30 secs and softbacked for 30 mins at 90° C. in an oven (resulting in a 3 μm thick film). The resist is exposed using an EV Model 620 contact aligner. This aligner uses a broadband UV lamp, calibrated at H-line (405 nm) to 20 mW/cm$^2$, but with approximately 10 mW/cm$^2$ at I-line (365 nm). Total exposure dose at H-line is 260 mJ/cm$^2$ (13 sec exposure). Develop time is 1 min. in Microposit MF319 developer (standard ammonium hydroxide phosphate developer). The mask pattern will be used to pattern the backside oxide, which will be used as the etch mask for etching the fluid chambers. See Mask 1 in FIG. 10A.

An oxygen plasma descum is performed on the wafer backside in a March PX-series oxygen plasma asher at 100 W, 300 mT oxygen for 60 secs. The backside of the process wafers is then etched in the PlasmaTherm RIE tool using an oxide etch recipe for 60 mins, rotated 180 degrees, and etched for 60 more mins. (Etch recipe #9: 15 sccm $CF_4$, 15 sccm $CHF_3$, 40 mT, 100 W. Measured oxide etch rate is 18 nm/min). Completion of the etch is verified by measuring the remaining oxide thickness (zero) on the Nanospec 6100. The photoresist mask is removed from the process wafers using a 300 Watt, 350 mT oxygen plasma in the March PX-series plasma asher for 5 minutes, followed by a 10 minute soak in heated Baker PRS 2000 positive resist stripper. At this stage, the process wafers are in the situation shown in FIG. 9A.

Next, the topside dielectric layers will be removed from around the regions where the released mechanical structures will lie, as well as opening vias through the dielectric layers to make contact to the doped polysilicon layer. The backside is first protected with Shipley 1827 spun at 4000 rpm and baked for 20 mins. at 110° C. in an oven. Photolithography is then performed on the frontside using Shipley 1827 spun at 4000 rpm and softbaked at 90° C. in an oven for 30 mins. Exposure is performed on a Karl Suss MA6 contact aligner with backside alignment optics. Total exposure dose at H-line is 200 mJ/cm$^2$ (10 sec exposure). Develop time is 1 min. 10 secs in Microposit MF319 developer. The mask is mask #2 shown in FIG. 10B. A 1 minute 100 Watt oxygen plasma descum is performed in the March PX-series asher after developing. The top nitride layer is etched in the PlasmaTherm RIE tool using etch recipe #14 (described above) for 15 mins, rotated 180 degrees, and etched for 15 more mins. A 200 Watt, 200 sec., 350 mT oxygen plasma descum is then performed in the March PX-series asher to remove any resist that was sputtered into the pattern during the RIE etch. (This step is necessary; if the descum is not performed the subsequent wet etch step will experience significant undesired masking.) A wet oxide etch is then performed in Transene Improved Buffered Hydrofluoric Acid Etch (BHF) for 12 mins. (This is a significant overetch. 5 minutes etch would probably be sufficient.) Heated Baker PRS 2000 positive resist stripper is used to remove the photoresist. The topside dielectric films have now been removed from the membrane areas and the vias have been opened to the thin nitride film over the polysilicon. A DekTak 6M surface profilometer was used to measure the etch depth after photoresist removal. A value of 1.03-1.08 μm was obtained, which indicates that the top nitride and oxide layers have been fully etched down to the second nitride layer.

The next step is to etch through the second nitride layer in the locations where contact needs to be made to the polysilicon layer. The backside is first protected with Shipley 1827 spun at 3000 rpm and baked for 20 mins. at 110° C. in an oven. Photolithography is then performed on the frontside using Shipley 1827 spun at 3000 rpm and softbaked at 90° C. in an oven for 30 mins. Exposure is performed on the EV620 contact aligner. Total exposure dose at H-line is 260 mJ/cm$^2$ (13 sec exposure). Develop time is 1 min. 10 secs in Microposit MF319 developer. The mask is mask #3 shown in FIG. 10C. A 1 minute, 80 Watt, 280 mT oxygen plasma descum is performed in the March PX-series asher after developing. The thin nitride layer is then etched in the PlasmaTherm RIE tool using etch recipe #14 (described above) for 3.5 mins, rotated 180 degrees, and etched for 3.5 more mins. After etching, a probestation is used to measure the resistance between adjacent vias (2 mm apart), giving a value of approximately 100Ω. This indicates that the doped polysilicon has been exposed by the etch, as desired. A 200 Watt, 350 mT, 5 min. oxygen plasma followed by 10 mins. in hot PRS 2000 is used to strip the resist.

The next step is a polysilicon etch, which is used to define in situ strain gauges in the polysilicon layer. Again, the backside is protected with Shipley 1827 spun at 3000 rpm and baked for 20 mins. at 110° C. in an oven. Photolithography is then performed on the frontside using Shipley 1827 spun at 4000 rpm and softbaked at 90° C. in an oven for 30 mins. Exposure is performed on the EV620 contact aligner. Total exposure dose at H-line is 200 mJ/cm$^2$ (10 sec exposure). Develop time is 1.1 minutes in Microposit MF319 developer. The mask is mask #4 shown in FIG. 10D. A 1 minute, 100 Watt, 280 mT oxygen plasma descum is performed in the March PX-series asher after developing. The nitride/polysilicon/nitride laminate is then etched in the PlasmaTherm RIE tool using etch recipe #10 (polysilicon etch described above) for 16 mins, rotated 180 degrees, and etched for 16 more mins. After etching, the remaining oxide under the etched areas was measured on the Nanospec 6100 at 1.78 μm, indicating that the etch is all the way through the nitride/poly/nitride and has etched about 0.18 μm into the oxide. A 300 Watt, 350 mT, 5 min. oxygen plasma followed by 10 mins. in hot PRS 2000 is used to strip the resist.

The next step in the process is to deposit the Cr/Au metalization, which will be patterned using liftoff. Again, the backside is protected with Shipley 1827 spun at 3000 rpm and baked for 20 mins. at 110° C. in an oven. Photolithography is then performed on the frontside using Clariant AZ 9260 photoresist spun at 1000 rpm and softbaked at 90° C. in an oven for 30 mins. (Resulting in a 17 μm thick resist film.) Exposure is performed on the EV620 contact aligner. Total exposure dose at H-line is 1600 mJ/cm$^2$ (80 sec exposure). Develop time is 3 mins. in 1:3 Clariant AZ4OOK:$H_2O$ (a potassium-based buffered developer) developer. This developing time varies considerably more than the 1800 series develop time. Developing could take anywhere from 2 to 5 minutes. It is important to examine the resist after developing with both a microscope and a contact profilometer to ensure that developing is complete. The mask is mask #5 shown in FIG. 10E. The pads for wirebonding, the bond pads for the top Sn—Au bond, the metal interconnects, and contact to the polysilicon layer for the anodic bonding studs are all performed by this metal layer. A 100 second, 100 Watt, 280 mT oxygen plasma descum is performed in the March Px-series asher after developing.

A 50 nm Cr layer is now sputtered onto the frontside of the process wafers followed by a 2 μm Au layer. Sputtering is carried out in a Enerjet DC magnetron sputterer in a 7 mT Argon ambient. Film thickness is determined by the sputtering time (3 mins 30 secs for the Cr at 650 Watts, 12 min 30 secs for the Au at 0.5 Amps without rotation) based on a calibrated deposition rate. The wafers are then left to soak in acetone for 12 hours to dissolve the AZ 9260 resist and allow the thick Cr/Au to lift off as one piece. By using a long acetone soak, the use of ultrasonics is avoided. This significantly reduces the number of unwanted particles, and results in more sharply defined edges to the metal pattern. The thick Cr/Au will often lift off as a single piece. If particles or ragged edges remain after liftoff, heated 1112A remover and ultrasonics may be used to improve the liftoff. At this stage, the process wafers are in the situation shown in FIG. 9B.

Clariant AZ 9260 photoresist is spun onto the frontside of the process wafers at 2000 rpm for 30 secs and softbaked for 20 mins at 110° C. in an oven. (Approximately 10 μm thick.) This will protect the frontside structures during backside processing. AZ 9260 is then spun onto the backside at 2000 rpm for 30 secs and softbaked at 90° C. in the oven for 30 mins. The resist is exposed on the EV620 contact aligner with 1100 mJ/cm$^2$ total dose (55 secs exposure time). The mask is frontside aligned to the previously patterned oxide on the backside. The pattern on the mask defines the shape of all the membrane structures and the fluidic filling ports. The mask also includes lines between the dies, which will allow the DRIE etch to be used to separate the individual dies, avoiding the need for dicing, which the membranes would not survive. See Mask 6 in FIG. 10F. The resist is developed for 3 mins in 1:3 Clariant AZ400K:$H_2O$ (develop time may vary).

The process wafers are then mounted to 100 mm diameter, 500 μm thick silicon handle wafers using Shipley 1827 resist spun for 4 secs at 500 rpm, then 3 secs at 3000 rpm, and hardbaked in a 110° C. oven for 20 mins. These handles are needed to hold the wafers during the subsequent deep reactive ion etching (DRIE) process. Even though the etch is not all the way through the wafer, the depth of the etch and the tendency of silicon to cleave along crystal planes can result in the process wafers breaking if a handle is not used. The deep silicon etch is now performed from the backside in an STS Deep-Trench RIE (DRIE) tool (time-multiplexed DRIE with an inductively coupled plasma), running a modified Bosch process. A 2 min $O_2$ plasma descum (800 W coil power, 200 W platen power, 50 sccm $O_2$, 45 mT) is performed in the STS tool prior to starting the etch. (Etch Process parameters: Etch step: 13 secs, 160 sccm $SF_6$, 35 mT, 800 W coil power, 200 W platen power. Passivation step: 7 secs, 80 sccm $C_4F_8$, 15 mT, 600 W coil power, 0 W platen power.) Etch time is 1 hour 45 minutes. The etch depth is measured using a Zygo New View 5000 white-light interferometer. It is between 250-350 um with more variation wafer-to-wafer than across an individual wafer. (Variation across an individual wafer approximately 10 μm).

Figure 9A:
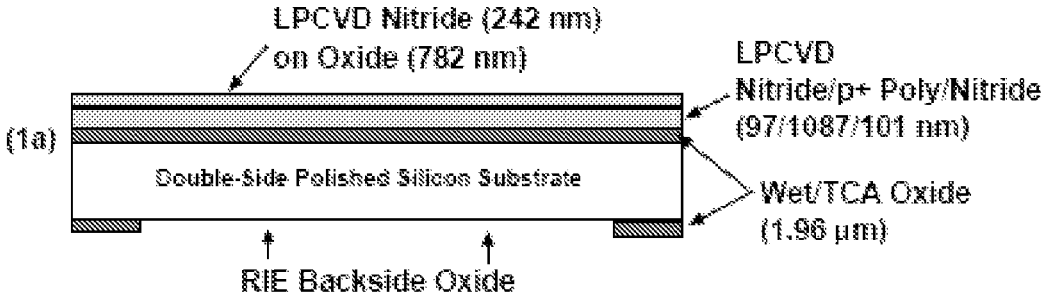
FIGS. 9A-9I are diagrams of a microfabrication process.
Figure 9B:
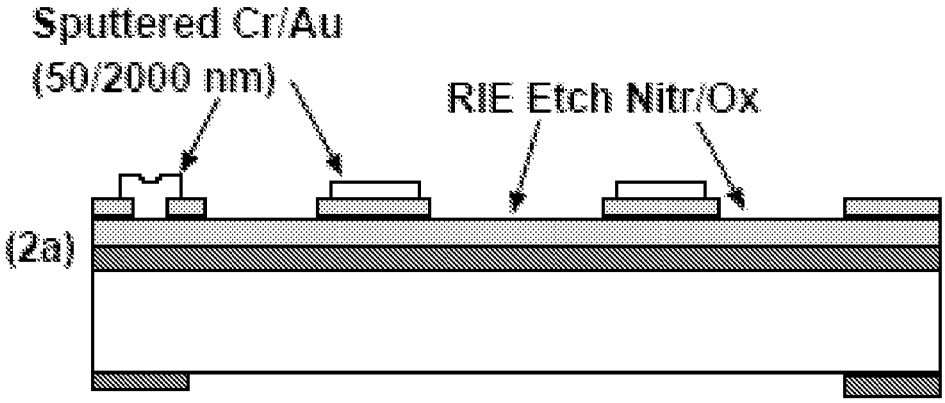
Figure 9C:
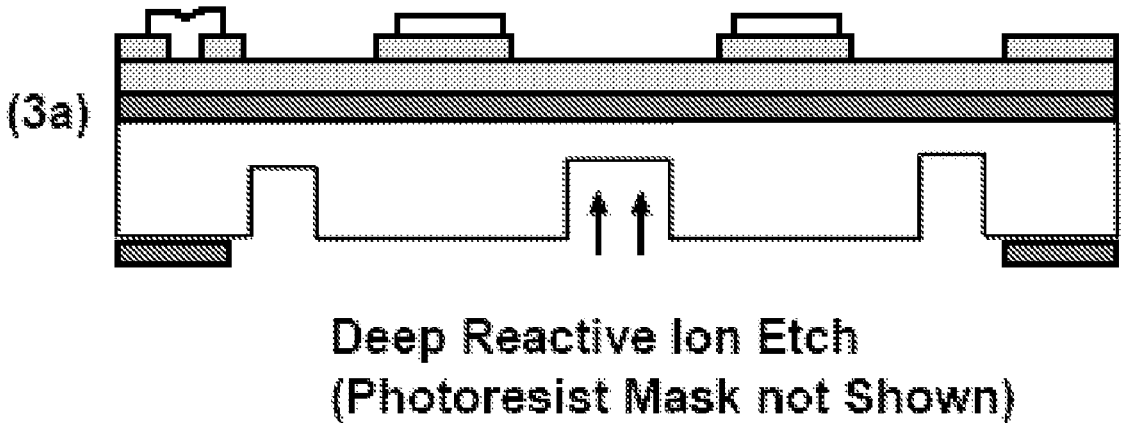

The process wafers are separated from the handle wafers in hot Baker PRS 2000, and then left to soak in PRS 2000 for an additional 15 minutes to remove all the AZ 9260 photoresist. Care should be taken when removing the wafers from the handles, as the deep etch lines from the DRIE etch can cause the wafers to break. A 10 minute Piranha clean (1:1 $H_2SO_4$:$H_2O_2$) may be carried out to further clean the wafers if residues are observed. The situation at this point is seen in FIG. 9C.

Clariant AZ 9260 photoresist is then spun onto the frontside of the process wafers at 2000 rpm for 30 secs and softbaked for 20 mins at 110° C. in an oven. (Approximately 10 μm thick.) This will protect the frontside structures during backside processing, particularly as the membranes become fragile after release.

Two options are available for the final DRIE etch. The first option, which was used for the single-channel sensors is to cleave the wafer into individual dies along the deep lines etched during the previous DRIE step. Each individual die is blown off carefully with dry nitrogen to remove any silicon dust which may have been generated during cleaving. The dies are mounted around the outside of a 500 μm thick silicon handle wafer with AZ 9260 resist spun at 2000 rpm for 30 secs. The resist is hardened by baking in the 110° C. oven for 30 minutes. The dies are arranged around the edge of the handle because the DRIE etch is nonuniform across the wafer, but most rapid around the outside of the wafer. If arranged in this way, the final DRIE etch will take approximately 1 hour and 30 minutes.

The second option, which was used for the μCAT design is to mount the process wafer to a handle as a whole wafer using Shipley 1827 resist spin at 500 RPM for 4 secs and then 2000 RPM for 10 secs, followed by mounting the process wafer and baking in a 110° C. oven for 30 minutes. If this option is used, the DRIE etch will take more time, approximately 2 hours and 30 minutes is expected. Due to the long etch time, there is danger of the oxide mask breaking through and ruining the devices. If this option is selected, the oxide mask should either be thicker than 2 μm (3 μm would be sufficient) or the earlier DRIE etch should be lengthened.

A final through-wafer DRIE etch is now performed, using the backside $SiO_2$ as an etch mask (patterned using Mask #1 at the beginning of the process). The same etch recipe as the first DRIE step, described above, is used. The etch time to completely etch through to the etch-stop oxide is between 1.5 and 2.5 hours. The 2 μm of thermal $SiO_2$ serves as an etch stop for the etch. The etch rate of the $SiO_2$ is approximately 200 times slower than the Si. Due to this, some etch nonuniformity can be tolerated. If too much overetch is required, however, the $SiO_2$ may thin too much and the membranes could break or the masking oxide could break through. This step is the worst step as far as yield for this reason; once the membranes are etched out they become fragile and can easily break. The protective coat of AZ 9260 helps in this regard, as does a clean handle wafer. During the through etch, the pattern widens by approximately 50 μm in each lateral dimension. So, a trench will end up being 90-120 μm wider than the masked dimensions. If the etch is not complete, the wafers can be returned to the etch chamber and etched for additional time to complete the etch.

The dies (still attached to a handle wafer with resist) are next dipped in isopropyl alcohol for 10 secs and immediately transferred to 1:1 HF:$H_2O$ (with isopropanol still wetting the surface). They are etched in the 1:1 HF for 7 mins. The membranes look initially rippled after coming out of the DRIE etch, because of the compressive stress in the oxide etch stop. After about 4 mins in 1:1 HF, the membranes will appear to flatten out as the oxide is removed. If the etch is allowed to proceed for too long, the nitride will begin to slowly etch away and some membranes may fracture. The isopropanol dip is needed to stop the formation of air bubbles in the etched trench. The isopropanol completely fills the deep trenches with no bubble formation. The HF is then able to replace the IPA without forming bubbles. If the wafer is put into HF directly, air bubbles will form in the etched trench and stop the etchant from being able to reach and remove the oxide layer, resulting in a buckled membrane.

Figure 9D:
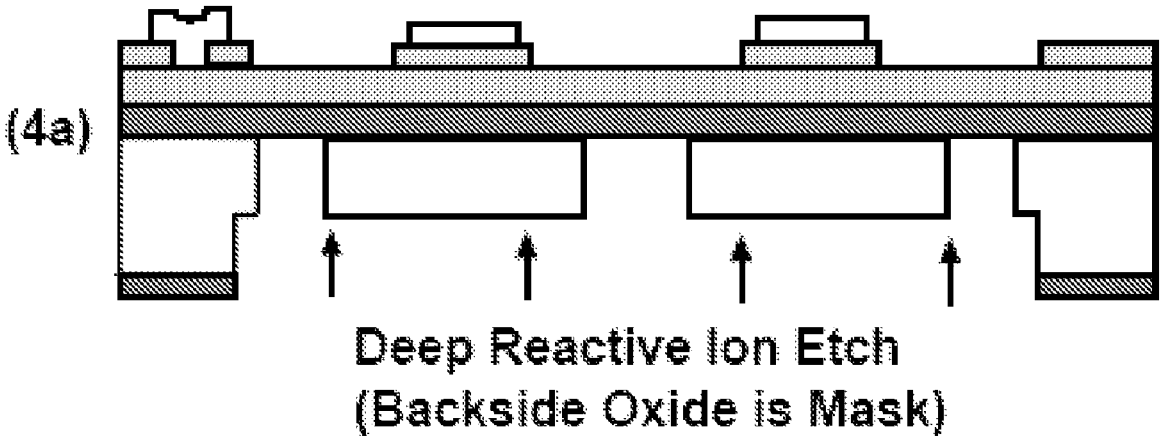
Figure 9E:
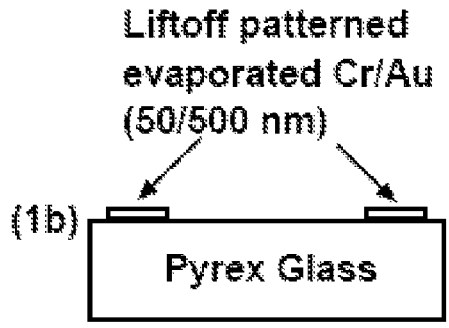

The dies (still on a handle wafer) are rinsed gently in a DI water cascade (no agitation or bubbles) and then transferred to an acetone soak for 10-20 hours, which will release the dies from the handle wafer. The individual dies are rinsed in acetone (10 mins), then isopropanol (5 mins), then water (5 mins). The dies are finally cleaned in 1:1 $H_2SO_4$:$H_2O_2$ (Piranha) for 10 mins and rinsed in water, and then dried in the 110° C. oven. After cleaning and drying, the membranes for the single-channel dies appear flat (<0.1 μm deflection) under the white light interferometer. The μCAT dies show upward deflections of 1-2μ which are thought to be due to the thin film stresses acting on the global mechanics of the chip. The situation at this point is seen in FIG. 9D.

Glass Processing

Figure 9F:
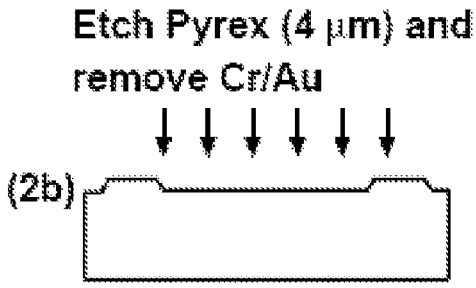

A 500 μm thick, 100 mm diameter Pyrex glass wafer (Cornng type 7740 borosilicate glass with Na and Al doping) is now processed to produce the top electrodes for capacitive sensing. First, the wafer is cleaned in 1:1 $H_2SO_4$:$H_2O_2$ (Piranha) for 10 mins. The first step is to etch the legs which will act as spacers to hold the Pyrex above the silicon. Cr/Au will be used to mask the etch, patterned by liftoff. To this end, photolithography is performed on the frontside using Shipley 1827 spun at 3000 rpm and softbaked at 115° C. on a hotplate for 1.5 mins. Exposure is performed on the EV620 contact aligner with a total exposure dose at H-line of 320 mJ/cm$^2$ (16 sec exposure). Develop time is 1 min. 10 secs in Microposit MF319 developer. The mask is mask #7 shown in FIG. 10G. A 1 minute, 150 Watt, 250 mT oxygen plasma descum is performed in the March PX-series asher. 50 nm of Cr, followed by 500 nm Au is evaporated onto the Pyrex wafer in an Enerjet E-beam evaporator. The film thicknesses are monitored on-line during deposition using a frequency-shift measurement in a resonating crystal. Liftoff is performed using heated Shipley Microposit 1112A Remover, ultrasonic, and a DI water rinse. FIG. 9B shows the situation at this point. As shown in FIG. 9F, the Cr/Au is then used as an etch mask as the Pyrex is etched in 3:1 $H_2O$:HF. The etch rate for this step was found to vary considerably from wafer to wafer (perhaps due to changes in the glass composition). Etch rates were in the range of 1-10 μ/min. For the single channel devices, the etch was 3.9 μm deep after 3.5 mins. The etch depth is determined using the DekTak 6M Surface Profilometer. Undercut for this etch is substantial. For a 4 μm deep etch, the mask is undercut by 65 μm on either side. It may be possible to reduce the undercut by using different etchants (such as HF:$HNO_3$) or by using a different Pyrex formulation or surface finish. This etch time may be varied (or the step even removed) to reduce the sense gap and increase sensitivity, at the risk shorting out the sensor. The Cr/Au etch mask is removed using a 5 minute etch in Transene TFA Gold Etchant (KI-$I_2$ Complex) followed by a rinse and a 2 minute etch in Cyantek CR-14 Chromium etchant (22% $(NH_4)_2Ce(NO_3)_6$+8% HAc+$H_2O$).

A second liftoff is next performed to pattern the electrodes on the Pyrex. Photolithography is performed on the frontside using Clariant AZ 9260 spun at 2000 rpm and softbaked at 115° C. on a hotplate for 4.5 mins. (Final thickness 10 μm.) The thick resist is used order to have good step coverage of the etched glass. Exposure is performed on the EV620 contact aligner with a total exposure dose at H-line of 1400 mJ/cm$^2$ (70 sec exposure). Develop time is 3 minutes in 1:3 Clariant AZ4OOK:$H_2O$ developer. The mask is mask #8 shown in FIG. 10G. A 2 minute, 200 Watt, 350 mT oxygen plasma descum is performed in the March PX-series asher. 20 nm of Cr, followed by 100 nm of Pt is evaporated onto the Pyrex wafer in an Enerjet E-beam evaporator. The film thicknesses are monitored on-line during deposition using a frequency-shift measurement in a resonating crystal. Liftoff is performed using heated Shipley Microposit 1112A Remover. Since the Cr/Pt has very high stress, it tends to generate a lot of particles during liftoff. In order to avoid shorts in the sense gap, it is critical to avoid particle generation. Thus, ultrasonic should not be used to assist in the Cr/Pt liftoff. Patience and heated 1112A, perhaps in multiple stages, with DI water rinses in between can generate a particle-free liftoff. Good contact was obtained over the glass etch steps, with measured resistance on the order of 20-30Ω.

The final lithography step on the glass wafer is used to deposit and pattern the Sn "bumps" which will form the Sn—Au bond to the silicon die. Photolithography is performed on the frontside using Clariant AZ 9260 spun at 2000 rpm and softbaked at 115° C. on a hotplate for 4.5 mins. (Final thickness 10 μm.) The thick resist is used in order to have good step coverage of the etched glass. Exposure is performed on the EV620 contact aligner with a total exposure dose at H-line of 1400 mJ/cm$^2$ (70 sec exposure). Develop time is 3 minutes in 1:3 Clariant AZ4OOK:$H_2O$ developer. The mask is mask #7 shown in FIG. 10G (the same mask as used for the glass etch). A 2 minute, 200 Watt, 350 mT oxygen plasma descum is performed in the March PX-series asher. 1.3 μm of Sn is evaporated onto the Pyrex wafer in an Cooke E-beam evaporator. The film thickness is monitored on-line during deposition using a frequency-shift measurement in a resonating crystal. Liftoff is performed using a 10 hour acetone soak. Again, to avoid generating particles, ultrasonic is avoided during liftoff. Acetone must be used rather than 1112A as the 1112A will attack the Sn. The Sn thickness is confirmed using a Zygo white-light interferometer to measure the total height of the glass etch and the Sn.

Both sides of the glass wafer are next protected with AZ 9260 resist spun at 2000 rpm and baked first on a hotplate at 115° C. for 4.5 mins for the frontside coat, and then in a 110° C. oven for 20 mins after the backside spin coat. The glass wafer is then diced into individual dies on a MicroAutomation 1006 dicing saw, using the Cr/Pt lines as alignment. The dicing saw mounting film and protective photoresist are removed in an acetone soak followed by an isopropanol soak and drying in a 110° C. oven. The individual dies are now ready for bonding to the frontside of the silicon dies.

A second unpatterned Pyrex glass wafer is protected with AZ 9260 photoresist in the same fashion, and diced into rectangular pieces on the MicroAutomation dicing saw. These glass pieces are cleaned first in acetone and isopropanol, then in a Piranha clean (1:1 $H_2SO_4$:$H_2O_2$), and then dried in a 110° C. oven. These glass pieces are now ready for bonding to the backside of the silicon. For the single-channel sensors, the glass pieces are 12.5 mm by 12.5 mm square, for the μCAT they are 41.4 mm by 9.4 mm.

Bonding and Packaging

Figure 9G:
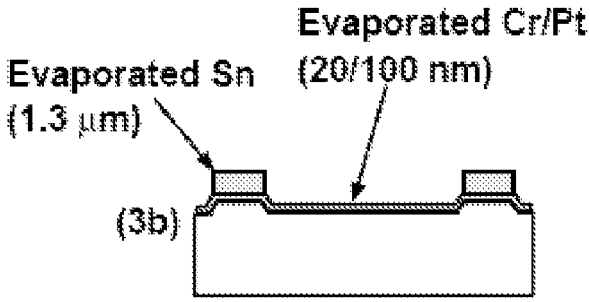
Figure 9H:
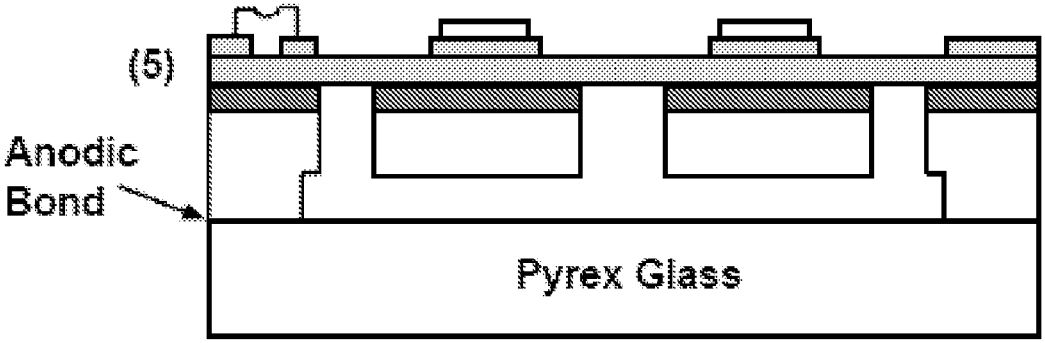
Figure 9I:
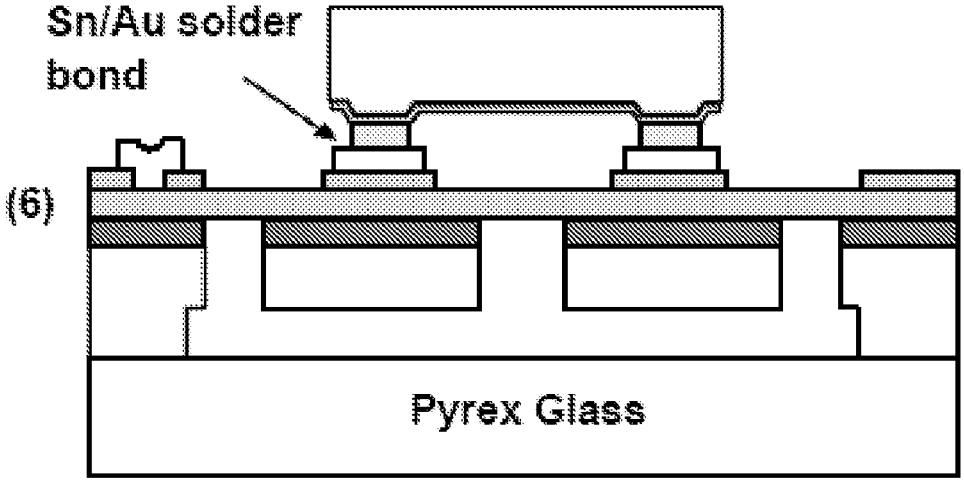
Figure 10A:
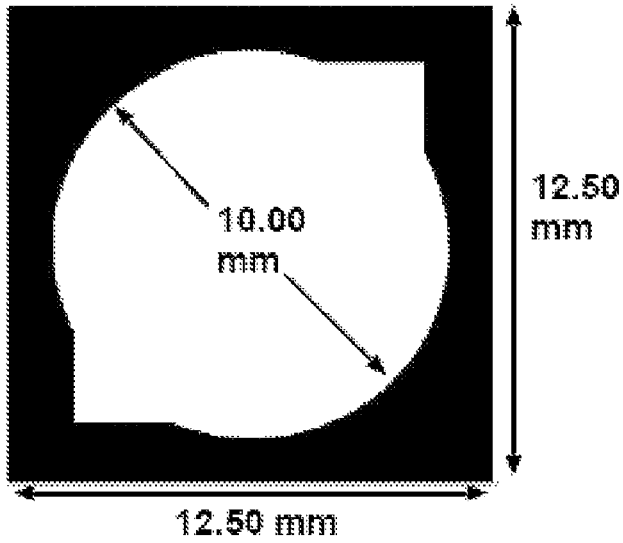
FIGS. 10A-10G are schematic views of a mask set for manufacturing the single channel acoustic sensor system. Each full mask contains 10 dies of this type. There are four different designs, which differ in the size of the central sensing membrane and in the number of radially located arc-segment input membranes. Note that the same mask set also includes the multichannel MEMS cochlea design which takes up most of the space. If only the single-channel hydrophone designs were included, 25 more dies would fit on each 4" wafer. In the diagram, white colored regions are transparent in the mask, black colored regions are opaque.
Figure 10B:
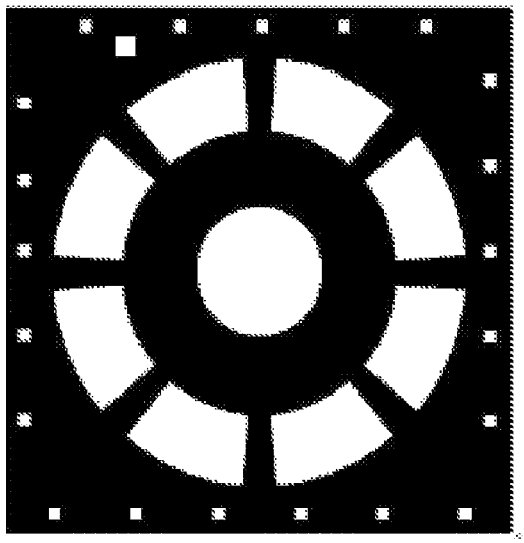
Figure 10C:
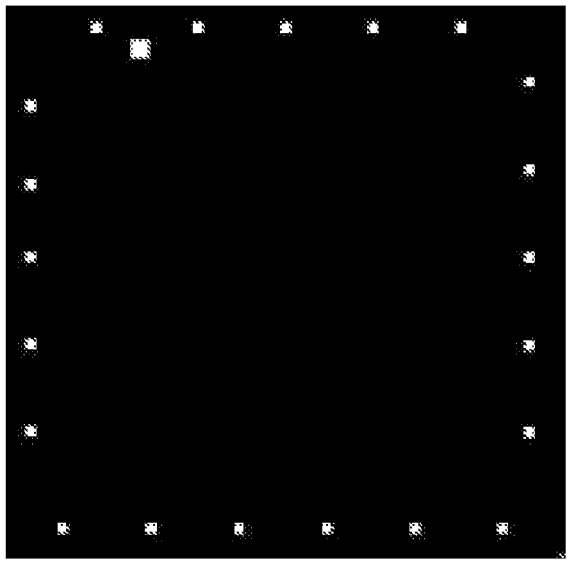
Figure 10D:
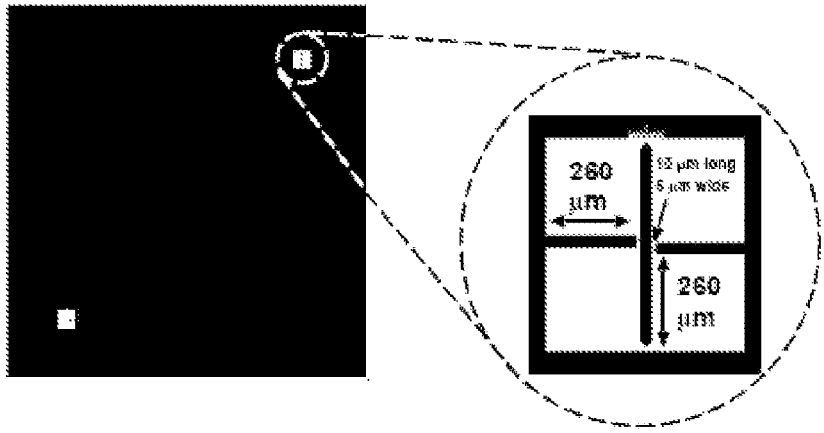
Figure 10E:
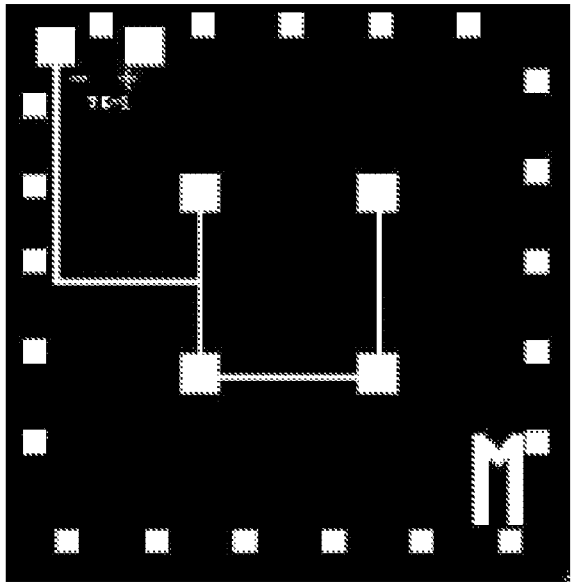
Figure 10F:
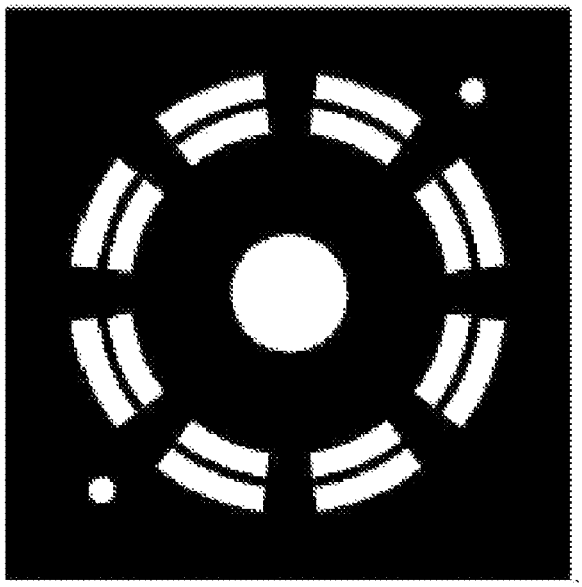
Figure 10G:
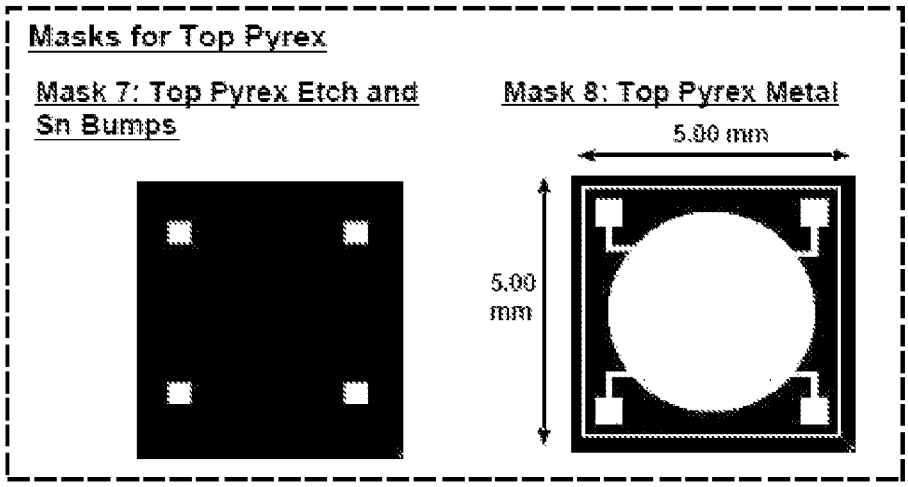

Once all the dies are prepared, the two final bonding steps shown in FIGS. 9C and 9G are conducted. First, the silicon dies are aligned to the unpatterned backside glass pieces by eye (the dies are the same size, so gross alignment is easy). Anodic bonding is carried out in a custom bonding jig. The bonding jig is machined out of aluminum, with two parallel aluminum plates. A bonding jig is needed since the commercial bonding tools which are available at the Michigan Nanofab are not capable of handling dies of this size. On one plate is a raised ridge slightly smaller than the die. On the other plate is a slight recess which allows positioning of the die. The ridge makes contact around the edge of the die while allowing the gap between the aluminum plates to be large enough to avoid arcing. Alumina ($Al_2O_3$) screws with steel springs are used to clamp the two sides together, providing a small clamping force (<10N) while maintaining electrical isolation between the two plates. Springs are needed to take up the mismatch in thermal expansion between the aluminum and alumina, or the screws will break.

The bond is performed in a $N_2$ glovebox on a hotplate at between 320° C. and 330° C. with a 700 V DC bias for 30 minutes. The anodic bonding step can change the stress in the diaphragm layer due to thermal expansion mismatches between the Pyrex and the silicon. This can be advantageous; after the silicon dies for the μCAT design are released, there is usually a small deflection (1-5 μm) of the membrane. After bonding, the membranes can be made to flatten out. In order to accomplish this, it is important that the silicon die expands more than the Pyrex die, so that during cooling the thermal mismatch introduces tensile rather than compressive residual stress into the silicon. The thermal coefficients of expansion of silicon and Pyrex are similar, but the total strain is expected to be equal at a temperature of 280° C. Experimental results in the literature, corroborated by experiments conducted as part of this study, indicate that to induce tensile stress in the silicon, the bonding temperature should be higher than this, 315° C. to 350° C. Also, it would be advantageous to have the silicon at a higher temperature than the glass. Thus, the silicon die is placed closer to the hotplate, the glass die further from the hotplate. This necessitates that the high voltage electrode be on the bottom, and the ground electrode be on the top (the silicon must be held at a positive potential with respect to the glass). Thus, to avoid applying a high voltage to the hotplate, a Boron Nitride ceramic layer is placed between the bonding jig and the hotplate surface. This material is electrically insulating but thermally conducting. It was found that keeping the anodic bond temperature between 320 and 330° C. and keeping the silicon closer to the hotplate often resulted in flat membranes after bonding. However, this part of the process was not repeatable. Flat membranes were produced only approximately 50% of the time. It seems possible that the variability of the bonding step is due to variability of the mechanical clamping forces originating from the loose electrodes on the bonding jig. Use of a commercial bonder (such as the Karl Suss SB-6 or the EV 501) with special tooling to accommodate these die sizes would improve process yield considerably.

The best anodic bonding process is therefore to turn the hotplate on with a setting of 360° C. After 40 minutes the base of the bonding jig will reach a temperature of 320° C. This temperature is measured by a thermocouple inserted into the center of the base of the jig. (Hence the actual die temperature during bonding is expected to be somewhat lower.) The voltage is applied gradually (steps of 50 V over 3 mins, allowing the current at each step to reduce to 0.1 mA). Once 700 V is reached, the bond is allowed to continue for 30 minutes. During this time the bonding jig heats to 328° C. as measured by the thermocouple. At this point, the current should have dropped to less than 0.02 mA, and the hotplate and the voltage source should be turned off. The bonding jig will cool to room temperature in approximately 1.5 hours. Note that anodic bonding occurs most easily to p-type (boron doped) silicon, hence the choice of starting substrate doping.

The topside, patterned Pyrex dies are then bonded to the silicon using Sn—Au solder bonding on a hotplate at 350° C. (as measured by a thermocouple inserted into the base of the jig) for 30 mins in a $N_2$ ambient. A 350° C. thermocouple temperature is achieved with a hotplate setting of 500° C. A custom bonding jib is used to apply a clamping force (10 N for the single channel sensor, 50 N for the μCAT) during the bond. The bonding stress resulting from this clamping force is approximately 100 MPa for the single channel sensor, 15 MPa for the μCAT. In order to ensure electrical conductivity and mechanical strength of the Sn—Au bond, the temperature used during the bonding process is critical. If the temperature is too high, the Sn diffuses too rapidly into the Au on both sides of the bond, and the bond is weak. If the temperature is too low, the Sn—Au alloy will not form at all. In addition, the clamping force must be high enough to remove any curvature of the glass due resulting from high tensile stresses in the Platinum electrodes. The bonds at the corners of the die are usually successful. The bonds towards the center of the die are the most likely to fail. In future iterations of the process it may be advantageous to increase the clamping force used for the multichannel system. Care must be taken that this will not break the chip.

The 350° C. bonding temperature is measured by a thermocouple embedded in a 5 mm thick aluminum block between the hotplate surface and the die. It is expected that the actual temperature at the die surface will be somewhat lower than the temperature measured by the thermocouple. In order to produce an open sensing gap (not shorted), it was critical to avoid any particles on either of the electrodes. Particles were generated mainly during the liftoff processing. The problem can be greatly mitigated by avoiding the use of ultrasonics. In addition, the use of Microposit 1112A, rather than acetone, as a liftoff solvent whenever possible reduced the particle count. Acetone was used for Sn liftoff due to chemical compatibility issues.

In the final step, needles are epoxied into the needle fill ports which were etched during the DRIE steps. Needles are epoxied into all the ports (both inlet and outlet ports), so that any silicone oil coming out of the outlet ports during filling will not spill over onto the front surface of the sensor. A micrometer injection jig is used to inject silicone oil into the fluid chamber. The needles are cut off and the inlet and outlet ports are sealed with epoxy. The use of high viscosity silicone (200 cSt or 500 cSt) improves the ability to fill the chamber without generation of bubbles. The high viscosity allows the bubbles that do form in the fluid chamber steps to be dragged out by the fluid flowing past. The glass backside allows the chamber to be observed during filling, so any small bubbles that do form can be removed by continuing to flow silicone oil through the chamber until they are forced out. The finished device is mounted in a hybrid leadless ceramic chip carrier (LCCC) package and wirebonded using Au wires.

Diaphragm Stress

Silicon nitride, silicon dioxide, polysilicon, and photodefineable polyimide have all been used as diaphragm materials in this work. Often the stresses for a given material vary considerably depending on process conditions and even reactor geometry. Polysilicon has historically been one of the most popular structural materials in MEMS devices.

In order to produce slightly tensile membranes for sensor structures, laminated thin film structures were used to produce a net stress in the 0-100 MPa tensile region. Both nitride/polysilicon/nitride and nitride/oxide/nitride laminates were successful in this respect. Other options for reducing residual stress which were not attempted included corrugation or embossing of the membrane and silicon-on-insulator technology.

Electronics

This describes the details of the electronics used in microsystem measurement. Two sets of electronics for MEMS sensor operation will be described. The first is for the single-channel sensors. The second set is for the multichannel cochlear-like sensor. A test circuit used for capacitor and impedeance measurements will also be described.

Capacitive Sensor Readout

Figure 19:
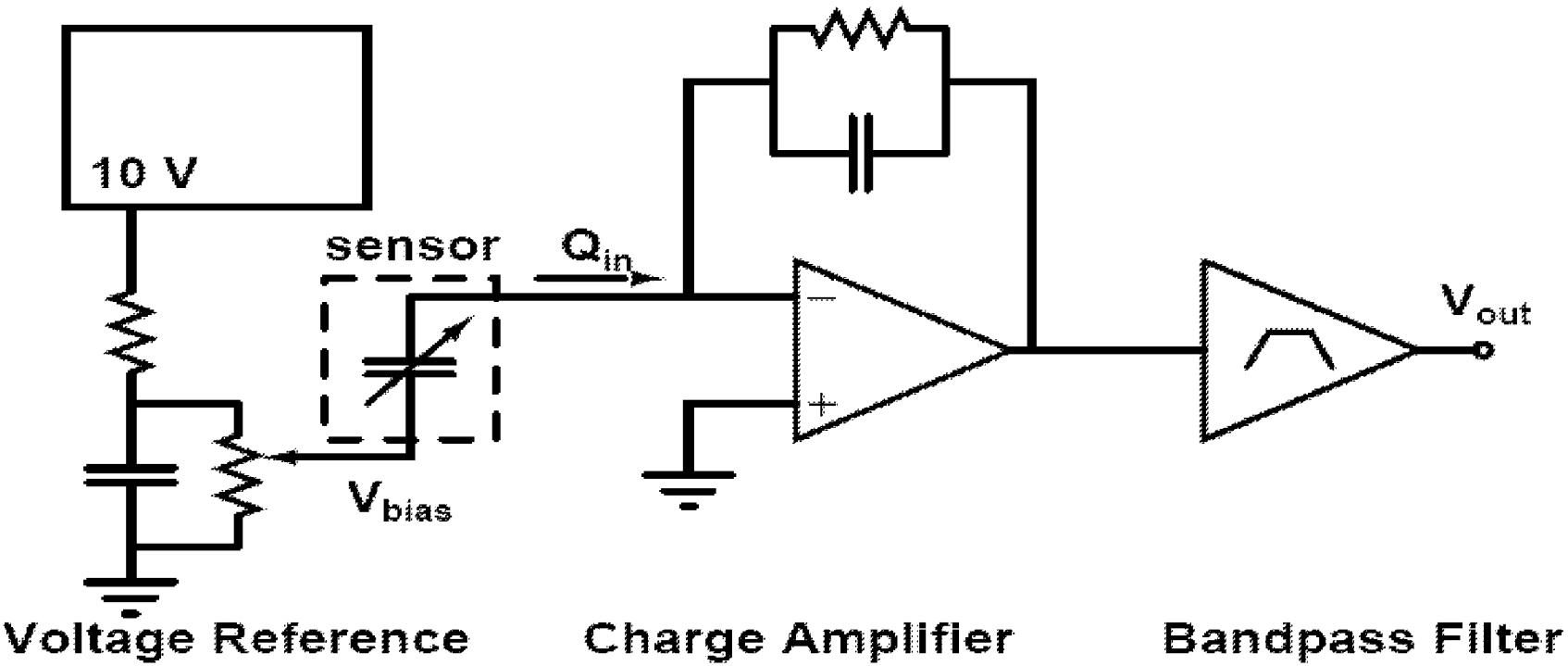
FIG. 19 is a schematic view of single channel system electronics, including DC voltage reference, charge amplifier, and bandpass filter.

Capacitive sensor readout requires three components: a charge amplifier, a DC bias source, and a filter and gain stage. FIG. 19 shows the architecture concept. The electronics should be low noise, and capable of operating across the frequency band of interest. Surface mount technology on custom printed circuit boards was chosen to implement the systems. Power is supplied by batteries to avoid picking up 60 Hz hum from the power lines. The entire system is mounted inside a grounded aluminum box to shield against RF interference.

DC Bias

An ADR01 reference IC is used to supply the DC bias. This chip gives a 10 V output. The output is filtered using a passive RC to reduce the noise contributions of the reference IC, which will otherwise feed directly into the sensor noise output. This can be a significant noise source if not filtered correctly.

Charge Amplifier

Figure 20:
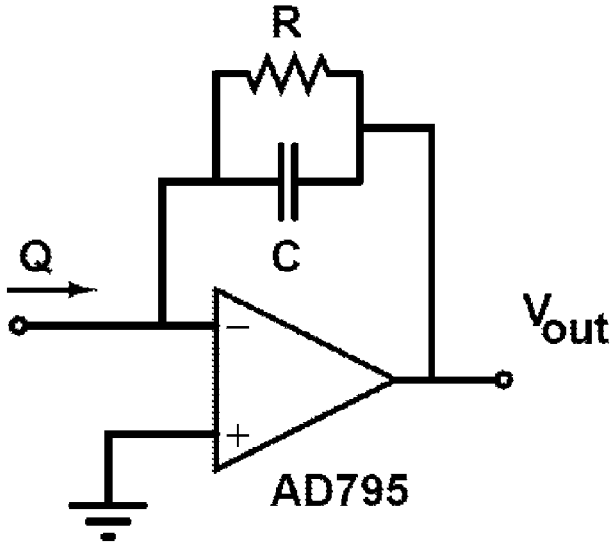
FIG. 20 is a charge amplifier schematic.

The charge amplifier takes charge injected from the MEMS sensor and generates a voltage. The charge amplifier should have a very high input impedance, as the charges generated are very small. The AD795, a low noise, precision, FET input operational amplifier from Analog Devices was chosen for this purpose due to its low voltage noise and very high input impedance. The circuit, shown in FIG. 20, is very simple. For an ideal opamp, it results in a voltage output $$V_{out} = \frac{-Q_{in}}{C} \tag{C.1}$$

Figure 21:
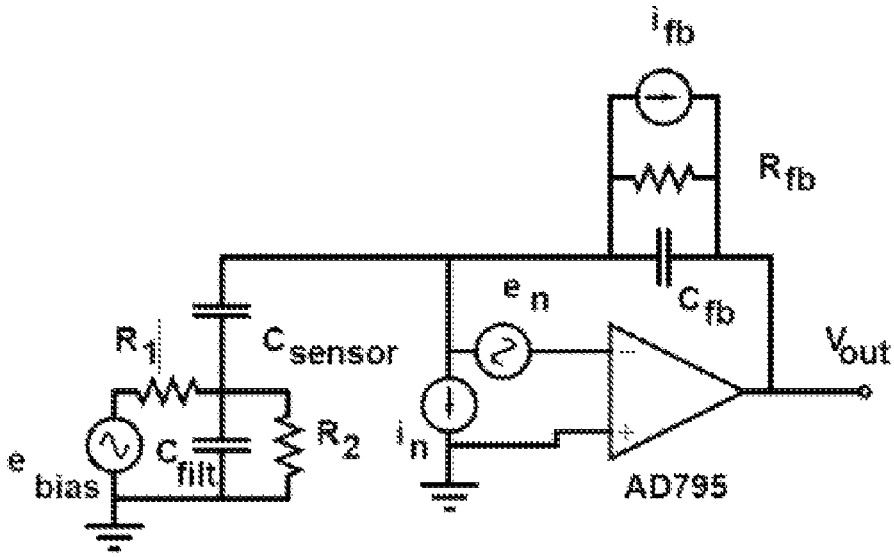
FIG. 21 is a charge amplifier schematic including noise sources.

The feedback resistor stabilizes the charge amp output at DC, creating a high pass filter with cutoff frequency $f=1/(2\pi RC)$. With R=200 MΩ, C=10 pF, f=80 Hz. The feedback capacitor cannot be reduced much below 10 pF before stray capacitances are larger than the component itself. Thus, the 200 MΩ resistor will set the low frequency cutoff of the chargeamp. It is important for these two passive components to be high quality, so a silvered mica capacitor and a thick film resistor are used. A model including the major noise sources for the charge amplifier is shown in FIG. 21. The voltage noise and current noise of the amplifier can be found from the data sheets, $e_n$=10 nV/Hz$^{1/2}$ and $i_n$=0.6 fA/Hz$^{1/2}$·$i_{fb}\sqrt{rkT/R_{fb}}$ is the Johnson noise of the feedback resistor. $e_{bias}$ is the noise coming from the ADR01 DC reference IC. The data sheets and measurements indicate that it is 2 μV/Hz$^{1/2}$ below 50 Hz, with a corner frequency at 500 Hz resulting in a reducing noise density frequency. The low pass filter on the bias source has $C_{filt}$=1 μF, $R_1$=10 kΩ. $R_2$ is the bias setting potentiometer, 100 kΩ if the bias is set at the maximum of 9 V.

Simple circuit analysis can be used to compute the transfer function from each noise source to the preamplifier output.

$$V_{bias} = \frac{R_{fb}C_{sensor}j\omega}{1 + R_{fb}C_{fb}j\omega}e_{bias} \quad (C.2)$$

$$V_{en} = \left(1 - \frac{R_{fb}C_{sensor}j\omega}{1 + R_{fb}C_{fb}j\omega}\right)e_n \quad (C.3)$$

$$V_{ifb} = \frac{-R_{fb}}{1 + R_{fb}C_{fb}j\omega}i_{fb} \quad (C.4)$$

$$V_{in} = \frac{-R_{fb}}{1 + R_{fb}C_{fb}j\omega}i_n \quad (C.5)$$

$$V_{out} = \sqrt{V_{bias}^2 + V_{en}^2 + V_{ifb}^2 + V_{in}^2} \quad (C.6)$$

For the single channel sensors as fabricated (the total capacitance is 200 pF, 190-198 pF of which is stray). For the multichannel MEMS sensors, with 32 channels, each channel has 35 pF of total capacitance. Again, the vast majority is stray. Note that the dominant noise sources at low frequencies are the bias noise from the ADR01 DC bias source and the Johnson noise of the feedback resistor. The bias noise becomes more significantly the larger the sensor capacitance, to is dominates with a 200 pF sensor, whereas the Johnson noise dominates with a 35 pF sensor. At high frequencies, the voltage noise of the AD795 dominates. The current noise of the AD795 does not contribute significantly.

The bias noise is reduced considerably by the passive filter consisting of $C_{filt}$ and $R_1$.

Bandpass Universal Active Filter

Figure 22:
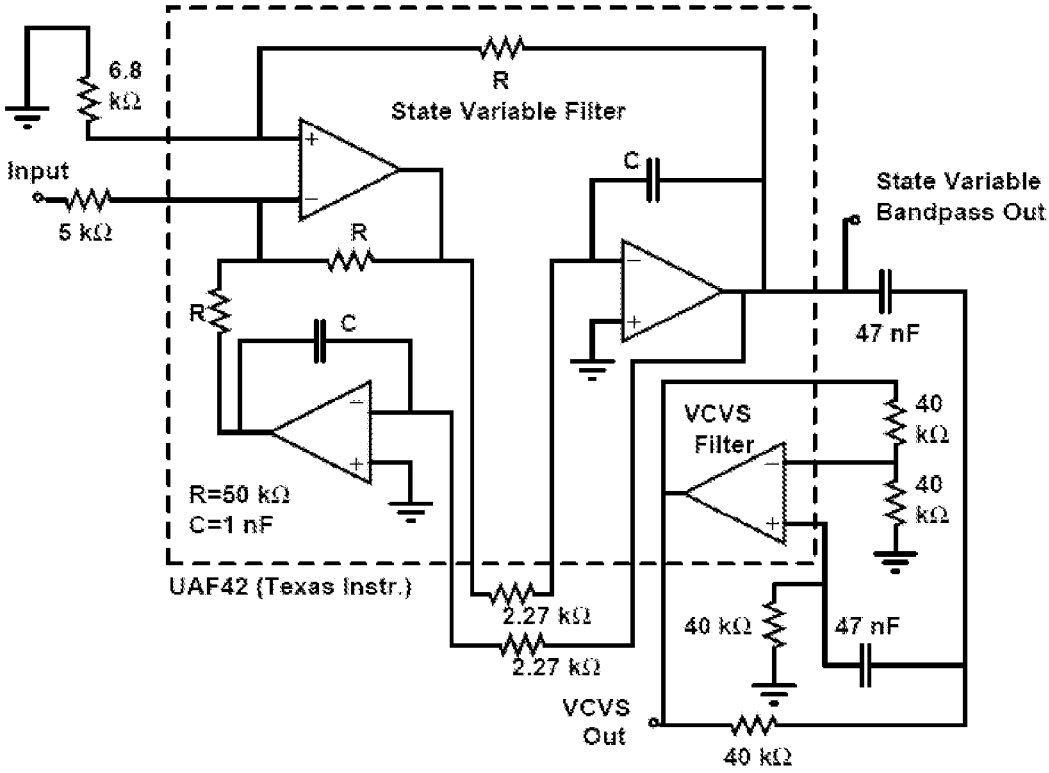
FIG. 22 is a topology of the cascaded state variable bandpass and VCVS high pass filter used in the single channel electronics implemented using a UAF42 universal active filter chip from Texas Instruments/Burr Brown.

The filter used with the single channel sensors is a bandpass filter with a 70 Hz-70 kHz passband with 26 dB of passband gain. This filter is implemented using a UAF42 universal active filter chip from Texas Instruments/Burr Brown. The chip contains 4 opamps. Three of the opamps, along with some internal passive components, can be used to implement a state-variable, or "biquad," bandpass filter. The fourth op-amp is used to implement a VCVS high-pass filter. FIG. 22 shows the circuit topology for this cascaded filter design.

The measured power consumption of the entire electronics is 260 mW, when operating off of +15V and −15V supplies. A SPICE model incorporating manufacturer-supplied models of the UAF42 active filter, the REF01 bias reference (which is similar to the ADR01), and the AD795 charge amplifier predicts a total power consumption of 271 mW. The SPICE model predicts that 216 mW is consumed by the UAF42, 39 mW by the AD795, and 15 mW by the REF01 (accounting for 270 mW). Power consumption could be reduced by operating at a lower voltage, perhaps using a single 3.3 V or 5 V supply. This would reduce sensitivity somewhat because the sensor would operate at a lower bias, but would be a worthwhile tradeoff for low power applications. Additional power savings may be possible by choosing a more efficient active filter scheme.

Dual Sallen-Key Bandpass Filter

Figure 23:
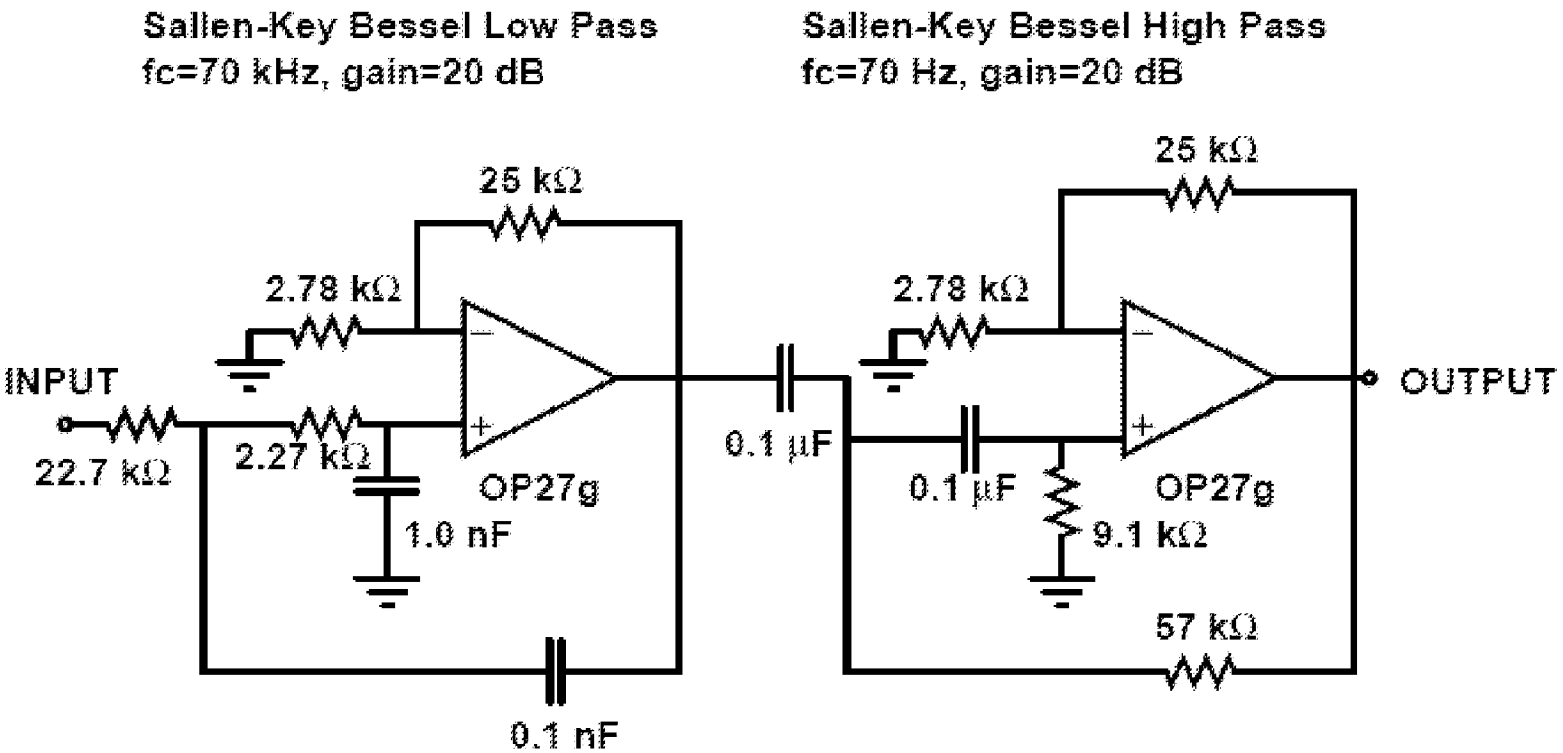
FIG. 23 is a circuit topology for the dual Sallen-Key filter designed as a Bessel filter (minimal time domain distortion; that is, a linear phase lag with frequency).

The filter used with the multichannel cochlear-like sensor is a bandpass filter with a 100 Hz-50 kHz passband with a 40 dB of passband gain. The filter is implemented using two OP27 low noise precision operational amplifier from Analog Devices. Each op-amp is configured as two cascaded Sallen-Key filters designed by Bessel filters (maximally flat time delay). FIG. 23 shows the circuit topology for this cascade filter design.

The measured power consumption of the entire multichannel electronics is 326 mW, when operating off of +15 V and −15 V supplies. A SPICE model incorporating manufacturer-supplied models of the two OP27 dual Sallen-Key filters, the REF01 bias reference (which is similar to the ADR01), and the two AD795 charge amplifier predicts a total power consumption of 316 mW. The power consumption of the ADG506A multiplexers is not included in the model. The SPICE model predicts that 112 mW is consumed by each OP270GS, 38 mW by each of the AD795 chips, and 16 mW by the REF01 (accounting for 316 mW). Power consumption could be reduced by operating at a lower voltage, perhaps using a single 3.3 V or 5 V supply. This would reduce sensitivity somewhat because the sensor would operate at a lower bias, but would be a worthwhile tradeoff for low power applications.

Multiplexer

For the multichannel sensor, as many as 32 channels of sensor output will be delivered. Rather than using 32 charge amplifiers, two 16 channel multiplexer chips were used, each handling half of the output channels from the MEMS system. The output of each multiplexer goes through an AD795 charge amplifier and dual Sallen-Key bandpass filter and gain stage. The channels are selected via two 4 bit addresses on a 9 pin D connector.

Figure 24:
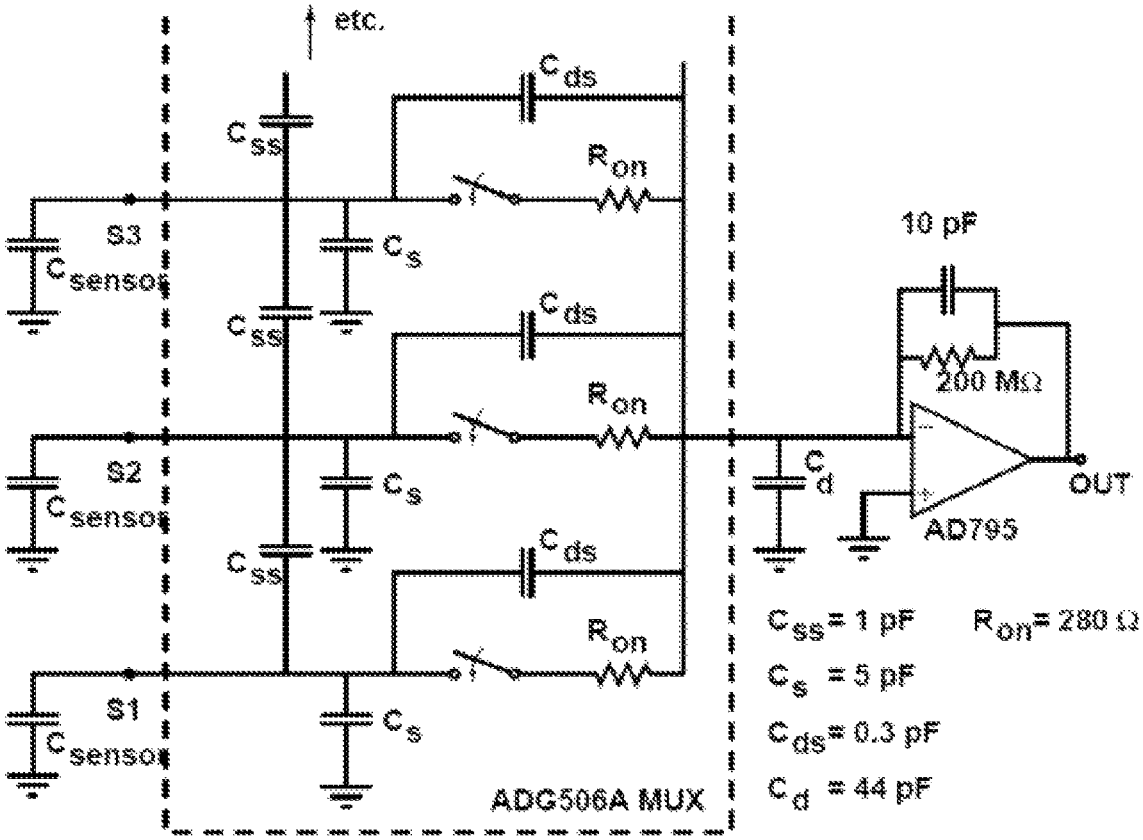

Care has to be taken to adequately filter the digital address signals coming in on the D connector, as they can be quite noisy. The multiplexers selected for this task are Analog Devices ADG506A CMOS monolithic 16 channel analog multiplexers. The multiplexers have an on resistance of $R_{on}$=280Ω, an off source capacitance of $C_8$=5 pF, a drain to source capacitance of $C_{ds}$=5 pF, and a drain to ground capacitance of $C_d$=44 pF. The source to source capacitance, $C_{ss}$ will depend on the stray capacitances in the circuit layout, but is expected to be on the order of 1 pF. Guard traces are used in between all traces leading to the MUX inputs on the PC board in order to reduce channel-to-channel capacitance. The circuit model for the MUX leading in to the charge amplifier is shown in FIG. 24. Based on this model, with the component values shown, −32 dB of crosstalk is expected between adjacent channels, −44 dB between channels with 1 space in between.

While embodiments of the invention have been illustrated and described, it is not intended that these embodiments illustrate and describe all possible forms of the invention. Rather, the words used in the specification are words of description rather than limitation, and it is understood that various changes may be made without departing from the spirit and scope of the invention.

What is claimed is:

1. A micro system for acoustic transduction comprising:

an input membrane configured to vibrate in response to an excitation from acoustic energy in a medium adjacent the input membrane and external to the system;

a closed, liquid filled, acoustic chamber having chamber walls; and a conductive membrane having a variable acoustic impedance along its length, wherein the input membrane and the conductive membrane form portions of the chamber walls, wherein the liquid transfers acoustic energy from the input membrane to the conductive membrane, wherein the conductive membrane is configured to vibrate in response to an excitation from an acoustic pressure wave in the liquid adjacent the conductive membrane, and wherein a location of maximum displacement of the conductive membrane along its length depends on a frequency of the acoustic pressure wave.

2. The system of claim 1 further comprising an array of electrodes spaced away from the conductive membrane wherein one electrode of the array of electrodes and a portion of the conductive membrane proximate the one electrode form a capacitor having a capacitance and wherein the capacitance depends on a distance between the one electrode and the portion of the conductive membrane proximate the one electrode.

3. The system of claim 1 wherein the membrane has first and second ends, wherein the second end is wider than the first end, and wherein the membrane tapers from the second end to the first end.

4. The system of claim 3 wherein the input membrane is proximate to the first end of the membrane.

5. The system of claim 1 wherein the conductive membrane comprises a laminate structure.

6. The system of claim 5 wherein the laminate structure includes a conductive layer disposed between two insulative layers.

7. The system of claim 1 wherein the liquid is silicon oil.

* * * * *